US010636359B2

(12) United States Patent
Zhang et al.

(10) Patent No.: US 10,636,359 B2
(45) Date of Patent: Apr. 28, 2020

(54) OLED VOLTAGE DRIVER WITH CURRENT-VOLTAGE COMPENSATION

(71) Applicant: Apple Inc., Cupertino, CA (US)

(72) Inventors: Sheng Zhang, Milpitas, CA (US); Yunhui Hou, San Jose, CA (US); Chaohao Wang, Sunnyvale, CA (US)

(73) Assignee: Apple Inc., Cupertino, CA (US)

( * ) Notice: Subject to any disclaimer, the term of this patent is extended or adjusted under 35 U.S.C. 154(b) by 0 days.

(21) Appl. No.: 16/132,324

(22) Filed: Sep. 14, 2018

(65) Prior Publication Data

US 2019/0088205 A1 Mar. 21, 2019

Related U.S. Application Data

(60) Provisional application No. 62/561,508, filed on Sep. 21, 2017, provisional application No. 62/561,529, filed on Sep. 21, 2017, provisional application No. 62/561,517, filed on Sep. 21, 2017.

(51) Int. Cl.
*G09G 3/3258* (2016.01)
*G09G 3/3233* (2016.01)

(52) U.S. Cl.
CPC ..... *G09G 3/3258* (2013.01); *G09G 3/3233* (2013.01); *G09G 2310/027* (2013.01); *G09G 2320/029* (2013.01); *G09G 2320/0223* (2013.01); *G09G 2320/0233* (2013.01); *G09G 2320/041* (2013.01); *G09G 2320/045* (2013.01); *G09G 2320/0673* (2013.01)

(58) Field of Classification Search
None
See application file for complete search history.

(56) References Cited

U.S. PATENT DOCUMENTS

| | | | | |
|---|---|---|---|---|
| 9,384,698 | B2 | 7/2016 | Chaji et al. | |
| 9,761,170 | B2 | 9/2017 | Chaji et al. | |
| 2011/0074750 | A1* | 3/2011 | Leon | G09G 3/30 345/207 |
| 2015/0364116 | A1* | 12/2015 | Kong | G09G 3/3291 345/205 |
| 2017/0039953 | A1 | 2/2017 | Lee | |

FOREIGN PATENT DOCUMENTS

KR 20080083778 A 9/2008

OTHER PUBLICATIONS

Partial International Search Report and Written Opinion for PCT Application No. PCT/US2018/051023 dated Nov. 30, 2018; 15 pgs.

* cited by examiner

*Primary Examiner* — Christopher J Kohlman
(74) *Attorney, Agent, or Firm* — Fletcher Yoder, P.C.

(57) ABSTRACT

A mobile electronic device includes a display having an active array and a reference array. The active array includes a pixel and the reference array includes a reference pixel. The mobile electronic device also includes processing circuitry communicatively coupled to the display. The processing circuitry drives the pixel based at least in part on a degraded current-voltage relationship of the pixel, a reference current-voltage relationship of the reference pixel, and an aged current-voltage relationship.

20 Claims, 46 Drawing Sheets

OLED VOLTAGE DRIVER WITH CURRENT-VOLTAGE COMPENSATION

CROSS-REFERENCE TO RELATED APPLICATION

This application claims priority to U.S. Provisional Patent Application No. 62/561,529, filed Sep. 21, 2017, entitled "OLED Voltage Driver with Current-Voltage Compensation," U.S. Provisional Patent Application No. 62/561,517, filed Sep. 21, 2017, entitled "OLED Voltage Driver with Current-Voltage Compensation," and U.S. Provisional Patent Application No. 62/561,508, filed Sep. 21, 2017, entitled "OLED Voltage Driver with Current-Voltage Compensation," the contents of which are each incorporated by reference in their entireties for all purposes. This application is also related to co-pending U.S. patent application Ser. No. 16/132,320, entitled "OLED Voltage Driver with Current-Voltage Compensation," and co-pending U.S. patent application Ser. No. 16/132,322, entitled "OLED Voltage Driver with Current-Voltage Compensation," the contents of which are each incorporated by reference in their entireties for all purposes.

BACKGROUND

The present disclosure relates generally to electronic displays and, more particularly, to compensating for voltage degradation in an electronic display with voltage-driven pixels and/or current-driven.

This section is intended to introduce the reader to various aspects of art that may be related to various aspects of the present disclosure, which are described and/or claimed below. This discussion is believed to be helpful in providing the reader with background information to facilitate a better understanding of the various aspects of the present disclosure. Accordingly, it should be understood that these statements are to be read in this light, and not as admissions of prior art.

Flat panel displays, such light emitting diode (LED) displays, are commonly used in a wide variety of electronic devices, including such consumer electronics as televisions, computers, and handheld devices (e.g., cellular telephones, audio and video players, gaming systems, and so forth). Such display panels typically provide a flat display in a relatively thin package that is suitable for use in a variety of electronic goods. In addition, such devices may use less power than comparable display technologies, making them suitable for use in battery-powered devices or in other contexts where it is desirable to minimize power usage.

LED displays typically include picture elements (e.g. pixels) arranged in a matrix to display an image that may be viewed by a user. Individual pixels of an LED display may generate light as current is applied to each pixel. Current may be applied to each pixel by programming a voltage to the pixel that is converted by circuitry of the pixel into the current. The circuitry of the pixel that converts the voltage into the current may include, for example, thin film transistors (TFTs). However, certain operating conditions, such as aging or temperature, may affect the amount of current applied to a pixel when applying a certain voltage.

Voltage degradation in pixels may occur due to at least aging. For example, at a first time, a first voltage may be applied to a diode of the pixel, such that a target current results at the diode and causes the diode to emit a light of a target brightness level. However, over time and use of the pixel, voltage degradation may occur. That is, a second voltage different (e.g., greater) than the first voltage may be applied to the diode to result in the target current and cause the diode to emit the light of the target brightness level.

SUMMARY

A summary of certain embodiments disclosed herein is set forth below. It should be understood that these aspects are presented merely to provide the reader with a brief summary of these certain embodiments and that these aspects are not intended to limit the scope of this disclosure. Indeed, this disclosure may encompass a variety of aspects that may not be set forth below.

The present disclosure relates to compensating for voltage degradation in an electronic display with voltage-driven pixels and/or current-driven. The disclosure may be used in connection with a variety of self-emissive electronic displays, including, for example, light emitting diode (LED) displays, such as organic light emitting diode (OLED) displays, active matrix organic light emitting diode (AMOLED) displays, or micro LED (μLED) displays. Individual pixels of an LED display may generate light based at least in part on a current applied to each pixel. The current may be applied to each pixel by programming a voltage to the pixel, which may be converted in the pixel into the current that is applied to the pixel. The conversion of the voltage into current may be regulated by circuitry that includes, for example, thin film transistors (TFTs). Since the behavior of the circuitry of the pixels may change over time from aging of the pixels, non-uniform temperature gradients, or other factors, the voltages applied to the pixels across the display may be adjusted to compensate for these variations, thereby improving image quality by reducing visible image artifacts due to pixel non-uniformity. The non-uniformity of pixels in a display may vary between devices of the same type (e.g., two similar phones, tablets, wearable devices, or the like), may vary over time and usage (e.g., due to aging and/or degradation of the pixels or other components of the display), and/or may vary with respect to temperatures, as well as in response to additional factors, such as electromagnetic interference (EMI) from other electronic components.

To improve display panel uniformity, adaptive correction or compensation of the display may be employed using behavior observed on a "reference array" of the display. The reference array may be adjacent to or part of an active array or area of the display that is hidden from view (e.g., at an edge of the display that is covered by a housing of the display). As such, the pixels of the reference array may have characteristics similar to the pixels of the viewable part or the active area of the display, but may not be visible when activated. Because the reference array may be used mostly for pixel testing, however, the pixels of the reference array may be operated much less often than the pixels in the visible part or active array of the display. As such, the pixels of the reference array may be considered to have experienced substantially no aging in comparison to the rest of the pixels of the display. The behavior of the pixels of the reference array thus may provide a baseline behavior that would be expected for pixels of the visible part or active array of the display without aging effects.

Accordingly, measurements of the behavior of the reference array of the display may be used to determine a baseline current-voltage relationship of the pixels of the main active area. The measurements may be obtained based at least in part on a power supply voltage level and capture gamma tap points for each brightness setting of the display based at least in part on the current-voltage curve. The reference array may be used to determine the current-voltage relationship when temperature at the display changes (e.g., when compared to a certain threshold). In another example, processing circuitry coupled to the display may drive a pixel of an active array based at least in part on a current-voltage relationship of the pixel and a reference current-voltage relationship of a reference pixel of the reference array. In some cases, the processing circuitry may include a current-voltage compensation circuit that receives degradation ratios, an input voltage, and an input reference current, and outputs a compensation voltage. A digital-to-analog converter may then drive the pixel based at least in part on the compensation voltage.

Various refinements of the features noted above may be made in relation to various aspects of the present disclosure. Further features may also be incorporated in these various aspects as well. These refinements and additional features may be made individually or in any combination. For instance, various features discussed below in relation to one or more of the illustrated embodiments may be incorporated into any of the above-described aspects of the present disclosure alone or in any combination. The brief summary presented above is intended only to familiarize the reader with certain aspects and contexts of embodiments of the present disclosure without limitation to the claimed subject matter.

BRIEF DESCRIPTION OF THE DRAWINGS

Various aspects of this disclosure may be better understood upon reading the following detailed description and upon reference to the drawings in which.

DETAILED DESCRIPTION OF SPECIFIC EMBODIMENTS

Figure 1:
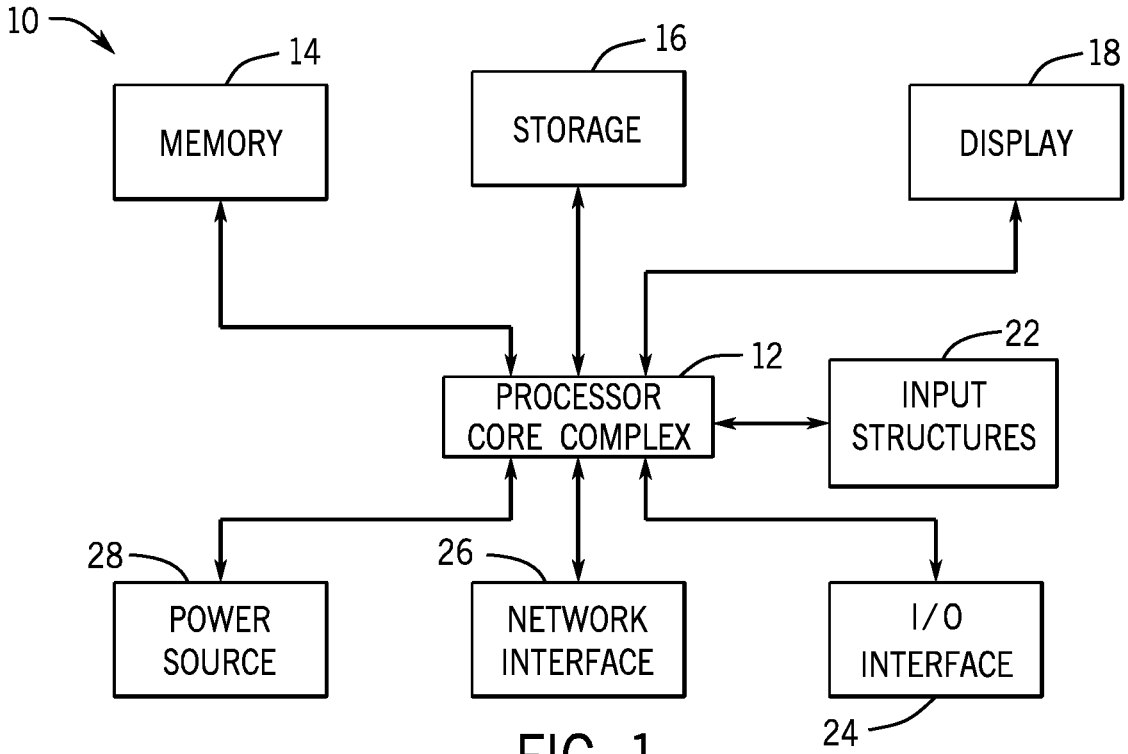
FIG. 1 is a schematic block diagram of an electronic device that performs display sensing and compensation, in accordance with an embodiment.

One or more specific embodiments will be described below. In an effort to provide a concise description of these embodiments, not all features of an actual implementation are described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. Additionally, it should be understood that references to "one embodiment" or "an embodiment" of the present disclosure are not intended to be interpreted as excluding the existence of additional embodiments that also incorporate the recited features. Furthermore, the phrase A "based on" B is intended to mean that A is at least partially based on B. Moreover, the term "or" is intended to be inclusive (e.g., logical OR) and not exclusive (e.g., logical XOR). In other words, the phrase A "or" B is intended to mean A, B, or both A and B.

Electronic displays are ubiquitous in modern electronic devices. As electronic displays gain ever-higher resolutions and dynamic range capabilities, image quality has increasingly grown in value. In general, electronic displays contain numerous picture elements, or "pixels," that are programmed with image data. Each pixel emits a particular amount of light based at least in part on the image data. By programming different pixels with different image data, graphical content including images, videos, and text can be displayed.

Display panel sensing allows for operational properties of pixels of an electronic display to be identified to improve the performance of the electronic display. For example, variations in temperature and pixel aging (among other things) across the electronic display cause pixels in different locations on the display to behave differently. Indeed, the same image data programmed on different pixels of the display could appear to be different due to the variations in temperature and pixel aging. For example, a pixel emits an amount of light, gamma, or gray level based at least in part on an amount of current supplied to a diode (e.g., an LED) of the pixel. For voltage-driven pixels, a target voltage may be applied to the pixel to cause a target current to be applied to the diode (e.g., as expressed by a current-voltage relationship or curve) to emit a target gamma value. Variations may affect a pixel by, for example, changing the resulting current that is applied to the diode when applying the target voltage. Without appropriate compensation, these variations could produce undesirable visual artifacts.

Accordingly, the techniques and systems described below may be used to compensate for operational variations across the display using a reference array having control circuitry that determines a current-voltage relationship based at least in part on a power supply voltage level and captures gamma tap points for each brightness setting of the display based at least in part on the current-voltage curve. The reference array control circuitry may determine the current-voltage relationship when temperature at the display changes (e.g., when compared to a certain threshold). Additionally, processing circuitry coupled to the display may drive a pixel of an active array based at least in part on a current-voltage relationship of the pixel and a reference current-voltage relationship of a reference pixel of the reference array. Moreover, the processing circuitry may include a current-voltage compensation circuit configured that receives degradation ratios, an input voltage, and an input reference current, and outputs a compensation voltage. A digital-to-analog converter may then drive the pixel based at least in part on the compensation voltage.

Figure 2:
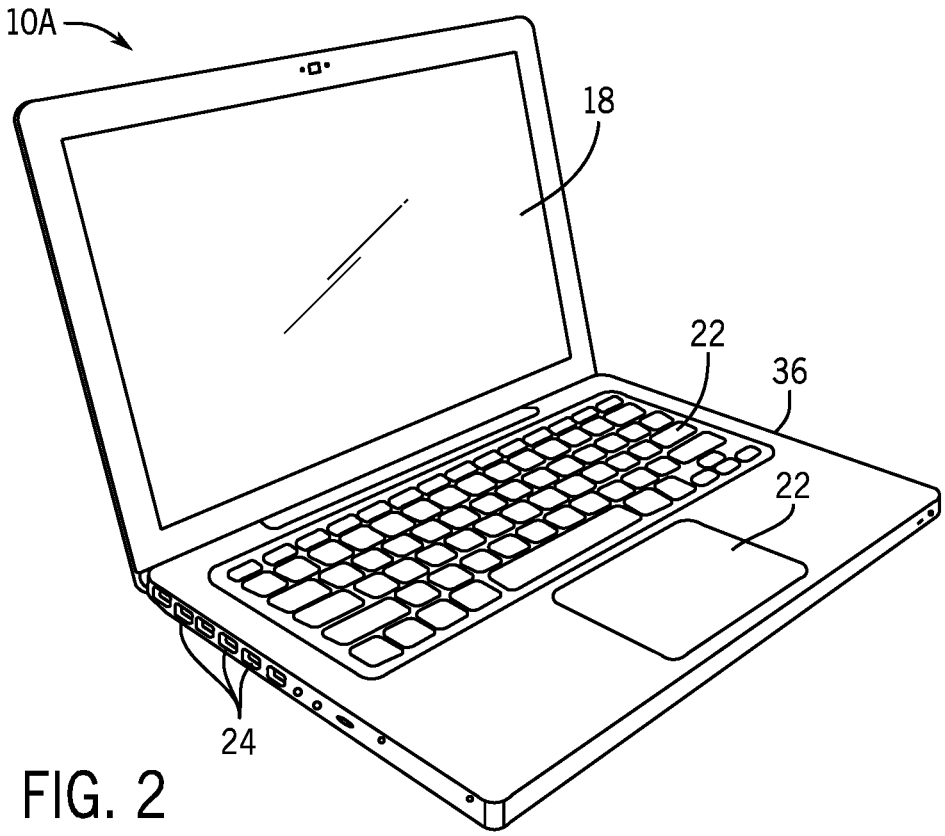
FIG. 2 is a perspective view of a notebook computer representing an embodiment of the electronic device of FIG. 1.
Figure 4:
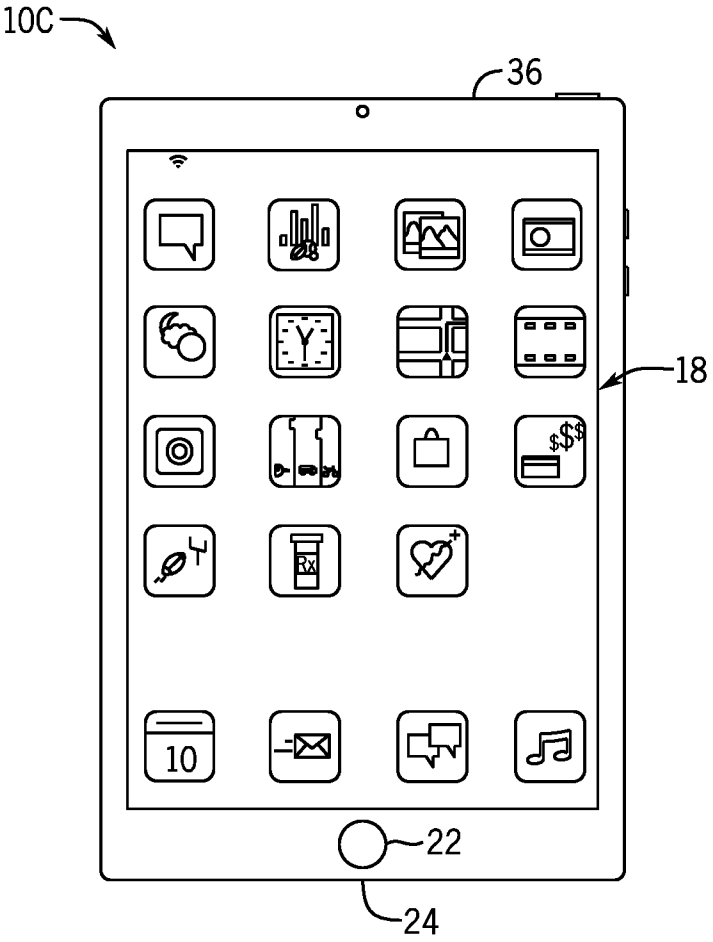
FIG. 4 is a front view of another hand-held device representing another embodiment of the electronic device of FIG. 1.
Figure 3:
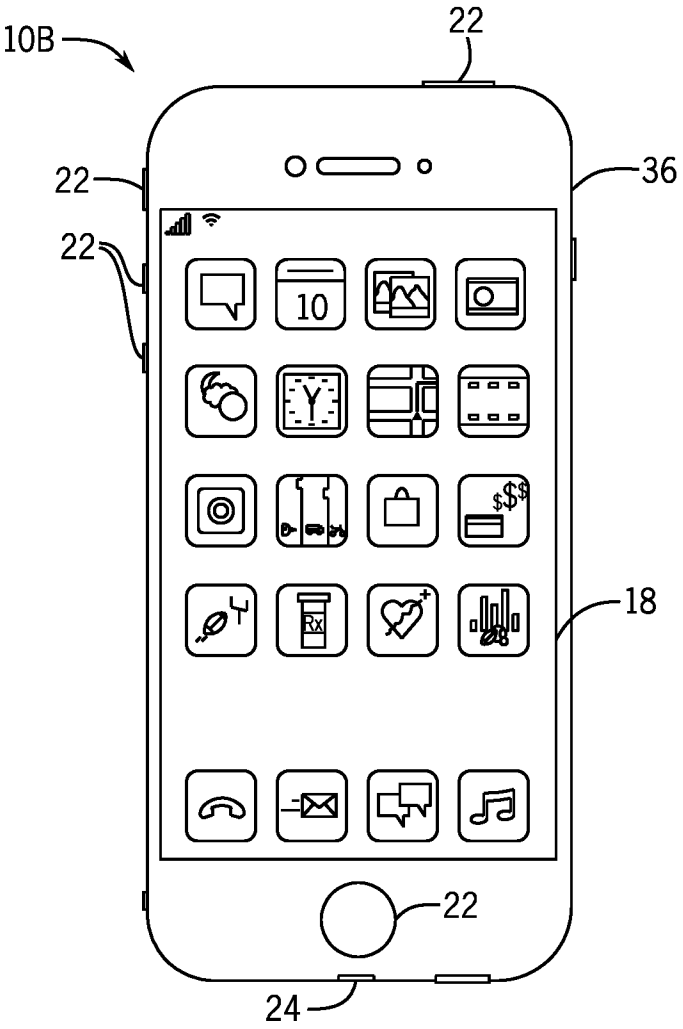
FIG. 3 is a front view of a hand-held device representing another embodiment of the electronic device of FIG. 1.
Figure 5:
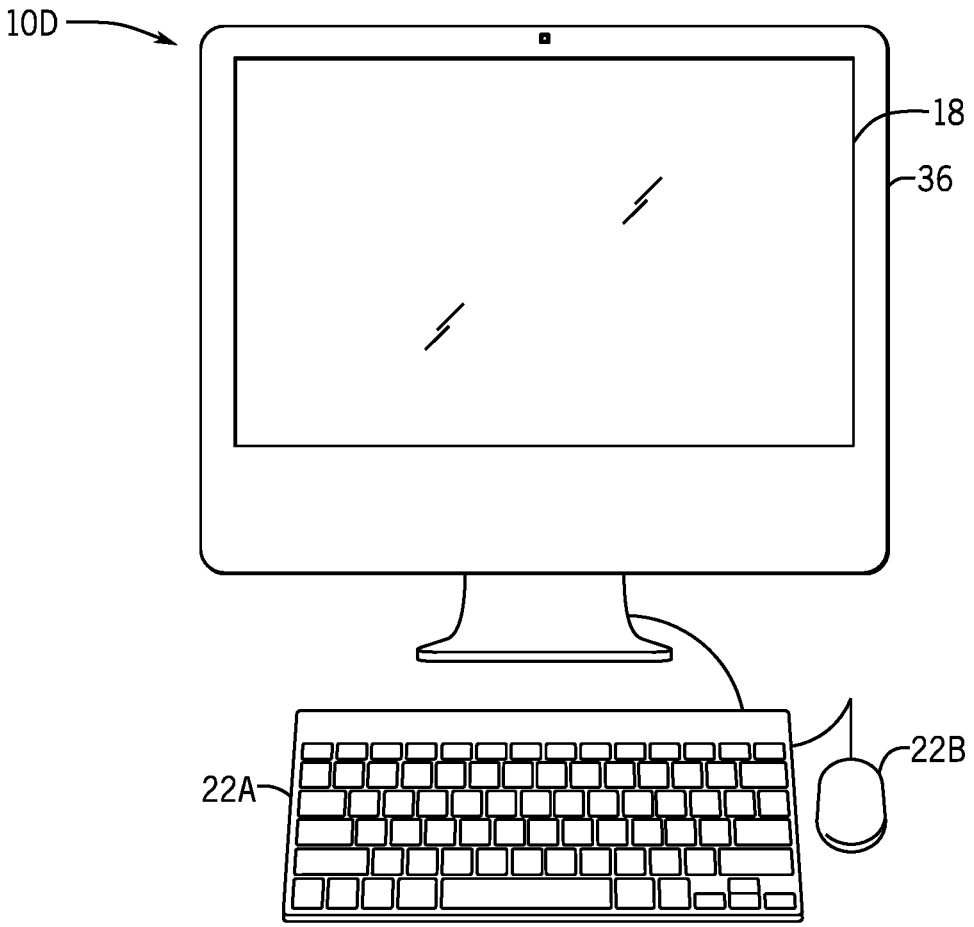
FIG. 5 is a front view of a desktop computer representing another embodiment of the electronic device of FIG. 1.
Figure 6:
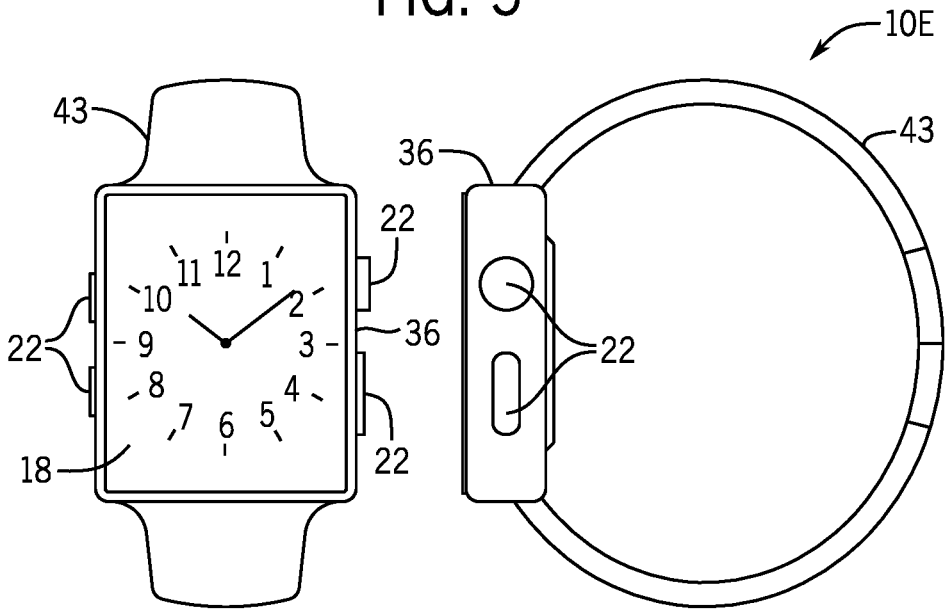
FIG. 6 is a front view and side view of a wearable electronic device representing another embodiment of the electronic device of FIG. 1.

With this in mind, a block diagram of an electronic device 10 is shown in FIG. 1. As will be described in more detail below, the electronic device 10 may represent any suitable electronic device, such as a computer, a mobile phone, a portable media device, a tablet, a television, a virtual-reality headset, a vehicle dashboard, or the like. The electronic device 10 may represent, for example, a notebook computer 10A as depicted in FIG. 2, a handheld device 10B as depicted in FIG. 3, a handheld device 10C as depicted in FIG. 4, a desktop computer 10D as depicted in FIG. 5, a wearable electronic device 10E as depicted in FIG. 6, or a similar device.

The electronic device 10 shown in FIG. 1 may include, for example, a processor core complex 12, a local memory 14, a main memory storage device 16, an electronic display 18, input structures 22, an input/output (I/O) interface 24, network interfaces 26, and a power source 28. The various functional blocks shown in FIG. 1 may include hardware elements (including circuitry), software elements (including machine-executable instructions stored on a tangible, non-transitory medium, such as the local memory 14 or the main memory storage device 16) or a combination of both hardware and software elements. It should be noted that FIG. 1 is merely one example of a particular implementation and is intended to illustrate the types of components that may be present in electronic device 10. Indeed, the various depicted components may be combined into fewer components or separated into additional components. For example, the local memory 14 and the main memory storage device 16 may be included in a single component.

The processor core complex 12 may carry out a variety of operations of the electronic device 10, such as causing the electronic display 18 to perform display panel sensing and using the feedback to adjust image data for display on the electronic display 18. The processor core complex 12 may include any suitable data processing circuitry to perform these operations, such as one or more microprocessors, one or more application specific processors (ASICs), or one or more programmable logic devices (PLDs). In some cases, the processor core complex 12 may execute programs or instructions (e.g., an operating system or application program) stored on a suitable article of manufacture, such as the local memory 14 and/or the main memory storage device 16. In addition to instructions for the processor core complex 12, the local memory 14 and/or the main memory storage device 16 may also store data to be processed by the processor core complex 12. By way of example, the local memory 14 may include random access memory (RAM) and the main memory storage device 16 may include read only memory (ROM), rewritable non-volatile memory such as flash memory, hard drives, optical discs, or the like.

The electronic display 18 may display image frames, such as a graphical user interface (GUI) for an operating system or an application interface, still images, or video content. The processor core complex 12 may supply at least some of the image frames. The electronic display 18 may be a self-emissive display, such as an organic light emitting diodes (OLED) display, a micro-LED display, a micro-OLED type display, or a liquid crystal display (LCD) illuminated by a backlight. In some embodiments, the electronic display 18 may include a touch screen, which may allow users to interact with a user interface of the electronic device 10. The electronic display 18 may employ display panel sensing to identify operational variations of the electronic display 18. This may allow the processor core complex 12 to adjust image data that is sent to the electronic display 18 to compensate for these variations, thereby improving the quality of the image frames appearing on the electronic display 18.

The input structures 22 of the electronic device 10 may enable a user to interact with the electronic device 10 (e.g., pressing a button to increase or decrease a volume level). The I/O interface 24 may enable electronic device 10 to interface with various other electronic devices, as may the network interface 26. The network interface 26 may include, for example, interfaces for a personal area network (PAN), such as a Bluetooth network, for a local area network (LAN) or wireless local area network (WLAN), such as an 802.11x Wi-Fi network, and/or for a wide area network (WAN), such as a cellular network. The network interface 26 may also include interfaces for, for example, broadband fixed wireless access networks (WiMAX), mobile broadband Wireless networks (mobile WiMAX), asynchronous digital subscriber lines (e.g., ADSL, VDSL), digital video broadcasting-terrestrial (DVB-T) and its extension DVB Handheld (DVB-H), ultra wideband (UWB), alternating current (AC) power lines, and so forth. The power source 28 may include any suitable source of power, such as a rechargeable lithium polymer (Li-poly) battery and/or an alternating current (AC) power converter.

In certain embodiments, the electronic device 10 may take the form of a computer, a portable electronic device, a wearable electronic device, or other type of electronic device. Such computers may include computers that are generally portable (such as laptop, notebook, and tablet computers) as well as computers that are generally used in one place (such as conventional desktop computers, workstations and/or servers). In certain embodiments, the electronic device 10 in the form of a computer may be a model of a MacBook®, MacBook® Pro, MacBook Air®, iMac®, Mac® mini, or Mac Pro® available from Apple Inc. By way of example, the electronic device 10, taking the form of a notebook computer 10A, is illustrated in FIG. 2 in accordance with one embodiment of the present disclosure. The depicted computer 10A may include a housing or enclosure 36, an electronic display 18, input structures 22, and ports of an I/O interface 24. In one embodiment, the input structures 22 (such as a keyboard and/or touchpad) may be used to interact with the computer 10A, such as to start, control, or operate a GUI or applications running on computer 10A. For example, a keyboard and/or touchpad may allow a user to navigate a user interface or application interface displayed on the electronic display 18.

FIG. 3 depicts a front view of a handheld device 10B, which represents one embodiment of the electronic device 10. The handheld device 10B may represent, for example, a portable phone, a media player, a personal data organizer, a handheld game platform, or any combination of such devices. By way of example, the handheld device 10B may be a model of an iPod® or iPhone® available from Apple Inc. of Cupertino, Calif. The handheld device 10B may include an enclosure 36 to protect interior components from physical damage and to shield them from electromagnetic interference. The enclosure 36 may surround the electronic display 18. The I/O interfaces 24 may open through the enclosure 36 and may include, for example, an I/O port for a hard wired connection for charging and/or content manipulation using a standard connector and protocol, such as the Lightning connector provided by Apple Inc., a universal service bus (USB), or other similar connector and protocol.

User input structures 22, in combination with the electronic display 18, may allow a user to control the handheld device 10B. For example, the input structures 22 may activate or deactivate the handheld device 10B, navigate user interface to a home screen, a user-configurable application screen, and/or activate a voice-recognition feature of the handheld device 10B. Other input structures 22 may provide volume control, or may toggle between vibrate and ring modes. The input structures 22 may also include a microphone may obtain a user's voice for various voice-related features, and a speaker may enable audio playback and/or certain phone capabilities. The input structures 22 may also include a headphone input may provide a connection to external speakers and/or headphones.

FIG. 4 depicts a front view of another handheld device 10C, which represents another embodiment of the electronic device 10. The handheld device 10C may represent, for example, a tablet computer or portable computing device. By way of example, the handheld device 10C may be a tablet-sized embodiment of the electronic device 10, which may be, for example, a model of an iPad® available from Apple Inc. of Cupertino, Calif.

Turning to FIG. 5, a computer 10D may represent another embodiment of the electronic device 10 of FIG. 1. The computer 10D may be any computer, such as a desktop computer, a server, or a notebook computer, but may also be a standalone media player or video gaming machine. By way of example, the computer 10D may be an iMac®, a MacBook®, or other similar device by Apple Inc. It should be noted that the computer 10D may also represent a personal computer (PC) by another manufacturer. A similar enclosure 36 may be provided to protect and enclose internal components of the computer 10D such as the electronic display 18. In certain embodiments, a user of the computer 10D may interact with the computer 10D using various peripheral input devices, such as input structures 22A or 22B (e.g., keyboard and mouse), which may connect to the computer 10D.

Similarly, FIG. 6 depicts a wearable electronic device 10E representing another embodiment of the electronic device 10 of FIG. 1 that may be configured to operate using the techniques described herein. By way of example, the wearable electronic device 10E, which may include a wristband 43, may be an Apple Watch® by Apple, Inc. However, in other embodiments, the wearable electronic device 10E may include any wearable electronic device such as, for example, a wearable exercise monitoring device (e.g., pedometer, accelerometer, heart rate monitor), or other device by another manufacturer. The electronic display 18 of the wearable electronic device 10E may include a touch screen display 18 (e.g., LCD, OLED display, active-matrix organic light emitting diode (AMOLED) display, and so forth), as well as input structures 22, which may allow users to interact with a user interface of the wearable electronic device 10E.

Figure 7:
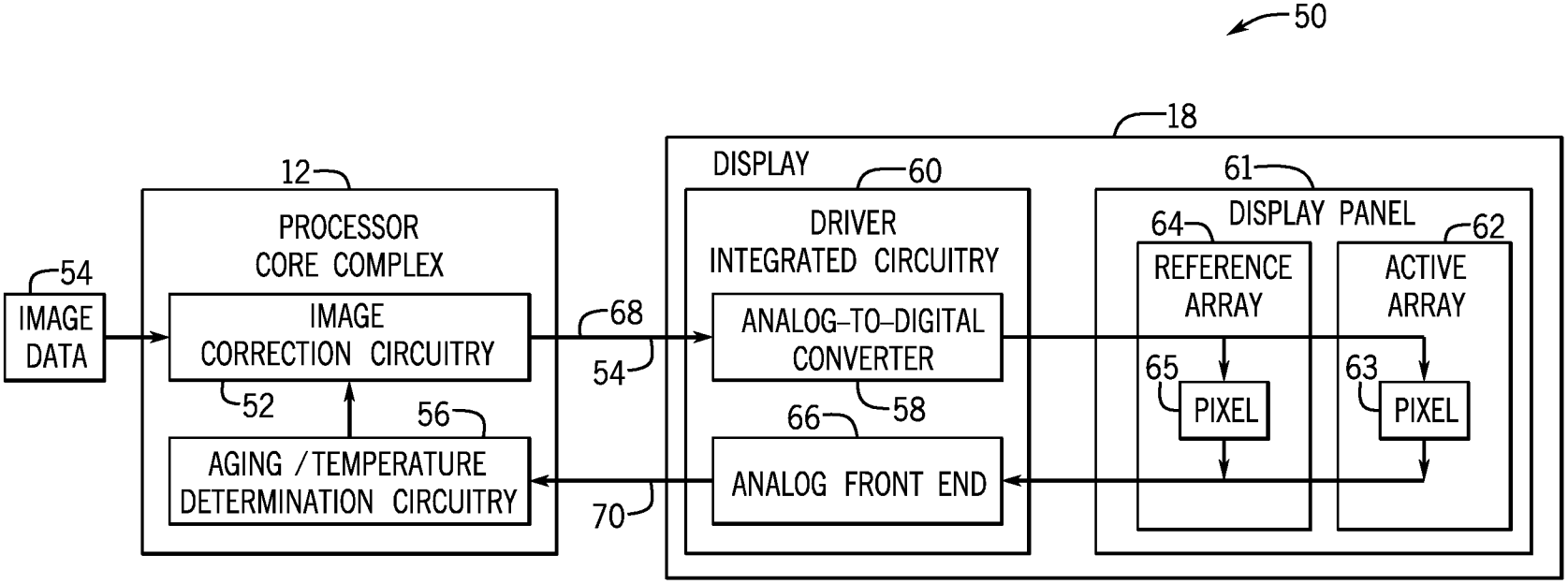
FIG. 7 is a block diagram of a system for display sensing and compensation, according to an embodiment of the present disclosure.

FIG. 7 is a block diagram of a system 50 for display sensing and compensation, according to an embodiment of the present disclosure. The system 50 includes the processor core complex 12, which includes image correction circuitry 52. The image correction circuitry 52 may receive image data 54, and compensate for non-uniformity of the display 18 based at least in part on and induced by process non-uniformity temperature gradients, aging of the display 18, and/or other factors across the display 18 to increase performance of the display 18 (e.g., by reducing visible anomalies). The non-uniformity of pixels in the display 18 may vary between devices of the same type (e.g., two similar phones, tablets, wearable devices, or the like), over time and usage (e.g., due to aging and/or degradation of the pixels or other components of the display 18), and/or with respect to temperatures, as well as in response to additional factors.

As illustrated, the system 50 includes aging/temperature determination circuitry 56 that may determine or facilitate determining the non-uniformity of the pixels in the display 18 due to, for example, aging and/or degradation of the pixels or other components of the display 18. The aging/temperature determination circuitry 56 that may also determine or facilitate determining the non-uniformity of the pixels in the display 18 due to, for example, temperature.

The image correction circuitry 52 may send the image data 54 (for which the non-uniformity of the pixels in the display 18 have or have not been compensated for by the image correction circuitry 52) to analog-to-digital converter 58 of a driver integrated circuit 60 of the display 18. The analog-to-digital conversion converter 58 may digitize the image data 54 when it is in an analog format. The driver integrated circuit 60 may send signals across gate lines of a display panel 61 to cause a row of pixels of an active array 62 of the display panel 61, including a pixel 63, to become activated and programmable, at which point the driver integrated circuit 60 may transmit the image data 54 across data lines to program the pixels, including the pixel 63, to display a particular gray level (e.g., individual pixel brightness). By supplying different pixels of different colors with the image data 54 to display different gray levels, full-color images may be programmed into the pixels of the active array 62 of the display panel 61.

The driver integrated circuit 60 may also send signals across gate lines to cause a row of pixels of a reference array 64 of the display panel 61, including pixel 65, to become activated and programmable. The reference array 64 may not be visible to a user of the electronic device 10. For example, the reference array 64 may be covered by an opaque structure or material (e.g., black material) that blocks sight of the reference array 64 from view. In some embodiments, the reference array 64 may wrap around an edge or back side of the electronic device 10 such that it is hidden from view. The driver integrated circuit 60 may also include a sensing analog front end (AFE) 66 to perform analog sensing of the response of the pixels to data input (e.g., the image data 54). In some embodiments, the AFE 66 may be used for sensing in both the active array 62 and the reference array 64. In alternative or additional embodiments, there may be at least a first AFE used for sensing in the active array 62 and at least a second AFE used for sensing in the reference array 64.

The processor core complex 12 may also send sense control signals 68 to cause the display 18 to perform display panel sensing. In response, the display 18 may send display sense feedback 70 that represents digital information relating to the operational variations of the display 18. The display sense feedback 70 may be input to the aging/temperature determination circuitry 56, and take any suitable form. Output of the aging/temperature determination circuitry 56 may take any suitable form and be converted by the image correction circuitry 52 into a compensation value that, when applied to the image data 54, appropriately compensates for operational changes of the display 18 (e.g., resulting in operational non-uniformity, or global changes to the display 18). This may result in greater fidelity of the image data 54, reducing or eliminating visual artifacts that would otherwise occur due to the operational variations of the display 18. In some embodiments, the processor core complex 12 may be part of the driver integrated circuit 60, and as such, be part of the display 18.

Figure 8:
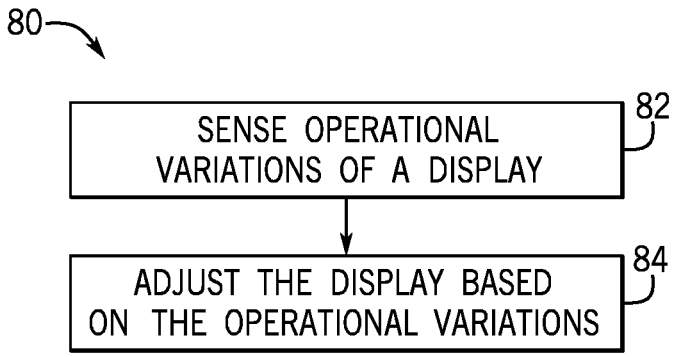
FIG. 8 is a flowchart illustrating a method for display sensing and compensation using the system of FIG. 7, according to an embodiment of the present disclosure.

FIG. 8 is a flowchart illustrating a method 80 for display sensing and compensation using the system 50 of FIG. 7, according to an embodiment of the present disclosure. The method 80 may be performed by any suitable device that may sense operational variations of the display 18 and compensate for the operational variations, such as the display 18 and/or the processor core complex 12.

The display 18 senses (process block 82) operational variations of the display 18 itself. In particular, the processor core complex 12 may send one or more instructions (e.g., sense control signals 68) to the display 18. The instructions may cause the display 18 to perform display panel sensing. The operational variations may include any suitable variations that induce non-uniformity in the display 18, such as process non-uniformity temperature gradients, aging of the display 18, and the like.

The processor core complex 12 then adjusts (process block 84) the display 18 based at least in part on the operational variations. For example, the processor core complex 12 may receive display sense feedback 70 that represents digital information relating to the operational variations from the display 18 in response to receiving the sense control signals 68. The display sense feedback 70 may be input to the aging/temperature determination circuitry 56, and take any suitable form. Output of the aging/temperature determination circuitry 56 may take any suitable form and be converted by the image correction circuitry 52 into a compensation value. For example, processor core complex 12 may apply the compensation value to the image data 54, which may then be sent to the display 18. In this manner, the processor core complex 12 may at least partially perform the method 80 to increase performance of the display 18 (e.g., by reducing visible anomalies).

Reference Array

The pixels 65 (and 63) described above may be voltage-driven pixels, such that the pixels are controlled by adjusting voltage inputs that are converted in the pixels 63 and 65 into currents, and/or current-driven pixels. That is, the pixels 63 and 65 may not be controlled by directly adjusting a current input. Instead, the pixels 63 and 65 may be controlled by indirectly adjusting the current input by providing some particular voltage values to the pixels 63 and 65 and allowing the current to be generated in the pixels 63 and 65 from the input voltage. Indeed, the luminance of each pixel 65 is directly related to the current provided to the pixel 65. The current provided to each pixel 65 is dependent on the voltage inputs to the pixel 65, and operational variations, such as temperature, may vary the current provided to the pixel 65 for a set of voltage inputs. As such, more accurately capturing or sensing a current-voltage relationship (expressed as a curve) for each pixel 65 enables the pixels 63, 65 to more accurately display the image data 54. In additional or alternative embodiments, the pixels 63 and 65 may be controlled by directly adjusting the current input Thus, the reference array 64 may be used to more accurately sense the current-voltage relationship for each pixel 65. In some embodiments, control circuitry of the reference array 64 may control a power supply (e.g., an ELVSS power supply coupled to a source of a thin film transistor (TFT) of the pixel 65) voltage level or current level to maintain a particular luminance setting. The reference array control circuitry may generate a current-voltage curve based at least in part on the power supply voltage level and capture gamma tap points based at least in part on the current-voltage curve. The reference array control circuitry may perform gray tracking or gamma correction on the gamma tap points and program the gamma tap points into a gamma digital-to-analog converter (DAC).

The reference array control circuitry may more accurately sense the current-voltage relationship for each pixel 65 by having an ELVSS power supply separate from an ELVSS power supply for the active array 62. Additionally, in some but not necessarily all embodiments, the reference array control circuitry may use a fixed ELVSS voltage level or current level (which may be set at a certain temperature) over the entire range of brightness settings, instead of sensing, generating, and using an ELVSS voltage level or current level for each brightness setting. A sensing circuit of the reference array 64 may apply a voltage to sense a current across a diode of the pixel 65 (e.g., force voltage sense current) to determine a set of current and voltage values, which may be used to determine a current-voltage relationship or curve associated with the ELVSS voltage level. In this manner, the reference array control circuitry may enable adjusting its ELVSS power supply 86 without affecting emission of the active array. Additionally, the reference array 64 may enable quicker, almost instantaneous brightness adjustment (instead of having to performing a sensing operation prior to each brightness adjustment).

Figure 9:
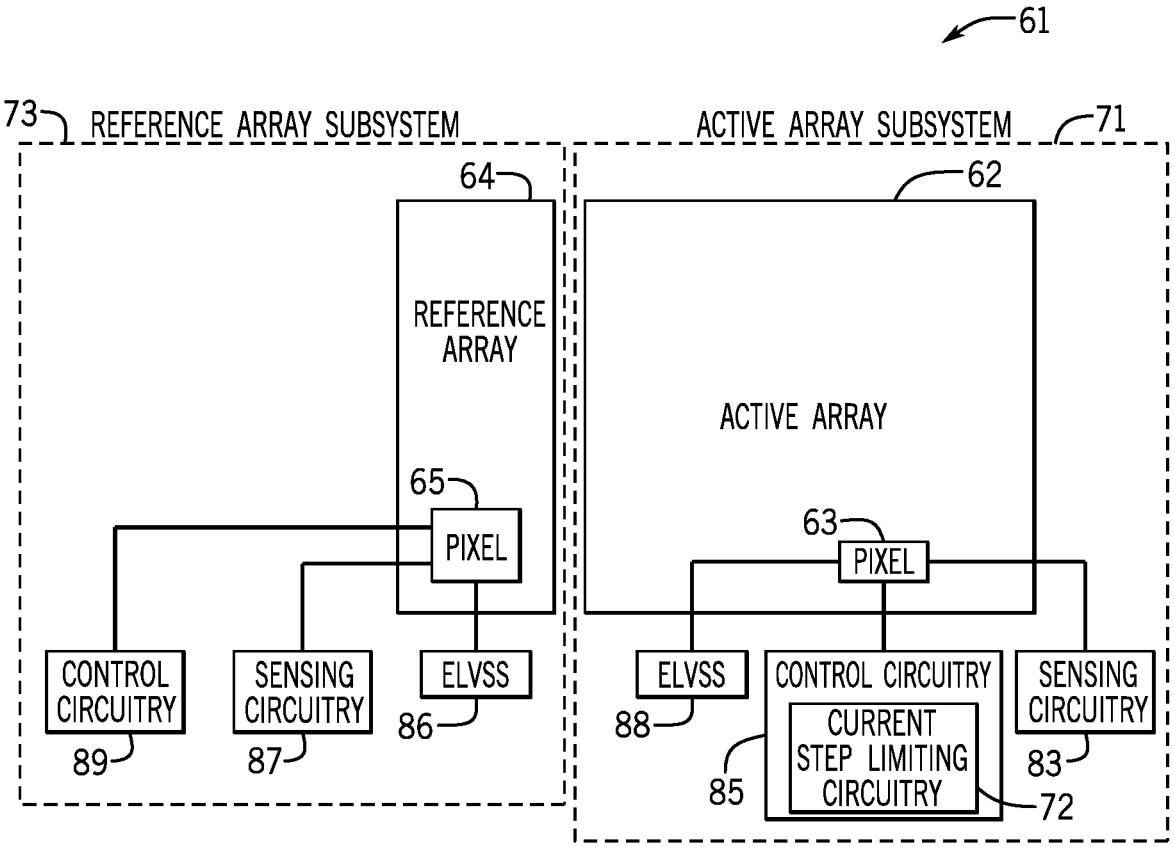
FIG. 9 is a diagram showing a power supply for a reference array separate from a power supply for an active array of an electronic display of FIG. 7, according to an embodiment of the present disclosure.

FIG. 9 is a diagram illustrating an active array subsystem 71 and a reference array subsystem 73 of the display panel 61 of FIG. 7, according to an embodiment of the present disclosure. The reference array subsystem 73 may include the ELVSS power supply 86 (e.g., a cathode) separate from the ELVSS power supply 88 (e.g., another, different, cathode) of the active array subsystem 71. The reference array 64 may include any suitable number (e.g., 1-1000) of columns of pixels 65. The ELVSS power supply 86 of the reference array subsystem 73 may thus be adjusted without affecting emission of the active array 62. As such, the separated ELVSS power supplies 86, 88 may enable low noise sensing schemes.

The reference array subsystem 73 may also include the reference array control circuitry 89 coupled to the pixel 65. The reference array control circuitry 89 may include any suitable circuitry used to control the reference array 64, such as processing circuitry, sensing circuitry 87, and the like. In some embodiments, the reference array control circuitry 89 may include control circuitry external to the reference array 64, such as control circuitry of the active array 62, the processor core complex 12, and the like. The reference array sensing circuitry 87 may enable sensing of operational parameters of the reference array 64, such as voltage measurements, current measurements, and the like. The reference array sensing circuitry 87 may include any suitable circuitry used to sense operational parameters of the reference array 64, such as voltage sensors, current sensors, and the like. In some embodiments, the reference array sensing circuitry 87 may be external to the reference array control circuitry 89. In some cases, the reference array control circuitry 89 may be part of the driver integrated circuitry 60 shown in FIG. 7.

Similarly, the active array subsystem 71 may also include control circuitry 85 coupled to the pixel 63 used to control the active array 62. The active array control circuitry 85 may include any suitable circuitry used to control the active array 62, such as processing circuitry, sensing circuitry 83, and the like. For example, as illustrated, the active array control circuitry 85 may include current step limiter circuitry 72 that may limit current compensation values used to compensate for voltage degradation in the electronic display 18. In particular, the current step limiter circuitry 72 may be used to limit the current compensation values below a visibility threshold (e.g., such that a viewer of the display 18 may not perceive the change in current values due to compensating for the voltage degradation). In alternative or additional embodiments, the reference array control circuitry 89 may include the current step limiter circuitry 72. In some embodiments, the active array control circuitry 85 may include control circuitry external to the active array 62, such as the reference array control circuitry 89, the processor core complex 12, and the like. The active array sensing circuitry 83 may enable sensing of operational parameters of the active array 62, such as voltage measurements, current measurements, and the like. The active array sensing circuitry 83 may include any suitable circuitry used to sense operational parameters of the active array 62, such as voltage sensors, current sensors, and the like. In some embodiments, the active array sensing circuitry 83 may be external to the active array control circuitry 85. In some cases, the active array control circuitry 85 may be part of the driver integrated circuitry 60 shown in FIG. 7.

Figure 10:
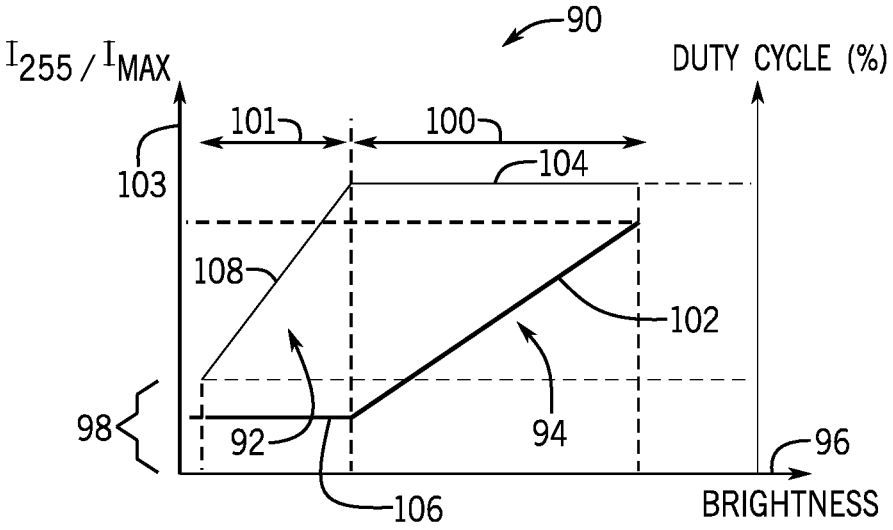
FIG. 10 is a graph illustrating a brightness control scheme for the electronic display of FIG. 7, according to an embodiment, of the present disclosure.

FIG. 10 is a graph illustrating a brightness control scheme 90 for the electronic display 18 of FIG. 7, according to an embodiment, of the present disclosure. The brightness control scheme 90 may use both a digital brightness control scheme 92 and an analog brightness control scheme 94. In particular, the brightness control scheme 90 may avoid using only the analog brightness control scheme 94 (over the entire brightness range 96), as that may cause low grade current levels (e.g., 98) to approach almost unmeasurable current levels.

For a certain brightness range 100, the brightness control scheme 90 may use the analog brightness control scheme 94 to control the brightness of a pixel 65 by adjusting current 102 to the pixel 65, while maintaining a constant duty cycle or pulse width 104 of a corresponding voltage (e.g., of a data signal that results in the current 102) input to the pixel 65. The certain brightness range 100 may be within a data voltage domain. Advantageously, using the analog brightness control scheme 94 may result in slower aging of the pixel 65. For a lower brightness range 101 (when compared to the certain brightness range 100), the brightness control scheme 90 may use the digital brightness control scheme 92 to maintain a constant current 106 while adjusting the duty cycle or pulse width 108 of the corresponding voltage input to the pixel 65 to control the brightness of the pixel 65. Advantageously, the digital brightness control scheme 92 may use a smaller current range (when compared to the analog brightness control scheme 94) and results in lower bias power usage. In this manner, the range of the operation current 103 may be relaxed so that the current 103 may be controlled for low grade current levels.

Certain electronic displays may adjust an ELVSS voltage level to control the brightness setting. However, when the ELVSS voltage level is adjusted, the current-voltage relationship for each pixel 65 may change. As such, each time the brightness setting changes (as a result of adjusting the ELVSS voltage level), certain electronic displays may sense or rescan the current-voltage relationship (which may be expressed and stored as a curve) for each pixel 65 (both at the new brightness settings and at one or more intermediate brightness settings to prevent changes visible to the eye). As a result, changing the brightness setting for these electronic displays may be inefficient and slow (e.g., on the scale of tens of seconds).

To avoid this time-consuming process, the reference array 64 of FIG. 7 may use a fixed ELVSS voltage level (which may be set at a certain temperature) over the entire range of brightness settings. As a result, the current-voltage relationship or curve for each pixel 65 may remain constant (and rescanning a separate current-voltage relationship or curve for each brightness setting and intermediate brightness settings may be avoided). In some embodiments, the reference array control circuitry 89 may adjust the ELVSS voltage level for different temperatures.

Figure 11:
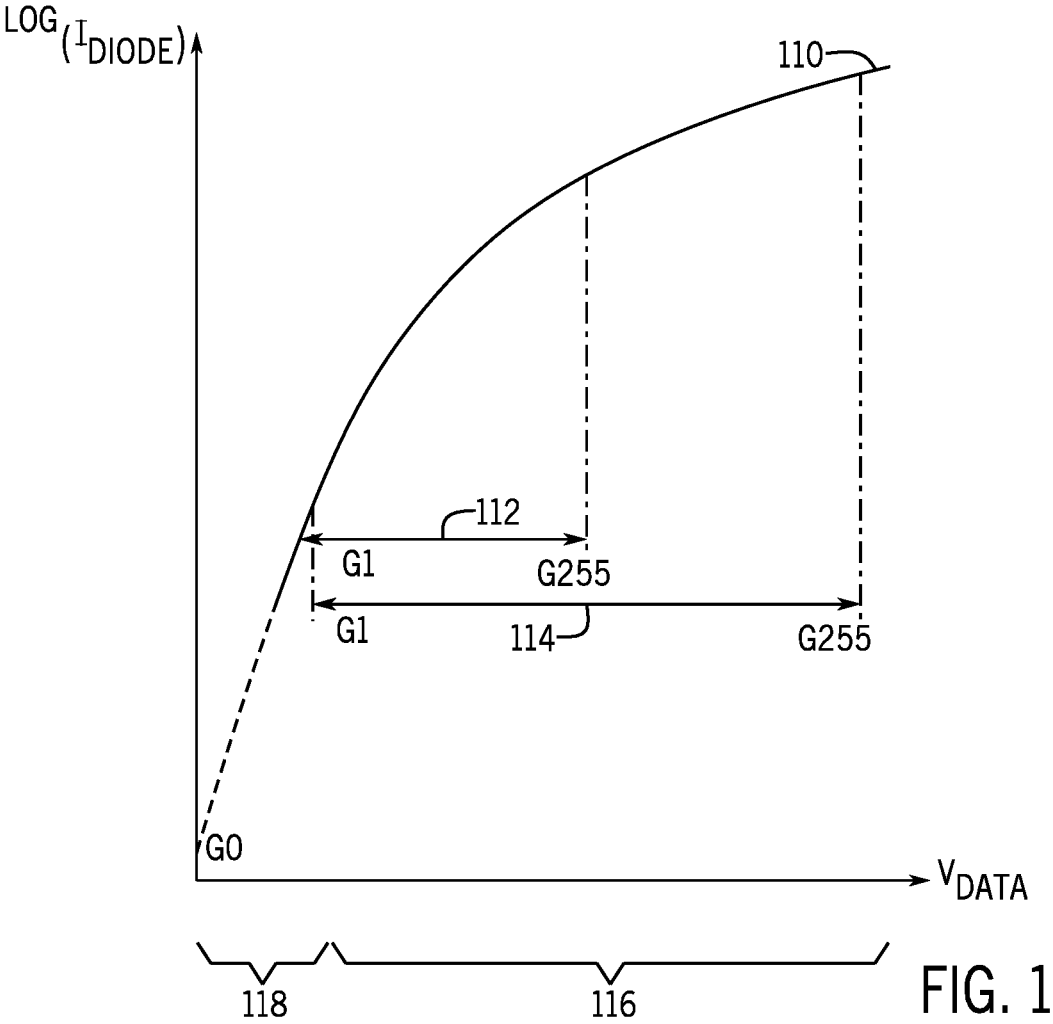
FIG. 11 is a graph of a current-voltage curve using a fixed power supply voltage level for the electronic display 18 of FIG. 7, according to an embodiment of the present disclosure.

FIG. 11 is a graph of a current-voltage curve 110 using a fixed ELVSS voltage level for the electronic display 18 of FIG. 7, according to an embodiment of the present disclosure. The current (e.g., $I_{Diode}$) may be provided to a diode (e.g., an LED) of a pixel 65, and the voltage ($V_{Data}$) may be provided to a gate of a TFT of the pixel 65. The current-voltage curve 110 may be based at least in part on a set of current and voltage values provided via the reference array 64. Additionally, the current-voltage curve 110 may also include interpolation and/or extrapolation of the set of current and voltage values provided via the reference array 64. The current-voltage curve 110 may be associated with gray levels (G0-G255) of each brightness setting. For example, a first portion 112 of the current-voltage curve 110 may correspond to a range of gray levels (e.g., from a minimum gray level 1 (G1)) to a maximum gray level 255 (G255)) for a first brightness setting (e.g., 50 nits) of the pixel 65. A second portion 114 of the current-voltage curve 110 may correspond to the range of gray levels for a second brightness setting (e.g., 150 nits) of the pixel 65.

Once the current-voltage curve 110 has been captured or realized, for any brightness setting, data may be generated from the current-voltage curve 110 to update the associated gamma value instantaneously. As such, the electronic display's response to a change in brightness setting may be substantially improved by avoiding rescanning a new current-voltage relationship or curve.

The interpolation technique used may be any suitable technique that expresses the set of current and voltage values as a curve, such as log space spline, linear spline, exponential, and the like. The pixel current may include a range of many (e.g., 6-8) orders of magnitude, and the set of current and voltage values may include a limited number (e.g., 5-14) of current and voltage value pairs. Log space spline interpolation is an example of a suitably effective interpolation technique for gamma generation from a few value pairs. In particular, using log space spline interpolation results in reasonably small error (e.g., 0-12%, 8-10%, and the like) over various temperatures. For example, the interpolation may be expressed as:

$$\log(I) = \sum_{i=0}^{3} a_i V_G^i \tag{1}$$

Equation 1 may enable interpolating 8 to 10 set of current and voltage value pairs to provide each gray voltage (G1-G255) across the brightness settings of a pixel 65.

In some embodiments, a second power supply (e.g., an ELVDD power supply coupled to a drain of the TFT of the pixel 65) may be adjusted to increase power savings. The ELVSS power supply may supply diode current (to the LED) of the pixel 65, but not bias current to the pixel 65. However, the ELVDD power supply may supply both diode current and bias current to the pixel 65. As such, maintaining a constant ELVSS voltage level with supplying a variable ELVDD voltage level to the pixel 65 (such that the current to the pixel 65 provided by the ELVDD power supply may be decreased) may enable power savings when operating the pixel 65.

Figure 12:
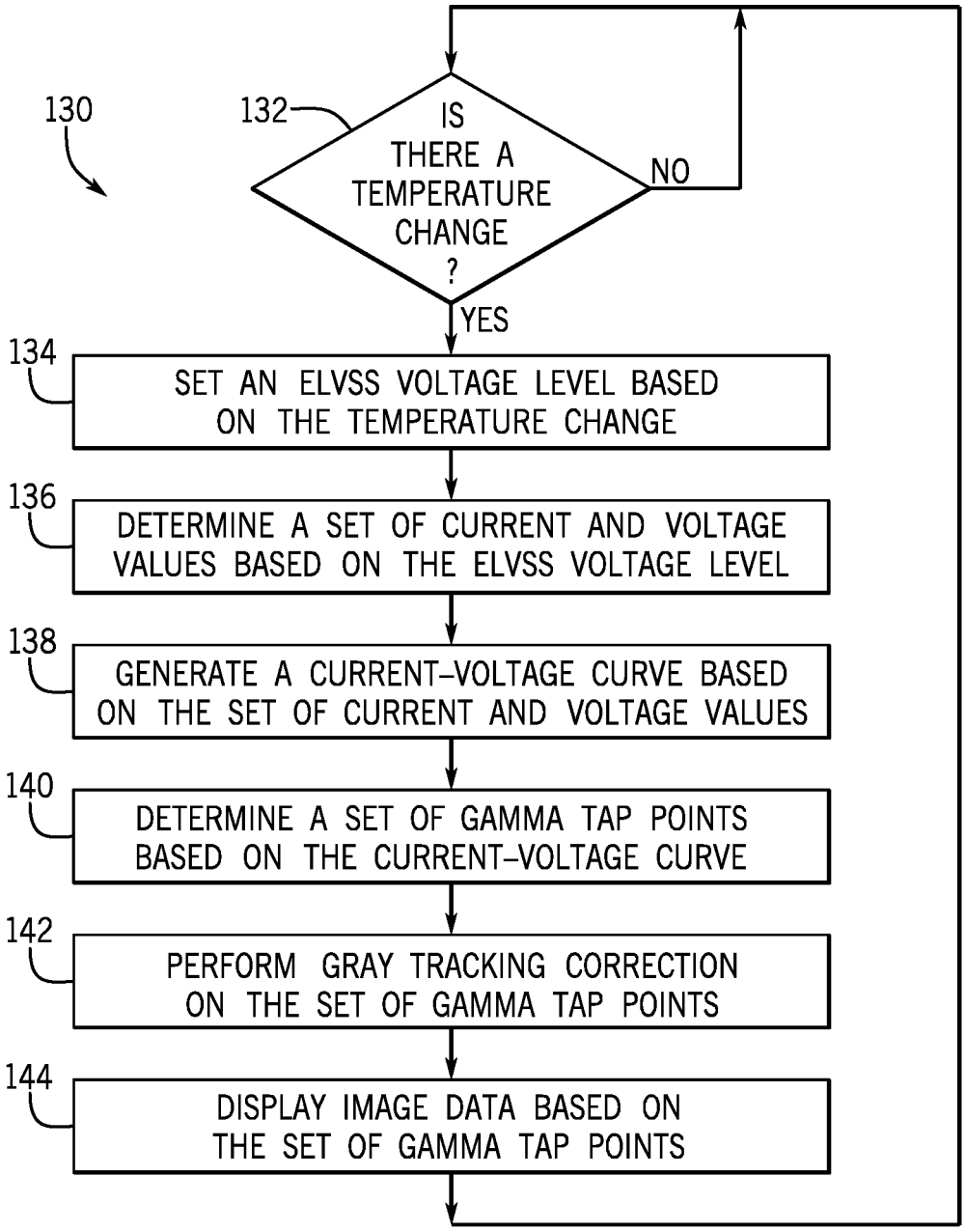
FIG. 12 is a flow diagram of a method for compensating for voltage degradation using the reference array of FIG. 7, according to an embodiment of the present disclosure.

FIG. 12 is a flow diagram of a method 130 for compensating for voltage degradation using the reference array 64 of FIG. 7, according to an embodiment of the present disclosure. The method 130 may be performed by any suitable device or combination of devices that may determine a temperature change, set an ELVSS voltage level, determine current and voltage values, generate a current-voltage curve, determine a set of gamma tap points, and perform gray tracking correction. While the method 130 is described using steps in a specific sequence, it should be understood that the present disclosure contemplates that the described steps may be performed in different sequences than the sequence illustrated, and certain described steps may be skipped or not performed altogether. In some embodiments, at least some of the steps of the method 130 may be performed by the reference array control circuitry 89, as described below. However, it should be understood that any suitable device or combination of devices is contemplated to perform the method 130, such as control circuitry of the active array 62, the processor core complex 12, and the like.

The reference array control circuitry 89 may determine (decision block 132) whether there is a temperature change. The temperature change may be a result of changes in ambient temperature, operating the electronic device 10, and the like. In some embodiments, the reference array control circuitry 89 may determine that there is a temperature change by comparing the temperature change to a threshold temperature change.

If there is not a temperature change, the reference array control circuitry 89 may return to decision block 132. If there is a temperature change, the reference array control circuitry 89 may set or determine (process block 134) the ELVSS voltage level. In particular, the reference array control circuitry 89 may iterate through a series of different ELVSS voltage levels until a target current is provided to the pixel 65 via a target voltage. For example, the ELVSS voltage level may be set such that a peak current (e.g., $I_{255}$, corresponding to a peak gray level of G255) for a target brightness setting (e.g., a peak brightness setting, 150 nits, or the like) is provided using a target voltage (e.g., $V_{255}$).

The reference array control circuitry 89 may determine (process block 136) a set of current and voltage values associated with the ELVSS voltage level. Specifically, the reference array control circuitry 89 may measure a number (e.g., 6-14) of current values provided to the LED of the pixel 65 based at least in part on the voltages (e.g., $V_{Data}$) provided to the pixel 65.

The reference array control circuitry 89 may then generate (process block 138) a current-voltage relationship or curve 110 based at least in part on the set of current and voltage values. That is, the reference array control circuitry 89 may interpolate and/or extrapolate the current-voltage relationship or curve 110 using the set of current and voltage values. In some embodiments, the log space spline interpolation technique may be used.

The reference array control circuitry 89 may determine a portion of the current-voltage relationship or curve 110 for one or more brightness settings of the pixel 65. Based at least in part on the portion of the current-voltage curve 110, the reference array control circuitry 89 may determine (process block 140) a set of gamma tap points. In some embodiments, the set of gamma tap points may be mapped to and used to generate respective gray levels.

The reference array control circuitry 89 may then perform (process block 142) gray tracking or gamma correction on the gamma tap points using an integrated circuit, such as a system on a chip (SoC) and/or the processor core complex 12. For example, the image correction circuitry 52 of the processor core complex 12 may perform the gray tracking or gamma correction on the gamma tap points.

The active array 64 may (process block 144) display image data based at least in part on the gamma tap points. In particular, the active array 64 may display gray levels of the image data using data voltages corresponding to the gray levels as provided or defined by the gamma tap points. In some embodiments, the current step limiter circuitry 72 of the active array control circuitry 85 may limit current compensation values used to provide the data voltages. In particular, the current step limiter circuitry 72 may be used to limit the current compensation values that provide the data voltages below a visibility threshold. The visibility threshold may correspond to a current value change that a viewer of the display 18 may not perceive when applied to the data voltages (as compared to displaying the gray levels of the image data using the data voltages prior to applying the current compensation values). In this manner, the viewer may not notice the applied compensation, improving the overall viewing experience of the display 18.

The method 130 may then be repeated if there is another temperature change. In this manner, the reference array control circuitry 89 may compensate for voltage degradation in the electronic display 18.

Figure 13:
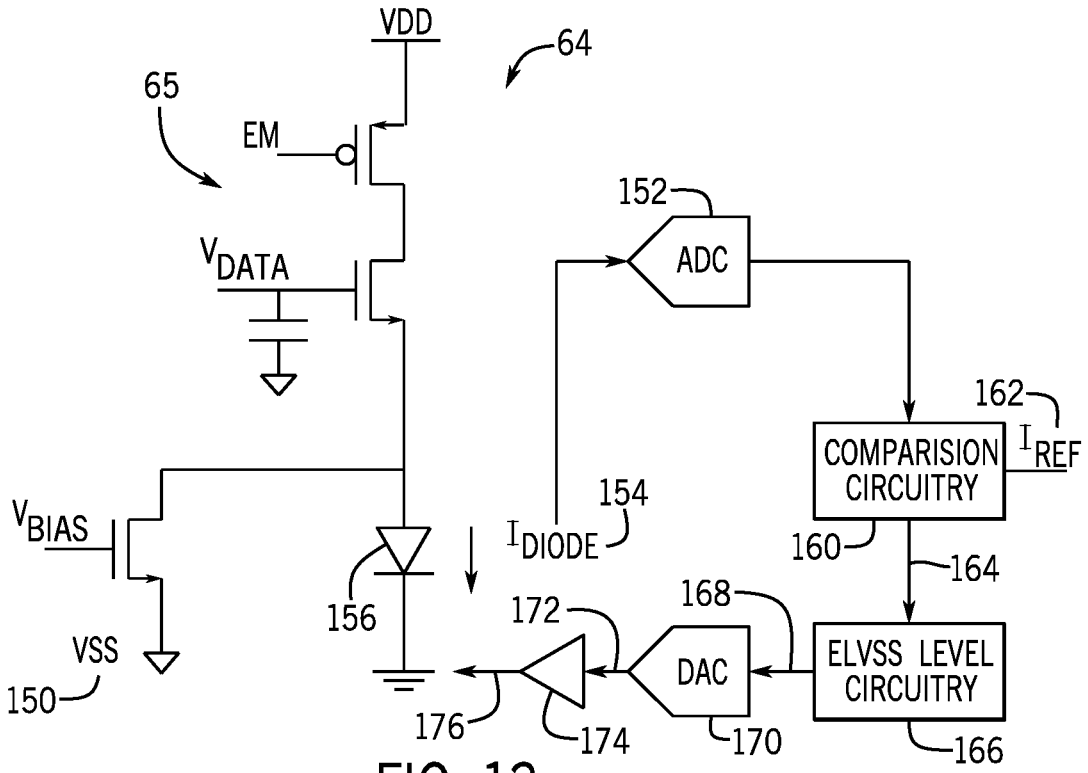
FIG. 13 illustrates a block diagram of components of the reference array of FIG. 7 used to set the power supply voltage level in response to a temperature change, according to an embodiment of the present disclosure.

FIG. 13 illustrates a block diagram of components of the reference array 64 of FIG. 7 used to set the ELVSS voltage level (e.g., VSS 150) in response to a temperature change, according to an embodiment of the present disclosure. An analog-to-digital converter (ADC) 152 may sense or receive, an analog current ($I_{Diode}$) 154 provided to a diode 156 (e.g., an LED or OLED) of the pixel 65, and convert the analog current ($I_{Diode}$) 154 to a digital signal 158.

Comparison circuitry 160 then compares the digital current signal 158 to a reference current ($I_{Ref}$) 162 to generate a difference signal 164 associated with a difference between the digital current signal 158 to the reference current ($I_{Ref}$) 162. The reference current ($I_{Ref}$) 162 may be the current (e.g., $I_{255}$) associated with a target data voltage used to generate a target gray level (e.g., a peak gray level of G255) at a target brightness setting (e.g., 150 nits) at, for example, a previous temperature at which the ELVSS voltage level was previously set (prior to the temperature change).

ELVSS voltage level search circuitry 166 may receive the difference signal 164 and determine an ELVSS voltage level that generates the reference current 162 (and thus the target gray level) at the target brightness setting when the target data voltage is applied. Any suitable search method may be used to determine the ELVSS voltage level, such as a binary search method, a step search method, and the like.

The ELVSS voltage level search circuitry 166 may generate a digital ELVSS voltage level signal 168, which may be received by a digital-to-analog converter (DAC) 170. The DAC 170 may convert the digital ELVSS voltage level signal 168 to an analog format, and send the result 172 to a buffer 174 to produce a buffered analog ELVSS voltage level signal 176. The buffered analog ELVSS voltage level signal 176 may be sent to the pixel 65 of the reference array 64 and/or the pixel 63 of the active array 62 to provide a new source voltage.

Figure 14:
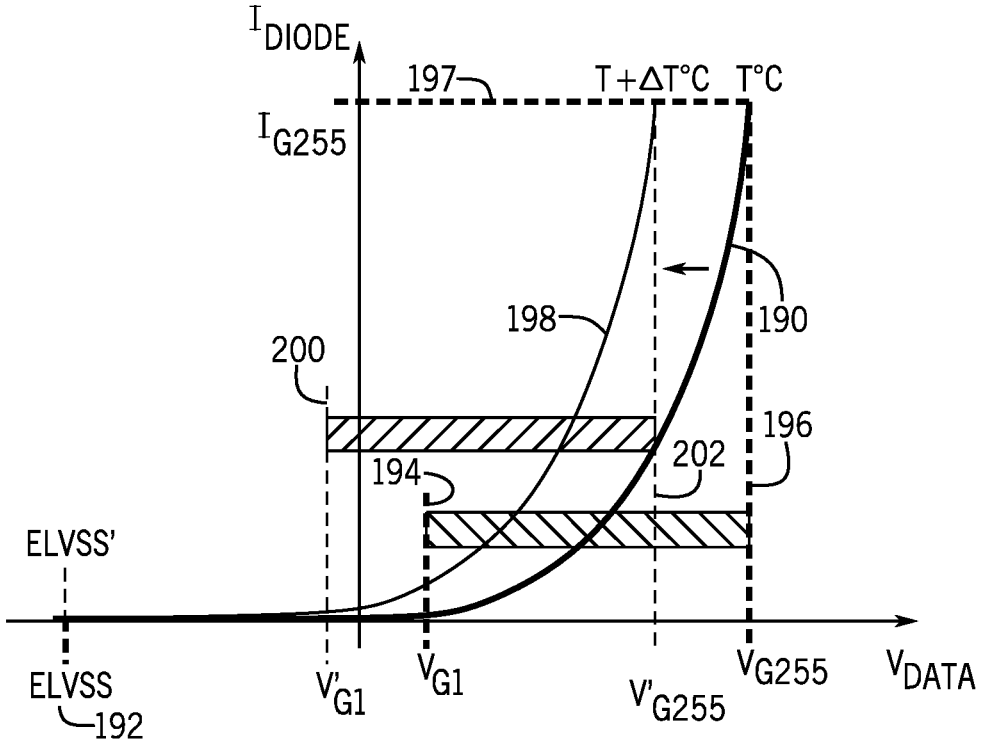
FIG. 14 is a graph illustrating current-voltage curves resulting from a temperature change, according to an embodiment of the present disclosure.

FIG. 14 is a graph illustrating current-voltage curves resulting from a temperature change, according to an embodiment of the present disclosure. A first current-voltage curve 190 is associated with a first ELVSS voltage level 192 set at a previous temperature. The first current-voltage curve 190 may be used to generate first data voltage levels from first $V_{G1}$ 194 to first $V_{G255}$ 196 that correspond to producing gray levels from G1 to G255 (at a target brightness setting). To produce the gray level G255, supplying the first data voltage level $V_{G255}$ 196 results in providing current level $I_{G255}$ 197 to the diode 156.

After the temperature change, the first current-voltage curve 190 moves to a second current-voltage curve 198, while the ELVSS voltage level remains at the first ELVSS voltage level 192. Because the first current-voltage curve 190 moves due to the temperature change, the data voltage levels change accordingly. In particular, the first $V_{G1}$ 194 moves to a second $V_{G1'}$ 200, and the first $V_{G255}$ 196 moves to a second $V_{G255'}$ 202.

Figure 15:
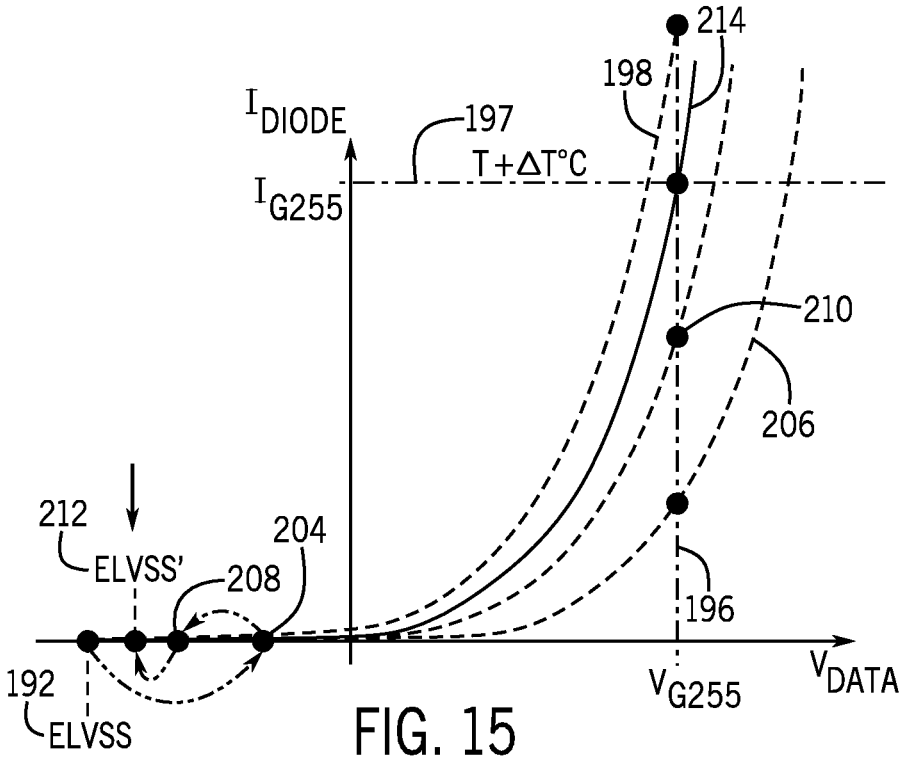
FIG. 15 is a graph illustrating power supply level search circuitry of the reference array of FIG. 7 determining a power supply voltage level that generates a target current, according to an embodiment of the present disclosure.

FIG. 15 is a graph illustrating ELVSS voltage level search circuitry 166 of the reference array 64 of FIG. 7 determining an ELVSS voltage level that generates a target current (e.g., the reference current 162) associated with a target gray level at a target brightness setting when a target data voltage is applied, according to an embodiment of the present disclosure. The first ELVSS voltage level 192 was set at a previous temperature and used to generate the current-voltage curve 198, which no longer generates a target current (e.g., $I_{G255}$ 198 associated with producing the gray level G255) when supplied a target voltage (e.g., $V_{G255}$ 196) due to the change in temperature.

A searching method may determine a second ELVSS voltage level 204 that may be used to generate a second current-voltage curve 206. However, as illustrated, when the target voltage of $V_{255}$ 196 is supplied, the resulting current is not the target current $I_{G255}$ 198 associated with producing the gray level G255. The searching method may determine a third ELVSS voltage level 208 that may be used to generate a third current-voltage curve 210. As with the second ELVSS voltage level 204, when the target voltage of $V_{255}$ 196 is supplied, the resulting current associated with the third ELVSS voltage level 208 is not the target current $I_{G255}$ 198. The searching method may also determine a fourth ELVSS voltage level (ELVSS') 212 that may be used to generate a fourth current-voltage curve 214. As illustrated, when the target voltage of $V_{255}$ 196 is supplied, the resulting current associated with the fourth ELVSS voltage level 212 is the target current $I_{G255}$ 198. The search method may be any suitable search method, such as a binary search method, a step search method, and the like.

Figure 16:
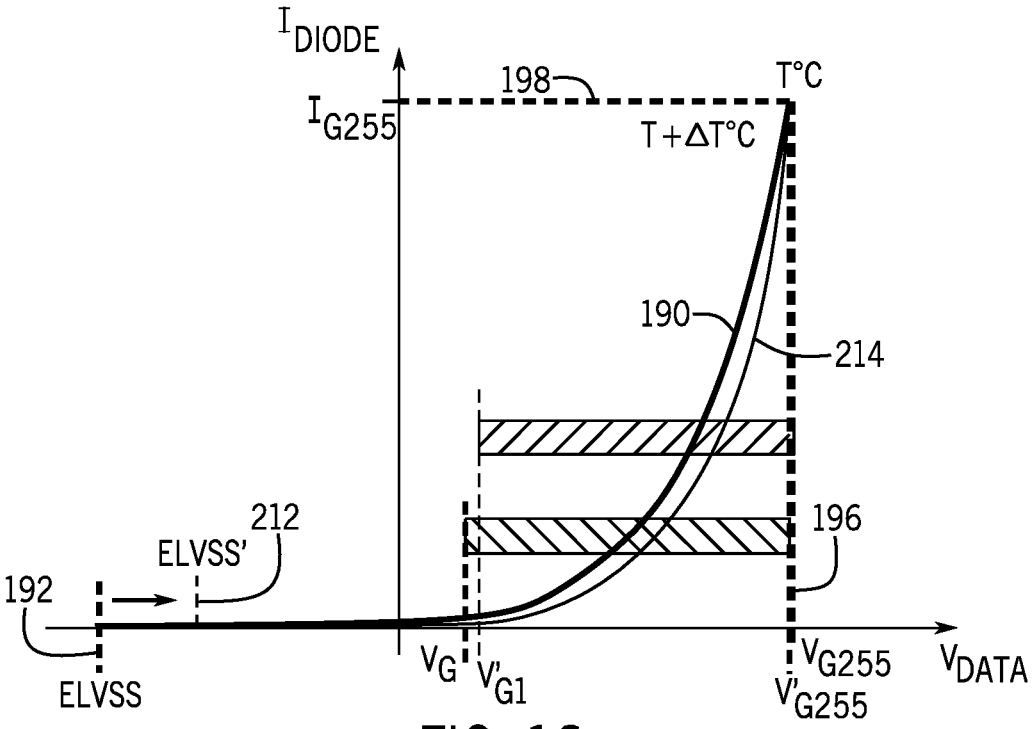
FIG. 16 is a graph comparing a previous current-voltage curve generated from a previous power supply voltage level prior to a temperature change with a current-voltage curve generated from setting the power supply voltage level after the temperature change, according to an embodiment of the present disclosure.

FIG. 16 is a graph comparing the previous current-voltage curve 190 generated from the previous ELVSS voltage level 192 prior to the temperature change with the current-voltage curve 214 generated from setting the ELVSS voltage level (ELVSS') 212 after the temperature change, according to an embodiment of the present disclosure. As illustrated, when the target voltage of $V_{255}$ 196 is supplied, the resulting current associated with the previous current-voltage curve 190 prior to the temperature change and the resulting current associated with the current-voltage curve 214 after the temperature change is both the target current $I_{G255}$ 198.

Figure 17:
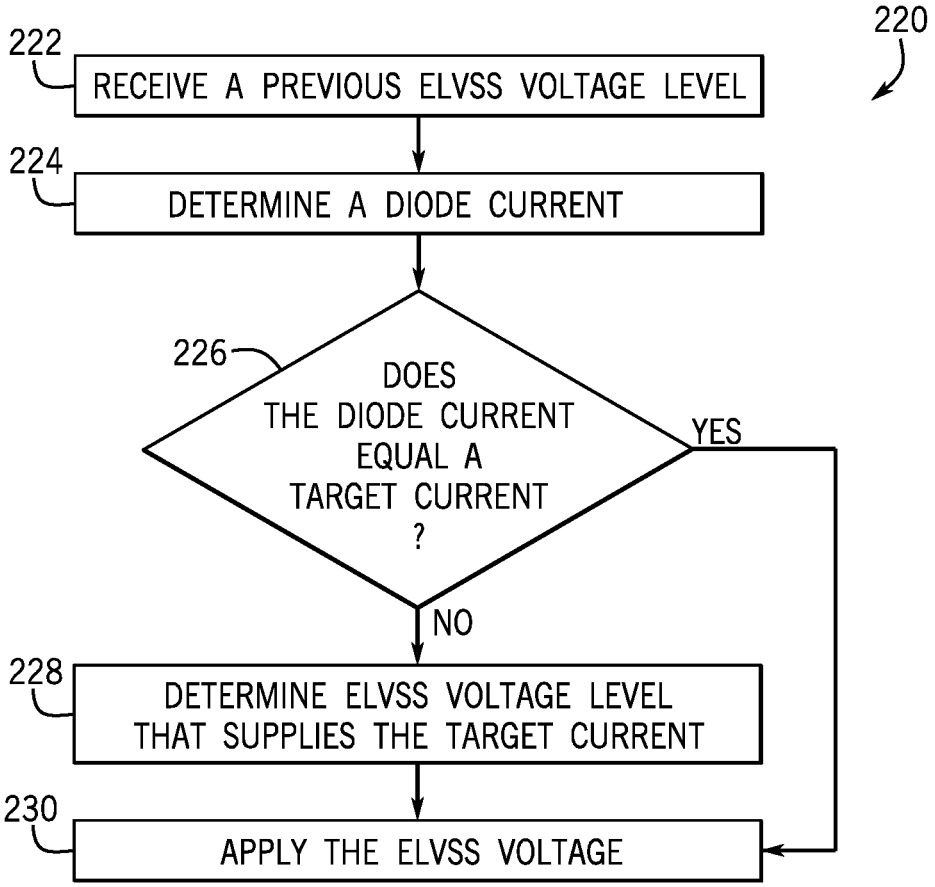
FIG. 17 is a flow diagram of a method for determining a power supply voltage level that provides a target current to a pixel of the electronic display of FIG. 7 after a temperature change, according to an embodiment of the present disclosure.

FIG. 17 is a flow diagram of a method 220 for determining an ELVSS voltage level that provides a target current (e.g., $I_{G255}$ 198) to a pixel 65 of the electronic display 18 of FIG.

7 after a temperature change when a target voltage (e.g., $V_{255}$ 196) is supplied, according to an embodiment of the present disclosure. The method 220 may be performed by any suitable device or combination of devices that may determine a diode current and an ELVSS voltage level that supplies a target diode current, and apply the ELVSS voltage level. While the method 220 is described using steps in a specific sequence, it should be understood that the present disclosure contemplates that the described steps may be performed in different sequences than the sequence illustrated, and certain described steps may be skipped or not performed altogether. In some embodiments, at least some of the steps of the method 220 may be performed by the reference array control circuitry 89, as described below. However, it should be understood that any suitable device or combination of devices is contemplated to perform the method 220, such as control circuitry of the active array 62, the processor core complex 12, and the like.

The reference array control circuitry 89 may receive (process block 222) a previous ELVSS voltage level. The previous ELVSS voltage level may have been set by the reference array control circuitry 89 for a previous temperature.

In some embodiments, the reference array control circuitry 89 may estimate a searching range based at least in part on a pixel's temperature characteristics. That is, the reference array control circuitry 89 may receive a temperature associated with the pixel 65, and estimate a voltage range that the ELVSS voltage level may be set to based at least in part on the temperature.

The reference array control circuitry 89 may then determine or sense (process block 224) a first diode current (e.g., current provided to the pixel 65). In particular, the first diode current may be a result of providing a target voltage level to the diode 156. The target voltage level may be a voltage that was supplied to the diode 156 that resulted in providing a target current level to the diode 156 at the previous temperature. In some embodiments, the target voltage level (e.g., $V_{255}$) may result in providing a peak current level (e.g., $I_{255}$) such that the diode 156 emits a peak gray level (e.g., G255).

The reference array control circuitry 89 may determine (decision block 226) whether the first diode current equals a target diode current (e.g., $I_{ref}$ 162). The comparison circuitry 160 may perform the determination. In some embodiments, the target diode current may be a peak current level (e.g., $I_{G255}$) such that the diode 156 emits a peak gray level (e.g., G255).

If not, the reference array control circuitry 89 determines (process block 228) an ELVSS voltage level (e.g., ELVSS' 212 as shown in FIG. 16) that supplies the target diode current (e.g., $I_{ref}$ 162) to the diode 156. For example, the ELVSS voltage level may supply the target diode current equal to a peak current level (e.g., $I_{255}$) when the target voltage level (e.g., $V_{255}$) associated with the diode 156 emitting a peak gray level (e.g., G255) is applied. The searching may be performed by the ELVSS voltage level search circuitry 166 using a binary search method, a step search method, and the like.

After the reference array control circuitry 89 determines the ELVSS voltage level in process block 228, or if the first diode current equals the target diode current in decision block 226, the reference array control circuitry 89 applies (process block 230) the ELVSS voltage level to the pixel 65. As such, the target diode current (e.g., a peak current level, $I_{255}$) may be applied to the diode 156 (e.g., using the target voltage level (e.g., $V_{255}$)), resulting in the diode 156 emitting a peak gray level (e.g., G255). In this manner, an ELVSS voltage level may be determined that provides a target current to a pixel 65 of the electronic display 18 after a temperature change (e.g., when a target voltage is supplied).

Figure 18:
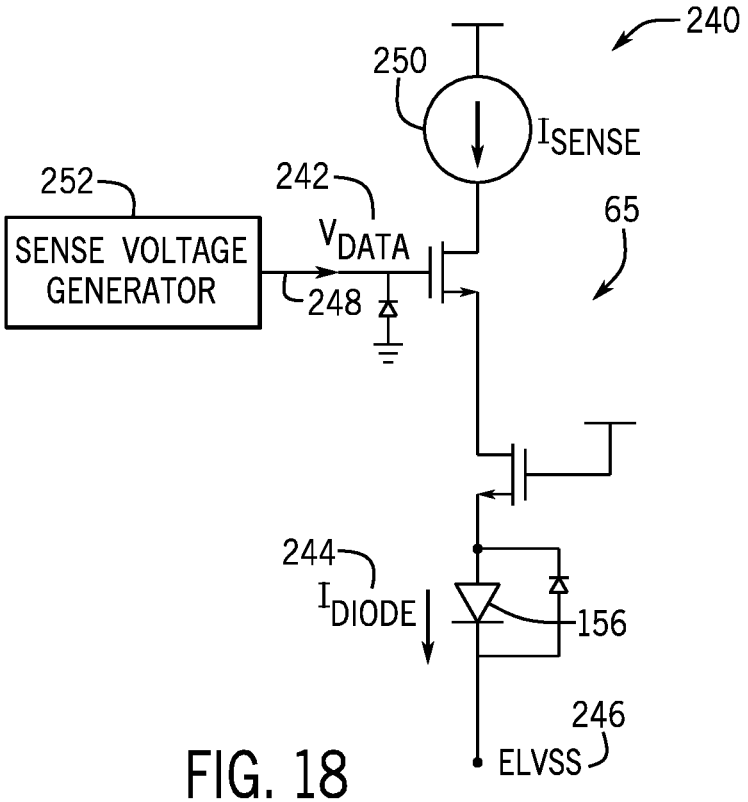
FIG. 18 is a schematic diagram of a sensing circuit of the reference array of FIG. 7 used to determine the set of current and voltage values, according to an embodiment of the present disclosure.

Once the ELVSS voltage level (e.g., ELVSS' 212 as shown in FIG. 16) is determined, the reference array control circuitry 89 may determine a set of current and voltage values. FIG. 18 is a schematic diagram of a sensing circuit 240 of the reference array control circuitry 89 of FIG. 7 used to determine the set of current and voltage values, according to an embodiment of the present disclosure. The sensing circuit 240 may be used to implement a force voltage sense current technique, such that the sensing circuit 240 may apply or force a data voltage $V_{data}$ 242 and determine or sense a current $I_{diode}$ 244 across the diode 156 of a pixel 65 for the ELVSS voltage level 246. The data voltage 242 provided by the sensing circuit 240 may be referred to as a sense voltage $V_{sense}$ 248 and the resulting current 244 may be referred to as a sensed current $I_{sense}$ 250. Advantageously, the sensing circuit 240 may perform a single sense operation to determine one current and voltage value pair, and the same technique may be performed for off-time sensing (e.g., sensing while the electronic device 10 is off or otherwise not in active use).

Figure 19:
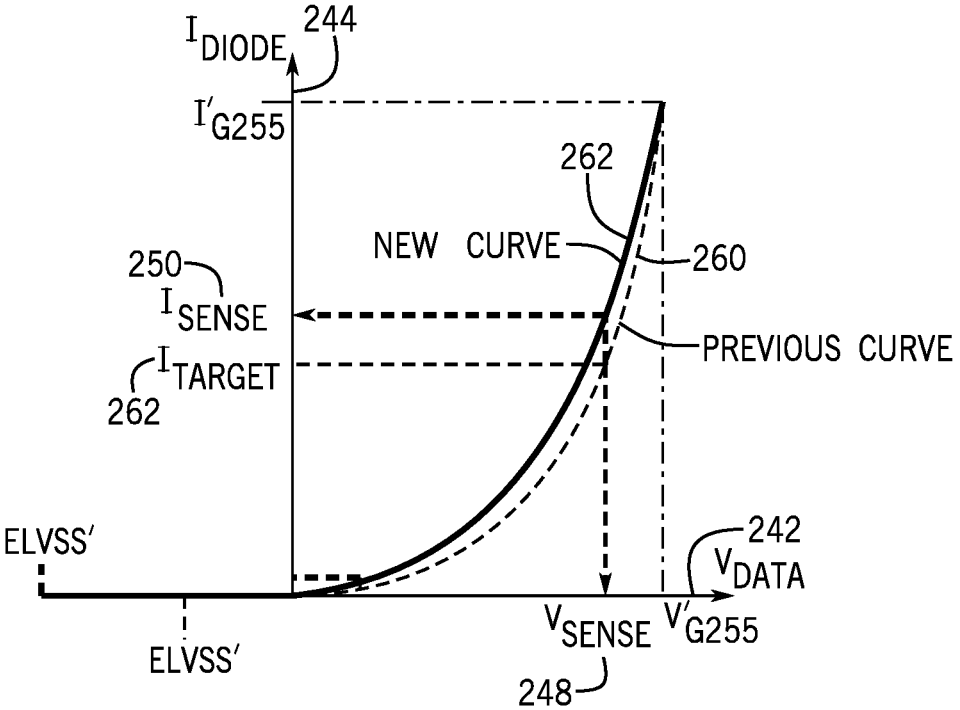
FIG. 19 is a graph illustrating performing a sensing operation using the reference array of FIG. 7, according to an embodiment of the present disclosure.

The sense voltage $V_{sense}$ 248 may be determined using a sense voltage generator 252. FIG. 19 is a graph illustrating performing a sensing operation using the reference array 64 of FIG. 7, according to an embodiment of the present disclosure. Because a temperature change between two sensing operations may be relatively small (e.g., less than or equal to approximately 5 degrees Celsius), a change in curvature between a previous current-voltage curve 260 (e.g., before the temperature change) and a current current-voltage curve 262 (e.g., after the temperature change) may also be relatively small. As such, the sense voltage generator 252 may derive sensing voltages (e.g., $V_{sense}$ 248) from the previous current-voltage curve 260. In the case of the previous current-voltage curve 260, the sense voltage $V_{sense}$ 248 corresponded to a target current $I_{target}$ 262. The reference array control circuitry 89 may use the same sense voltage $V_{sense}$ 248 from the previous current-voltage curve 260, and determine and/or measure the corresponding current ($I_{Diode}$ 244) across the diode 156, which is the sensed current $I_{sense}$ 250. In this manner, the reference array control circuitry 89 may perform sensing operations to determine the set of current and voltage values used to interpolate the current-voltage curve 262.

Figure 20:
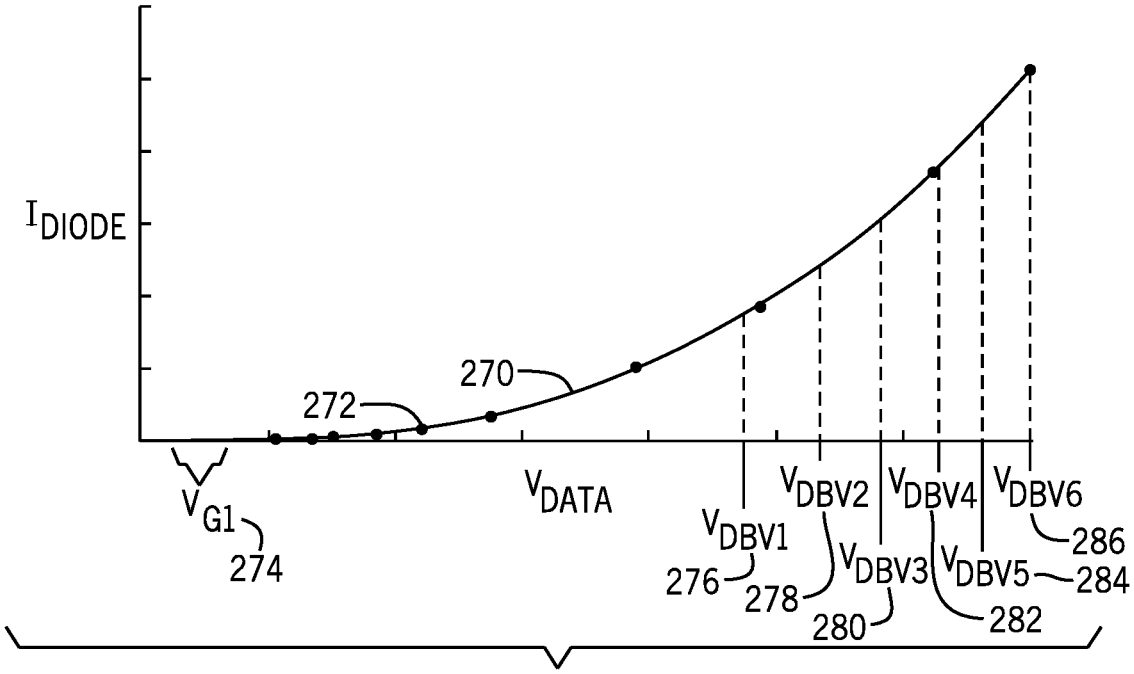
FIG. 20 is a graph illustrating associating portions of a current-voltage curve interpolated from a set of current and voltage values with various brightness settings, according to an embodiment of the present disclosure.

FIG. 20 is a graph illustrating associating portions of a current-voltage curve 270 interpolated from the set of current and voltage values (e.g., 272) with various brightness settings, according to an embodiment of the present disclosure. A first portion of the current-voltage curve 270, from $V_{G1}$ 274 to $V_{DBV1}$ 276 may correspond to a first brightness setting. $V_{G1}$ 274 may correspond to a voltage level that, when supplied to a pixel 65 at the first brightness setting, emits a gray level 1. It should be noted that $V_{G1}$ 274 may include a small range (e.g., approximately 100 milliVolts) of variation across different brightness settings (e.g., 50 nits to 150 nits). While $V_{G1}$ 274 may be associated with a voltage producing the lowest gray level (G1) using the first brightness setting, $V_{DBV1}$ 276 may be associated with a voltage producing the highest gray level (G255) using the first brightness setting. As an example, the first brightness setting may be 50 nits.

A second portion of the current-voltage curve 270, from $V_{G1}$ 274 to $V_{DBV2}$ 278, may correspond to a second brightness setting. $V_{G1}$ 274 may be associated with a voltage producing the lowest gray level (G1) using the second brightness setting, and $V_{DBV2}$ 278 may be associated with a voltage producing the highest gray level (G255) using the second brightness setting. As an example, the second brightness setting may be 70 nits.

A third portion of the current-voltage curve 270, from $V_{G1}$ 274 to $V_{DBV3}$ 280 may correspond to a third brightness setting. $V_{G1}$ 274 may be associated with a voltage producing the lowest gray level (G1) using the third brightness setting, and $V_{DBV3}$ 280 may be associated with a voltage producing the highest gray level (G255) using the third brightness setting. As an example, the third brightness setting may be 90 nits.

A fourth portion of the current-voltage curve 270, from $V_{G1}$ 274 to $V_{DBV4}$ 282 may correspond to a fourth brightness setting. $V_{G1}$ 274 may be associated with a voltage producing the lowest gray level (G1) using the fourth brightness setting, and $V_{DBV4}$ 282 may be associated with a voltage producing the highest gray level (G255) using the fourth brightness setting. As an example, the fourth brightness setting may be 110 nits.

A fifth portion of the current-voltage curve 270, from $V_{G1}$ 274 to $V_{DBV5}$ 284 may correspond to a fifth brightness setting. $V_{G1}$ 274 may be associated with a voltage producing the lowest gray level (G1) using the fifth brightness setting, and $V_{DBV5}$ 284 may be associated with a voltage producing the highest gray level (G255) using the fifth brightness setting. As an example, the fifth brightness setting may be 130 nits.

A sixth portion of the current-voltage curve 270, from $V_{G1}$ 274 to $V_{DBV6}$ 286 may correspond to a sixth brightness setting. $V_{G1}$ 274 may be associated with a voltage producing the lowest gray level (G1) using the sixth brightness setting, and $V_{DBV6}$ 286 may be associated with a voltage producing the highest gray level (G255) using the sixth brightness setting. As an example, the sixth brightness setting may be 150 nits.

Figure 21:
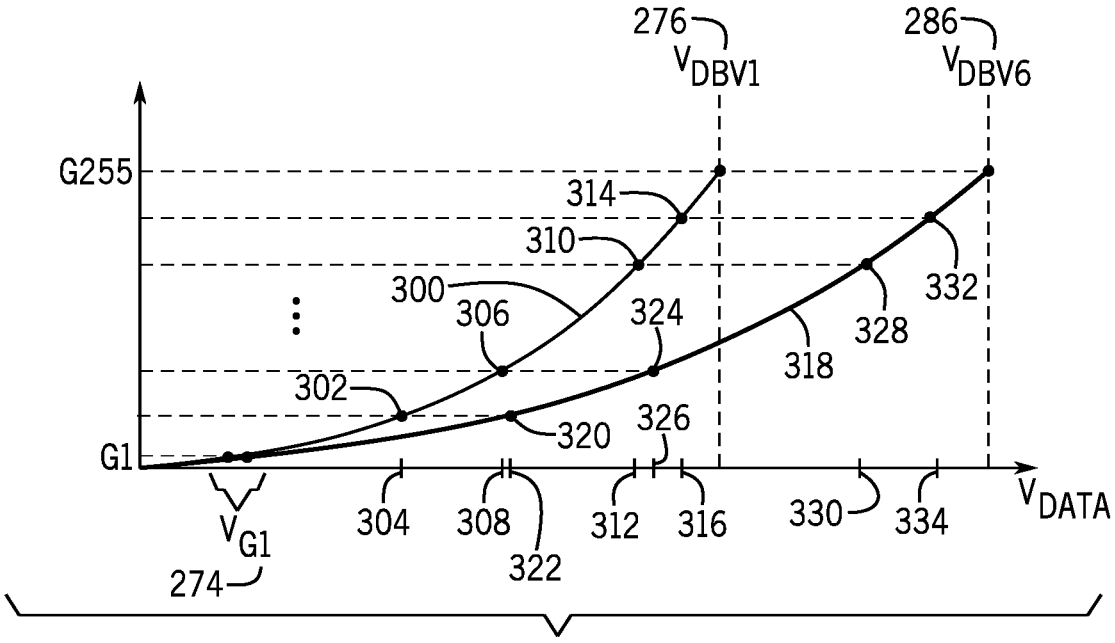
FIG. 21 is graph illustrating gamma tap points on portions of a current-voltage curve of FIG. 20 associated with various brightness settings, according to an embodiment of the present disclosure.

FIG. 21 is graph illustrating gamma tap points on portions of the current-voltage curve 270 of FIG. 20 associated with various brightness settings, according to an embodiment of the present disclosure. A first curve 300 may correspond to the first portion of the current-voltage curve 270 from FIG. 20, which spans a data voltage range from $V_{G1}$ 274 to $V_{DBV1}$ 276. The first curve 300 may correspond to a first brightness setting (e.g., 50 nits). As such, a gamma tap point for gray level 1 includes the voltage $V_{G1}$ 274, and a gamma tap point for gray level 255 includes the voltage $V_{DBV1}$ 276 (for the first brightness setting). The reference array control circuitry 89 may similarly associate or map gamma tap points using the first curve 300 for each gray level for the first brightness setting.

For example, a second gamma tap point 302 may be associated with a second gray level (e.g., G8) and include a second corresponding voltage 304. A third gamma tap point 306 may be associated with a third gray level (e.g., G18) and include a third corresponding voltage 308. A fourth gamma tap point 310 may be associated with a fourth gray level (e.g., G188) and include a fourth corresponding voltage 312. A fifth gamma tap point 314 may be associated with a fourth gray level (e.g., G231) and include a fifth corresponding voltage 316.

The reference array control circuitry 89 may similarly associate or map gamma tap points using other portions of the current-voltage curve 270 of FIG. 20 for other brightness settings. A second curve 318 may correspond to the sixth portion of the current-voltage curve 270 from FIG. 20, which spans a data voltage range from $V_{G1}$ 274 to $V_{DBV6}$ 286. The second curve 318 may correspond to a second brightness setting (e.g., 150 nits). As such, a gamma tap point for gray level 1 includes the voltage $V_{G1}$ 274, and a gamma tap point for gray level 255 includes the voltage $V_{DBV6}$ 286 (for the second brightness setting). For example, a second gamma tap point 320 may be associated with a second gray level (e.g., G8) and include a second corresponding voltage 322. A third gamma tap point 324 may be associated with a third gray level (e.g., G18) and include a third corresponding voltage 326. A fourth gamma tap point 328 may be associated with a fourth gray level (e.g., G188) and include a fourth corresponding voltage 330. A fifth gamma tap point 332 may be associated with a fourth gray level (e.g., G231) and include a fifth corresponding voltage 334. In this manner, the reference array control circuitry 89 may generate gamma tap points between data voltages and gray levels for each brightness setting of the pixel 65. It should be noted that $V_{G1}$ 274 may include a small range (e.g., approximately 100 milliVolts) of variation across different brightness settings (e.g., 50 nits to 150 nits).

Figure 22:
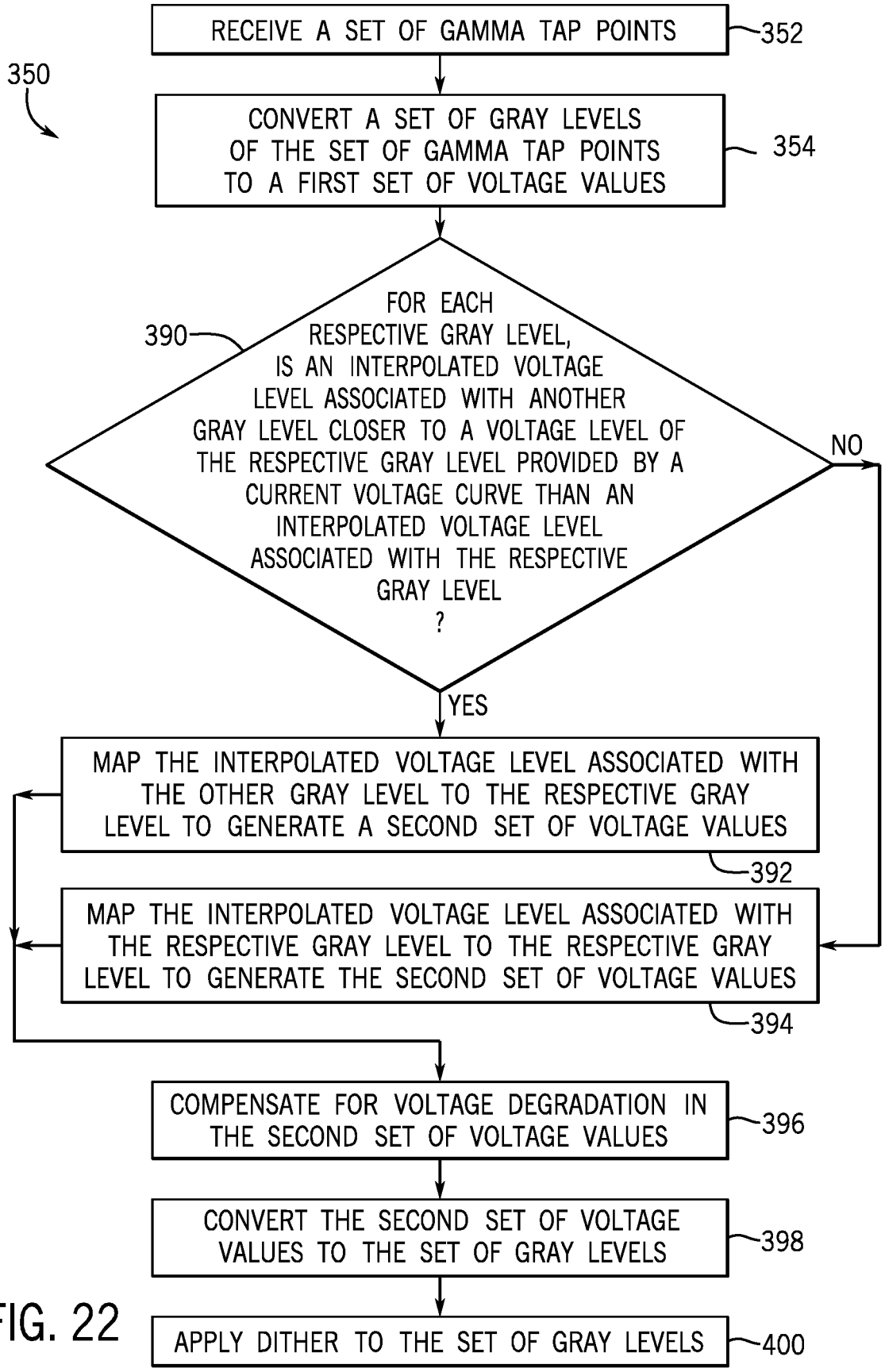
FIG. 22 is a flow diagram of a method for performing gray tracking or gamma correction on the gamma tap points of FIG. 21, according to an embodiment of the present disclosure.

FIG. 22 is a flow diagram of a method 350 for performing gray tracking or gamma correction on the gamma tap points of FIG. 21, according to an embodiment of the present disclosure. The method 350 may be performed by any suitable device or combination of devices that may convert gray levels to voltage values and vice versa, map interpolated voltage levels to gray levels, compensate for voltage degradation, and apply dither to gray levels. While the method 350 is described using steps in a specific sequence, it should be understood that the present disclosure contemplates that the described steps may be performed in different sequences than the sequence illustrated, and certain described steps may be skipped or not performed altogether. In some embodiments, at least some of the steps of the method 350 may be performed by the reference array control circuitry 89 or a system on a chip (SoC) of the reference array 64, as described below. However, it should be understood that any suitable device or combination of devices is contemplated to perform the method 350, such as control circuitry of the active array 62, the processor core complex 12, and the like.

The reference array control circuitry 89 may receive or determine (process block 352) a set of gamma tap points. The set of gamma tap points may map data voltage values to gray levels. For example, the set of gamma tap points may be those identified in FIG. 21 by the current-voltage curve 270 of FIG. 20. The set of gamma tap points may include gamma tap points for one or more brightness settings.

The reference array control circuitry 89 may then convert (process block 354) a set of gray levels of the set of gamma tap points to a first set of voltage values. In particular, the reference array control circuitry 89 may receive, determine, and/or store the data voltage values corresponding to the gray levels. Because there are 255 gray levels (G1-G255), the reference array control circuitry 89 may receive, determine, and/or store 255 data voltage values. The same set of gray levels may be chosen for each brightness setting as the gamma tap points.

Figure 23:
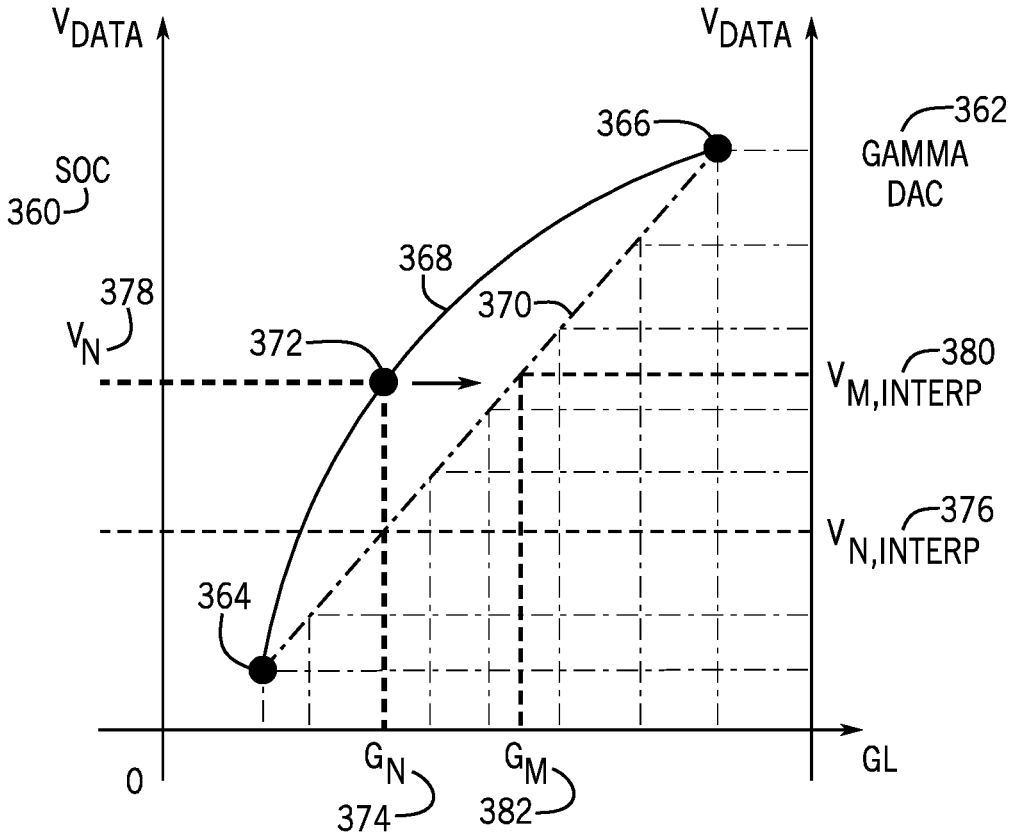
FIG. 23 is a graph comparing gamma level to voltage level conversion using a system on a chip and a gamma digital-to-analog converter, according to an embodiment of the present disclosure.

Specifically, a system on a chip (SoC) of the reference array 64 may perform this step instead of, for example, a gamma DAC, which may have greater interpolation error. This is because the gamma DAC may perform piecewise linear gamma level to voltage level conversion, whereas the SoC may calculate more accurate voltage levels because of the stored current-voltage curve (e.g., 270). For example, FIG. 23 is a graph comparing gamma level (e.g., gray level)

to voltage level conversion using a SoC 360 and a gamma DAC 362, according to an embodiment of the present disclosure. The graph includes two tap points 364, 366, with a curve 368 connecting the two tap points 364, 366. The curve 368 may be a portion of the current-voltage curve 270 of FIG. 20 and stored in the SoC 360. The gamma DAC 362 may generate an interpolated line 370 that connects the two tap points 364, 366. For gamma tap point 372, with a gray level of $G_n$ 374, the gamma DAC 362 may store an interpolated data voltage of $V_{n,interp}$ 376 based at least in part on the interpolated line 370, instead of a "true" voltage of $V_n$ 378. Instead, to generate more accurate gamma tap points, the SoC may map voltages on the interpolated line 370 that are closer to the true voltage of $V_n$ 378 to the gray level of $G_n$ 374. For example, the SoC may map an interpolated data voltage $V_{m,interp}$ 380 (which corresponds to another gray level of $G_m$ 382 on the interpolated line 370) to the gray level of $G_n$ 374, as $V_{m,interp}$ 380 is closer to the true voltage of $V_n$ 378 than $V_{n,interp}$ 376.

As such, for each respective gray level of the set of gray levels, the reference array control circuitry 89 may determine (decision block 390) whether there is a linearly interpolated voltage level (as interpolated by the gamma DAC 362) associated with another gray level of the set of gray levels that is closer to a voltage level of the respective gray level provided by a current-voltage curve (stored in the SoC 360) than a linearly interpolated voltage level associated with the respective gray level. The current-voltage curve may be interpolated from a set of current and voltage values with various brightness settings (e.g., with more accuracy than linear interpolation).

If so, the reference array control circuitry 89 may map (process block 392) the linearly interpolated voltage level associated with the other gray level to the respective gray level to generate a second set of voltage values. If not, the reference array control circuitry 89 may map (process block 394) the linearly interpolated voltage level associated with the respective gray level to the respective gray level to generate the second set of voltage values.

The reference array control circuitry 89 may compensate (process block 396) for voltage degradation in the second set of voltage values. Voltage at various pixels, wires, connections, interconnections, buses, circuit components, and the like, may vary (e.g., increase or decrease) over time and normal operation. For example, the voltage degradation may be due to degradation of components over time and normal use in the active array 62. Any suitable voltage compensation technique may be used to compensate for the voltage degradation in the second set of voltage values.

The reference array control circuitry 89 may convert (process block 398) the second set of voltage values to the set of gray levels. If the reference array control circuitry 89 mapped (from process block 392) a linearly interpolated voltage level associated with another gray level to a respective gray level, then outputting the respective gray level may result in outputting the other gray level. That is, if the interpolated data voltage $V_{m,interp}$ 380 (which corresponds to another gray level of $G_m$ 382 on the interpolated line 370) was mapped to the gray level of $G_n$ 374, then outputting $G_n$ 374 may result in outputting $G_m$ 382.

The reference array control circuitry 89 may then apply (process block 400) dither to the set of gray levels further reduce gray tracking or gamma error. Dither may be noise applied to the set of gray levels to randomize any quantization error, thus undesirable patterns, such as color banding in images. Any suitable form of dithering may be applied, such as 4 bit dithering. The reference array control circuitry 89 may program the resulting set of gray levels in the gamma DAC 362. The gamma DAC 362 may be programmed with a new set of gray levels (by repeating the method of 350) when the brightness setting of the pixel 65 changes. In this manner, the reference array control circuitry 89 may perform gray tracking or gamma correction on the gamma tap points of FIG. 21.

Figure 24:
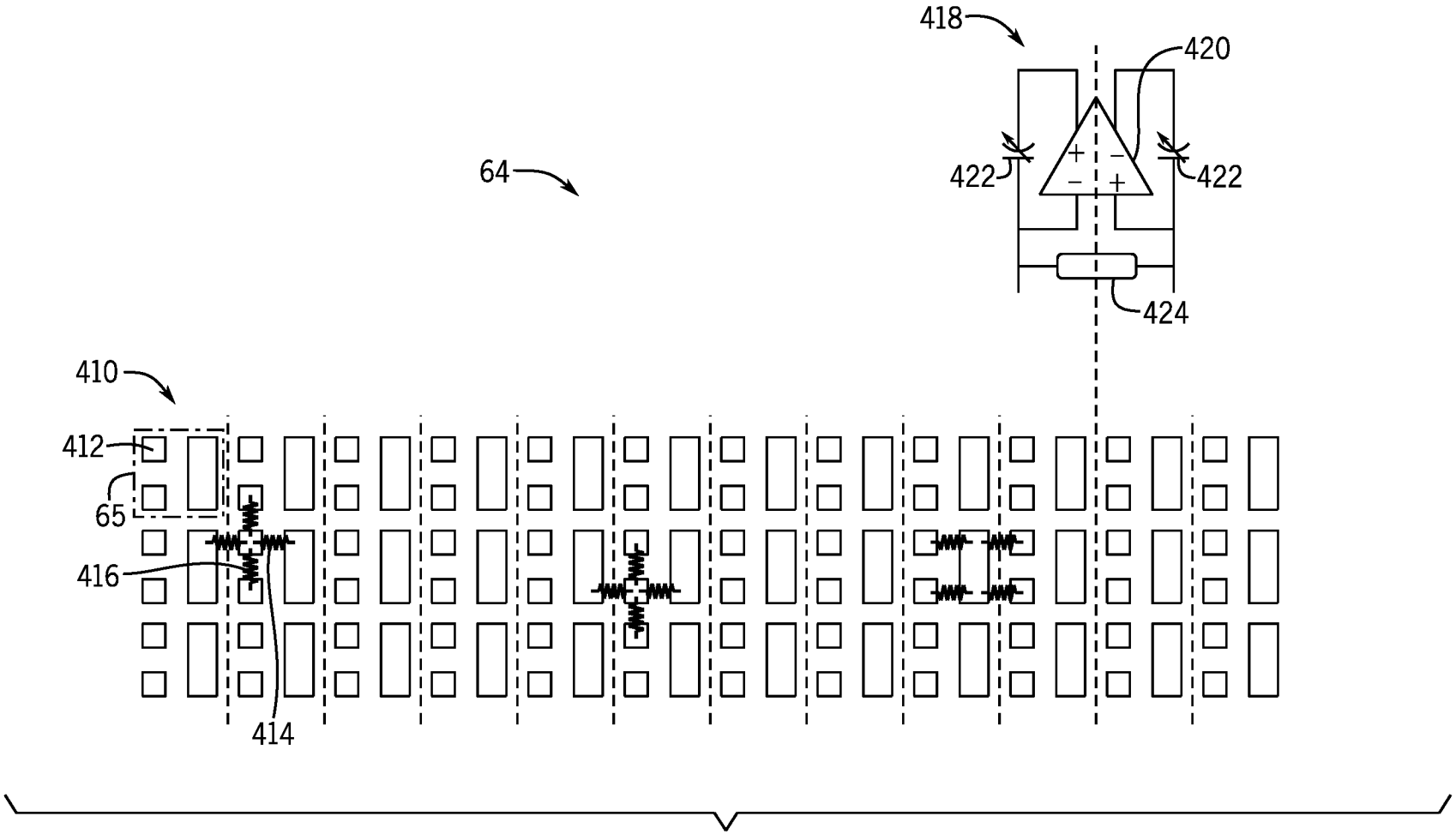
FIG. 24 is a diagram of the reference array of FIG. 7 illustrating features that decrease lateral leakage and/or bias currents, according to an embodiment of the present disclosure.
Figure 25:
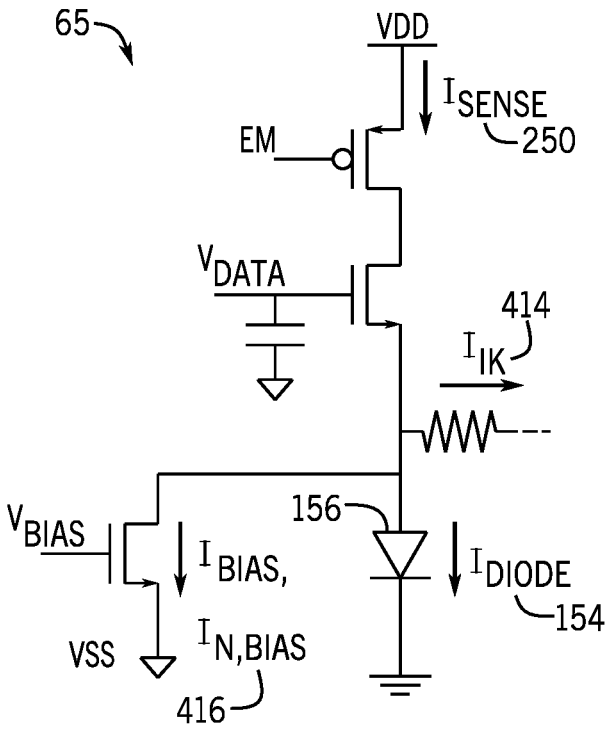
FIG. 25 is a circuit diagram of a pixel of the reference array of FIG. 7, according to an embodiment of the present disclosure.

To accurately sense current over a diode (e.g., 156) of a pixel 65, the reference array control circuitry 89 may decrease and/or cancel lateral leakage and/or bias currents of the pixel 65. FIG. 24 is a diagram of the reference array 64 of FIG. 7 illustrating features that decrease lateral leakage and/or bias currents, according to an embodiment of the present disclosure. As illustrated, the reference array 64 includes 12 columns 400 of pixels 65, which may each have subpixels 412 associated with a color (e.g., red, green, or blue). In some embodiments, pairs of columns 400 may be used for color sensing. For example, a first pair of columns 400 may be used to sense the color red, a second pair of columns 400 may be used to sense the color green, and a third pair of columns 400 may be used to sense the color blue. In alternative or additional embodiments, any suitable number of columns 400 and pixels 65 in the reference array 64 are contemplated. The reference array control circuitry 89 may decrease lateral leakage current (e.g., 414) and/or bias current (e.g., 416) between pixels 65 using the techniques described below. FIG. 25 is a circuit diagram of a pixel 65 of the reference array 64 of FIG. 7, according to an embodiment of the present disclosure. The lateral leakage current $I_{lk}$ 414 refers to current that may leak to other pixels 65 when the pixel 65 is in operation (e.g., emitting light). Similarly, the bias current $I_{bias}$, $I_{n,bias}$ 416 refers to current that may drain from the pixel 65 based at least in part on bias currents of other pixels 65. As such, when sensing current (e.g., $I_{sense}$ 250), if there is lateral leakage current $I_{lk}$ 414 and/or bias current $I_{bias}$, $I_{n,bias}$ 416, $I_{sense}$ 250 may not equal the current over the diode 156 (e.g., $I_{Diode}$ 154). Thus, sensing the current over the diode 156 using $I_{sense}$ 250 may not be accurate.

Referring back to FIG. 24, differential sensing circuitry 418, which may include an operational amplifier 420, capacitors 422, and a common mode feedback circuit 424, may be used to decrease noise and/or interference between pixel columns 410 and increase dynamic range. It should be understood that the reference array 64 may include the differential sensing circuitry 418 in between one or more columns 410 of pixels 65. In some embodiments, a pair of pixel columns 410 may be used as a reference (e.g., one for each polarity (positive, negative) from a power source (e.g., $V_{DD}$)) for differential sensing for each color of the pixels 65. In alternative or additional embodiments, correlated double sampling and/or chopping may be used to decrease leakage current, mismatch, and/or offset.

Figure 26:
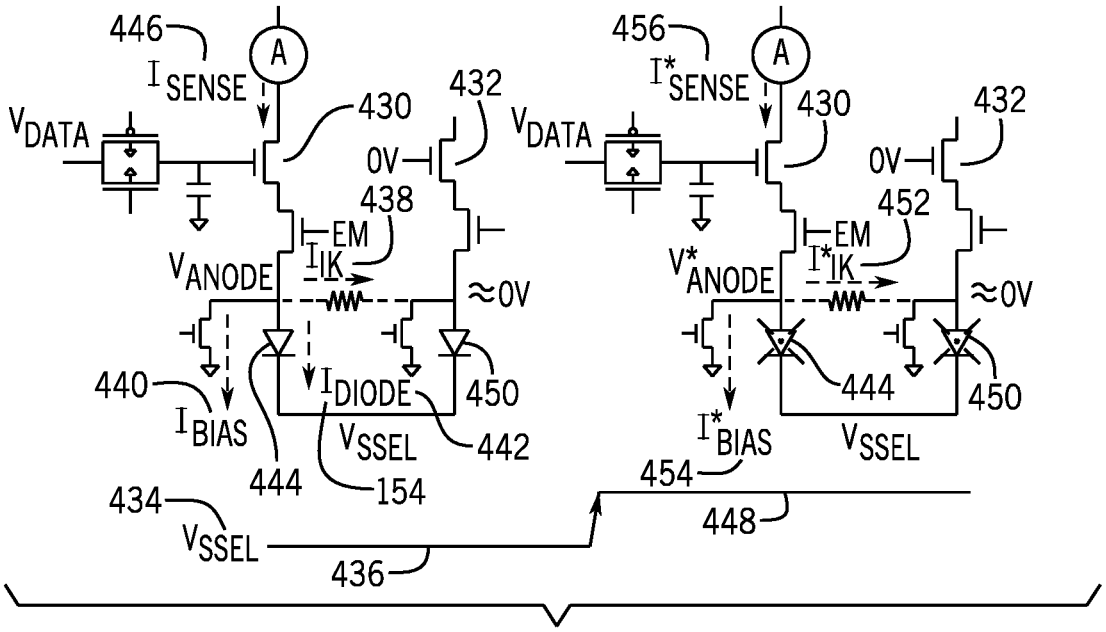
FIG. 26 is a circuit diagram illustrating a first technique to more accurately sense current in a pixel of the reference array of FIG. 7, according to an embodiment of the present disclosure.

FIG. 26 is a circuit diagram illustrating a first technique to more accurately sense current in a pixel of the reference array 64 of FIG. 7, according to an embodiment of the present disclosure. The ELVSS power supply may provide supply voltage of VSSEL 434 to two pixels 430, 432 of the reference array 64. As illustrated, the ELVSS power supply may first provide an operating supply voltage 436 (e.g., approximately −1.6 V (Volts)) to the two pixels 430, 432. Providing the operating supply voltage 436 may result in an operating leakage current $I_{lk}$ 438, an operating bias current $I_{bias}$ 440, and an operating diode current $I_{diode}$ 442 across a diode 444 of the first pixel 430. As such, sensing the current (e.g., $I_{sense}$ 446) may result in a sum current of the three currents (e.g., $I_{sense}=I_{lk}+I_{bias}+I_{diode}$).

The ELVSS power supply may then provide an increased voltage 448 (e.g., approximately 3 V) to the two pixels 430, 432 that stops current from flowing across the diodes (e.g., LEDs) 444, 450 of the two pixels 430, 432, resulting in a leakage current $I^*_{lk}$ 452 and a bias current $I^*_{bias}$ 452. As such, sensing the current (e.g., $I^*_{sense}$ 456) may result in a sum current of the two currents ($I^*_{sense}=I_{lk}+I^*_{bias}$). In this manner, subtracting $I^*_{sense}$ 456 from $I_{sense}$ 446 may result in a more accurate value for $I_{diode}$ (e.g., $I_{diode}=I_{sense}-I^*_{sense}$). It should be noted that the first technique of FIG. 26 may double sensing or sampling time in the pixels 430, 432.

Figure 27:
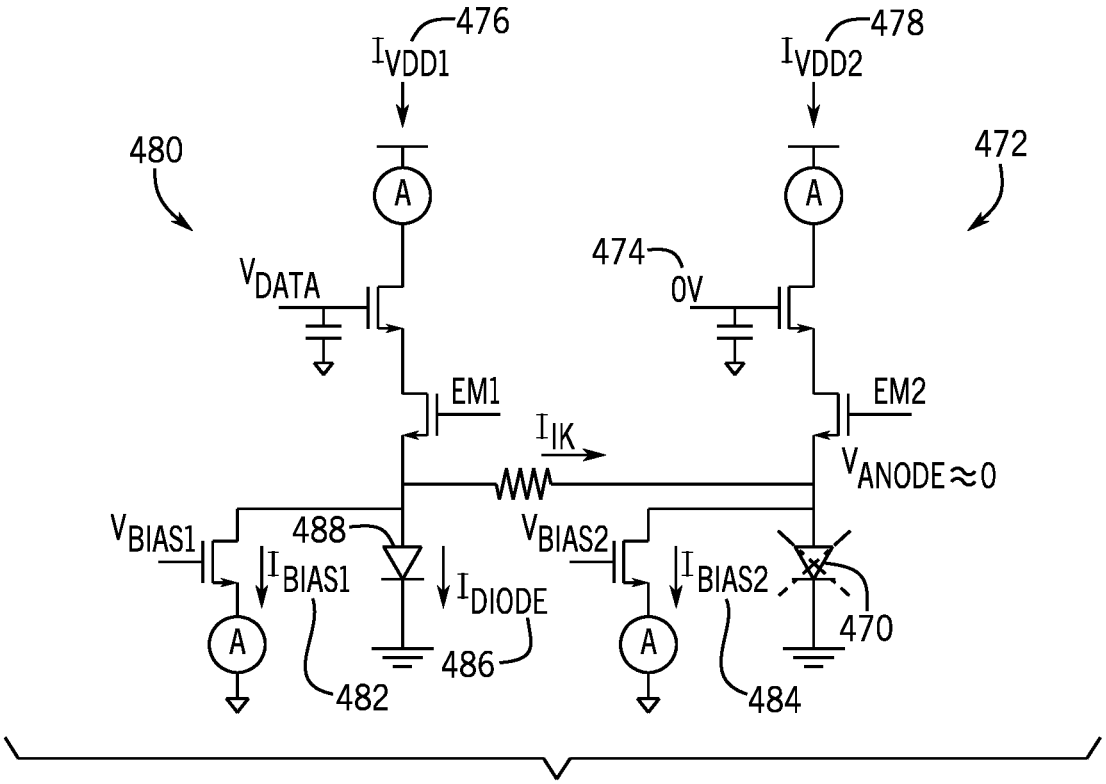
FIG. 27 is a circuit diagram illustrating a second technique to more accurately sense current in a pixel of the reference array of FIG. 7, according to an embodiment of the present disclosure.

FIG. 27 is a circuit diagram illustrating a second technique to more accurately sense current in a pixel of the reference array 64 of FIG. 7, according to an embodiment of the present disclosure. The second technique takes advantage of the knowledge that current flowing into a pixel may equal current flowing out of the pixel. As such, a diode 470 of a pixel 472 may be forced off by providing a low (e.g., 0 V) data voltage 474 to the diode 470, such that current across that diode 470 is zero. The reference array control circuitry 89 may then sense currents $I_{VDD1}$ 476 and $I_{VDD2}$ 478 provided by a drain power supply (ELVDD) to an adjacent pixel 480 and the pixel 472, respectively. The reference array control circuitry 89 may also sense bias currents $I_{Bias1}$ 482 and $I_{Bias2}$ 484 of the adjacent pixel 480 and the pixel 472, respectively. Because current flowing into a pixel may equal current flowing out of the pixel and the current across the diode 470 is zero, current $I_{Diode}$ 486 across a diode 486 of the adjacent pixel 480 may be more accurately determined by determining the difference of the sum of the current flowing into the two pixels 480, 472 and the sum of the current flowing out of the two pixels 480, 472 (e.g., $I_{Diode}=(I_{VDD1}+I_{VDD2})-(I_{Bias1}+I_{Bias2})$.

Figure 28:
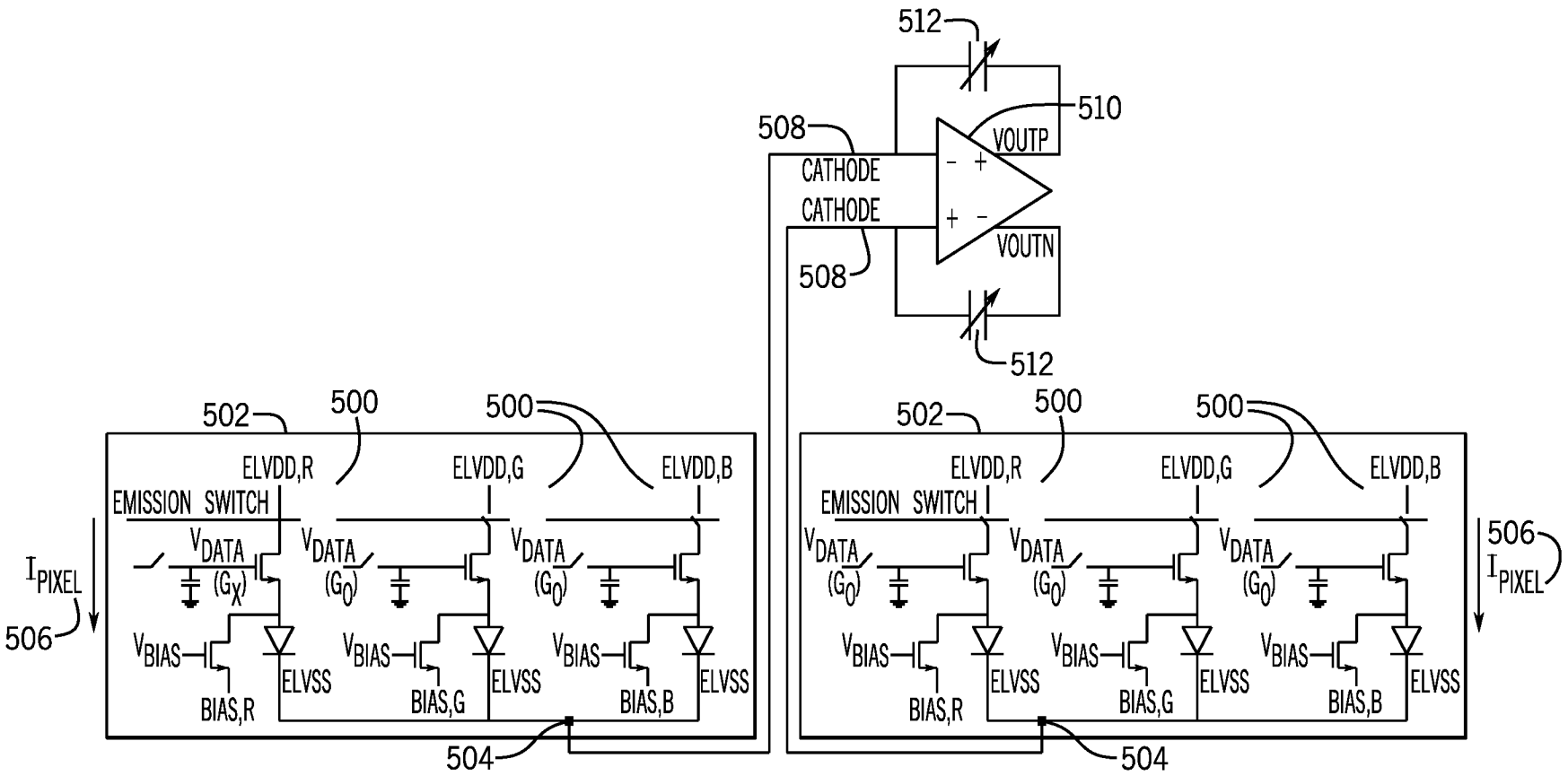
FIG. 28 is a circuit diagram illustrating a third technique to more accurately sense current in a pixel of the reference array of FIG. 7, according to an embodiment of the present disclosure.

FIG. 28 is a circuit diagram illustrating a third technique to more accurately sense current in a pixel of the reference array 64 of FIG. 7, according to an embodiment of the present disclosure. As illustrated, each subpixel 500 (corresponding to red, green, or blue colors) of pixels 502 may be coupled to an ELVSS port 504 that supplies a source voltage supply (VSS) to the pixels 502. Current $I_{Pixel}$ 506 across each pixel 502 may be directly measured from the ELVSS port 504. Each ELVSS port 504 may be coupled to a cathode 508. A pair of cathodes 508 may be coupled to an operational amplifier 510 and capacitors 512. In some embodiments, the ELVSS ports 504 may be coupled to the differential sensing circuitry 418. In this manner, the reference array control circuitry 89 may more accurately sense the current across each pixel.

Figure 29:
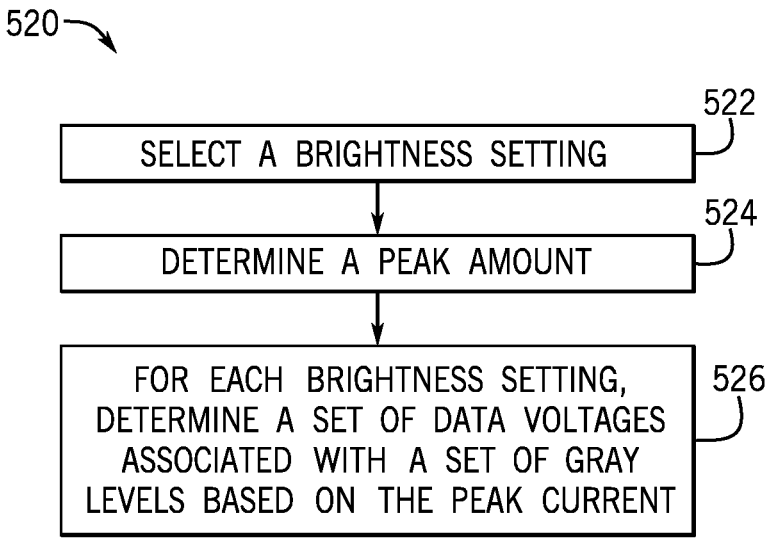
FIG. 29 is a flow diagram of a method for calibrating the reference array of FIG. 7, according to an embodiment of the present disclosure.

FIG. 29 is a flow diagram of a method 520 for calibrating the reference array 64 of FIG. 7, according to an embodiment of the present disclosure. The method 520 may be performed by any suitable device or combination of devices that may determine a peak current and data voltages associated with gray levels. While the method 520 is described using steps in a specific sequence, it should be understood that the present disclosure contemplates that the described steps may be performed in different sequences than the sequence illustrated, and certain described steps may be skipped or not performed altogether. In some embodiments, at least some of the steps of the method 520 may be performed by the reference array control circuitry 89, as described below. However, it should be understood that any suitable device or combination of devices is contemplated to perform the method 520, such as control circuitry of the active array 62, the processor core complex 12, and the like.

The reference array control circuitry 89 may select (process block 522) a brightness setting of one or more pixels. For example, the reference array control circuitry 89 may select a maximum brightness setting (e.g., 150 nits, 750 nits, or the like) of the one or more pixels.

The reference array control circuitry 89 may then determine (process block 524) a peak current of the one or more pixels. In particular, the peak current may be associated with a current provided to the one or more pixels that results in displaying or emitting a gray level of 255. In some embodiments, the reference array control circuitry 89 may estimate the peak current, and perform optical measurements on the one or more pixels to determine if G255 is being emitted by the one or more pixels within a certain threshold. If not, the reference array control circuitry 89 may adjust the estimated peak current until G255 is emitted by the one or more pixels.

The reference array control circuitry 89 may determine (process block 526) a set of data voltages associated with a set of gray levels for each brightness setting based at least in part on the peak current. In particular, for each gray level (G1-G255) of each brightness setting, the reference array control circuitry 89 may estimate a data voltage that emits the gray level at the brightness setting, and perform optical measurements on the one or more pixels to determine if the gray level is being emitted by the one or more pixels within a certain threshold. The reference array control circuitry 89 may estimated the data voltage based at least in part on a current-voltage curve determined and/or stored by the reference array 64, and the peak current. In particular, the reference array control circuitry 89 may determine a portion of the current-voltage curve to associated with each brightness setting based at least in part on the peak current. If the gray level is not being emitted by the one or more pixels within the certain threshold, the reference array control circuitry 89 may adjust the estimated data voltage until the gray level is emitted by the one or more pixels. In this manner, the reference array 64 may be calibrated for better performance.

Figure 30:
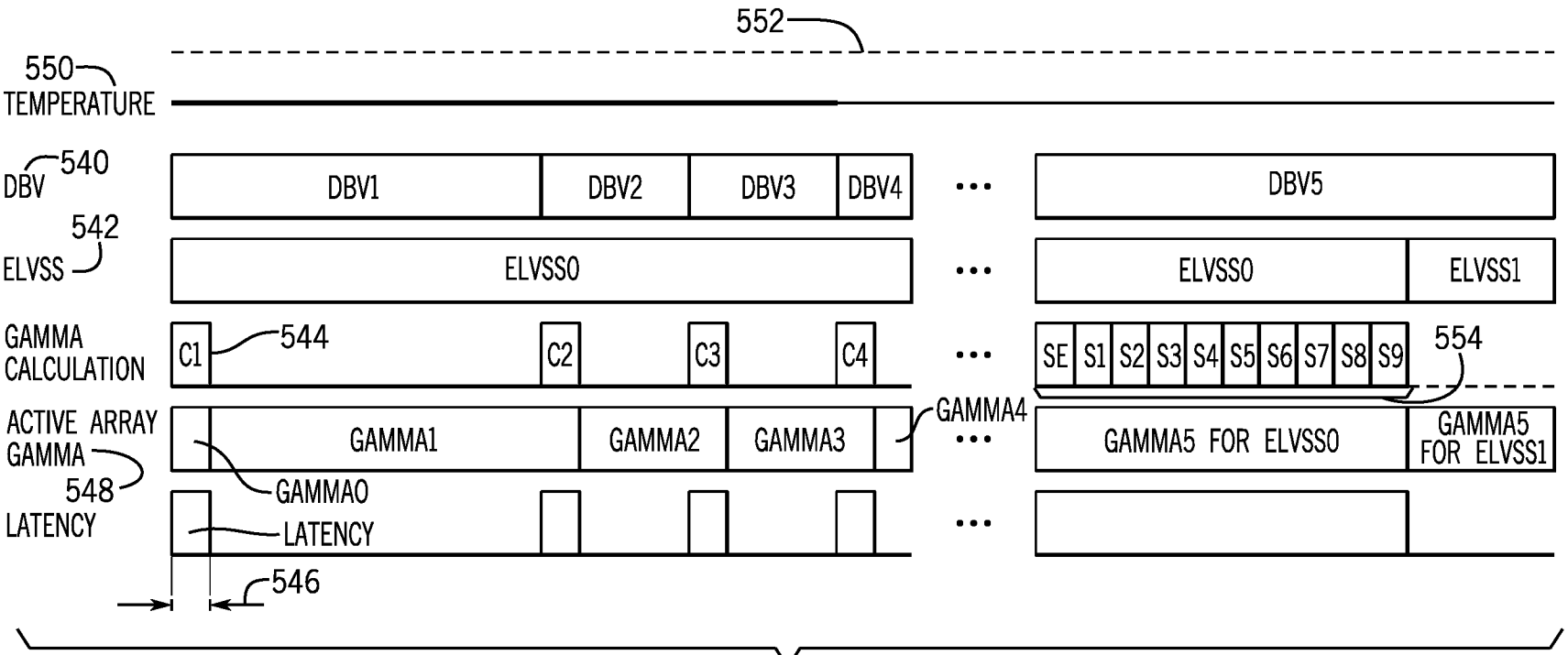
FIG. 30 is a timing diagram illustrating operation of the reference array, according to an embodiment of the present disclosure.

FIG. 30 is a timing diagram illustrating operation of the reference array 64, according to an embodiment of the present disclosure. As illustrated, as the brightness setting 540 (e.g., display brightness value (DBV)) changes (e.g., from DBV1, to DBV2, to DBV3, to DBV4), the ELVSS voltage value 542 (e.g., ELVSS0) remains constant. Moreover, calculating gamma or gray levels 544 corresponding to changing the brightness setting 540 of the reference array 64 may include a latency of one frame 546 of time. Once the gamma levels 544 have been calculated, the active array 62 may use the gamma levels 544 (as shown in 548) to display and/or emit image data.

Additionally, when the temperature 550 of the electronic display 18 reaches a certain threshold 552, the reference array control circuitry 89 may change the ELVSS voltage value 542 (e.g., to ELVSS1) after a sensing operation 554. Because the ELVSS voltage supplies of the reference array 64 and the active array 62 are separated, the ELVSS power supply for the reference array 64 may be adjusted without affecting emission of the active array 62. The active array 62 may synchronize updating its gamma levels 548 (e.g., to the gamma levels associated with ELVSS1) with the reference array control circuitry 89 updating its ELVSS power supply 542. Similarly, the active array 62 may synchronize updating its ELVSS power supply level with the reference array control circuitry 89 updating its ELVSS power supply 542.

Current-Voltage Sensing in the Active Array

A pixel emits a degree of light, gamma, or gray level based at least in part on an amount of current supplied to a diode (e.g., an LED) of the pixel. For voltage-driven pixels, a target voltage may be applied to the pixel to cause a target current to be applied to the diode (e.g., as expressed by a current-voltage relationship or curve) to emit a target gamma value. Variations (e.g., due to temperature, aging of the pixel, and the like) may affect a pixel by, for example, changing the resulting current that is applied to the diode when applying the target voltage. These variations may be a result of degradation of the pixel, and may affect multiple pixels of a display, such that non-uniformity among the pixels may result in visual artifact without appropriate compensation.

Figure 31:
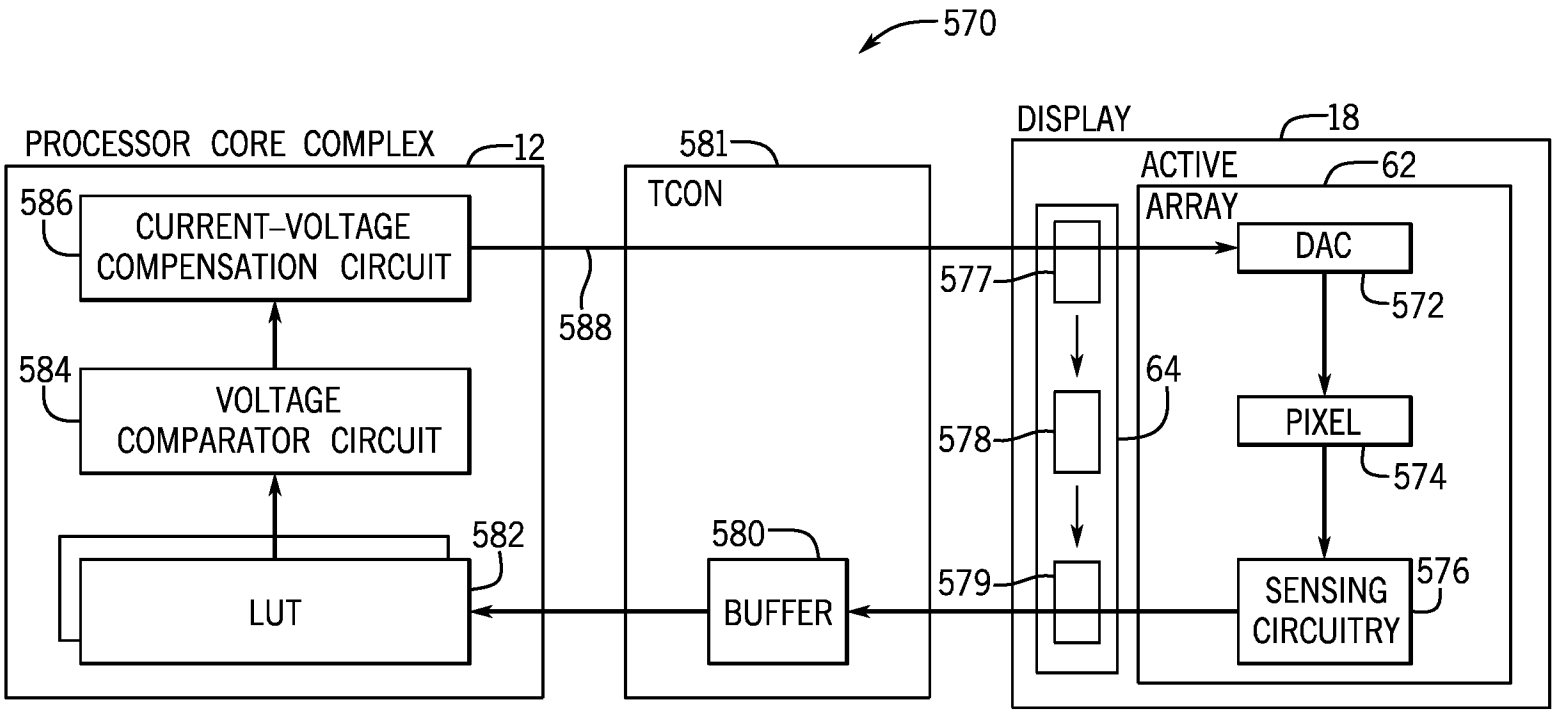
FIG. 31 is a block diagram of a system that performs current-voltage sensing, according to an embodiment of the present disclosure.

Accurately sensing current across diodes may more accurately identify when variations are affecting pixels. FIG. 31 is a block diagram of a system 570 that performs current-voltage sensing, according to an embodiment of the present disclosure. The system 570 includes the display 18 having the reference array 64 and the active array 62. The active array 62 may include a digital-to-analog converter 572, one or more pixels 574, and sensing and/or prediction circuitry 576. The sensing and/or prediction circuitry 576 may sense or predict a shift in a current-voltage relationship or curve. The remainder of the present disclosure discusses using sensing circuitry 576 to sense the current-voltage relationship or curve. However, it should be understood that prediction circuitry that performs prediction-based tracking based at least in part on sensing data collection is contemplated.

In some embodiments, the sensing circuitry 576 may perform a sensing operation periodically (e.g., approximately every two weeks) on the one or more pixels 574 of the active array 62. In additional or alternative embodiments, the sensing operation may be performed during an "off time" (e.g., when the electronic device 10 is not in active use, is plugged in and not in active use, during certain hours associated with inactivity, and the like). The reference array 64 may also include a digital-to-analog converter 577, one or more pixels 578, and sensing and/or prediction circuitry 579.

After a sensing operation is performed, a buffer 580 of a timing controller 581 may store results (e.g., current-voltage characteristics, values, measurements, and the like) of the sensing operation for a suitable period of time (e.g., approximately every two weeks). The timing controller 581 may be a component of the processor core complex 12, the display 18, or the electronic device 10. The result of the sensing operation may then be sent and stored in look-up tables 582 of the processor core complex 12 (e.g., a system on a chip). The look-up tables 582 may also store current-voltage characteristics, values, measurements, and the like, of the one or more pixels 578 of the reference array 64 (e.g., received from the sensing circuitry 579 of the reference array 64). A voltage comparator circuit 584 may determine, for the one or more pixels 574 of the active array 62, an amount of voltage to correct (based at least in part on previous results of sensing operations stored in the look-up tables 582 and the current-voltage characteristics of the pixels of the reference array 64). A current-voltage compensation circuit 586 may then generate a current-voltage curve (e.g., for the one or more pixels 574) based at least in part on the amounts of voltage to correct, and drive a respective pixel 574 via the digital-to-analog converter 572 based at least in part on the current-voltage curve. The arrows in FIG. 31 indicate a current-voltage sensing and compensation pipeline 588 that illustrates current and voltage data flow for sensing and compensation purposes in the system 570.

Figure 32:
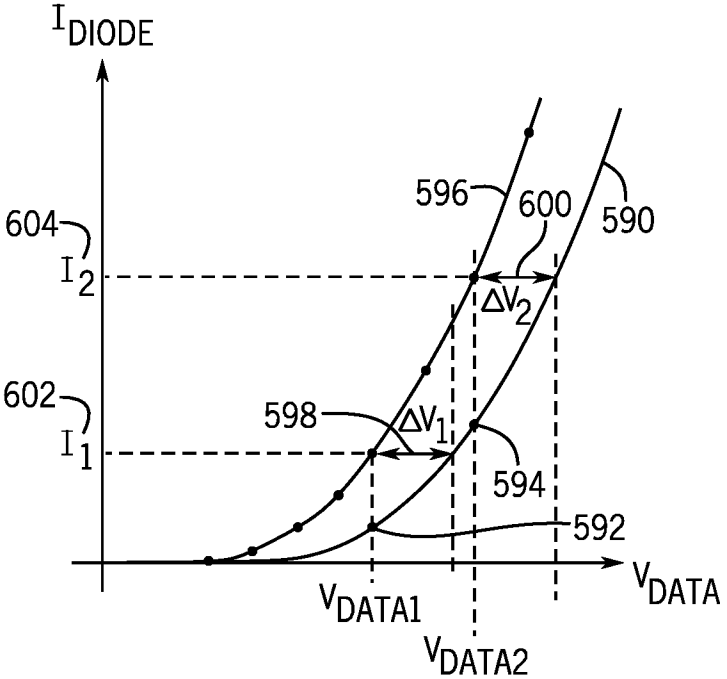
FIG. 32 is a graph of a current-voltage curve for a pixel of the display of FIG. 7, according to an embodiment of the present disclosure.

FIG. 32 is a graph of a current-voltage curve 590 for a pixel (e.g., 574) of the display 18 of FIG. 7, according to an embodiment of the present disclosure. The current-voltage curve 590 may be generated at a certain time $T_N$ after operating the display 18 or pixel 574 for N amount of time. The sensing circuitry 576 may determine or sense two (or more) current-voltage values 592, 594 at $T_N$, and the voltage comparator circuit 584 may interpolate the two current-voltage values to generate the current-voltage curve 590. A reference current-voltage curve 596 may also be generated by control circuitry of a reference array of the display 18. The reference current-voltage curve 596 may represent a "pristine" version of the current-voltage curve 590, in that the reference array may operate less frequently or minimized (e.g., and thus undergoes less aging) than an active array of the display 18, but operates at similar temperatures as the active array.

As illustrated, $\Delta V_1$ 598 indicates a difference in data voltages according to the current-voltage curve 590 and the reference current-voltage curve 596 to generate a target current $I_1$ 602 at a diode of the pixel 574. Similarly, $\Delta V_2$ 600 indicates a difference in data voltages according to the current-voltage curve 590 and the reference current-voltage curve 596 to generate a target current $I_2$ 604 at the diode.

Figure 33:
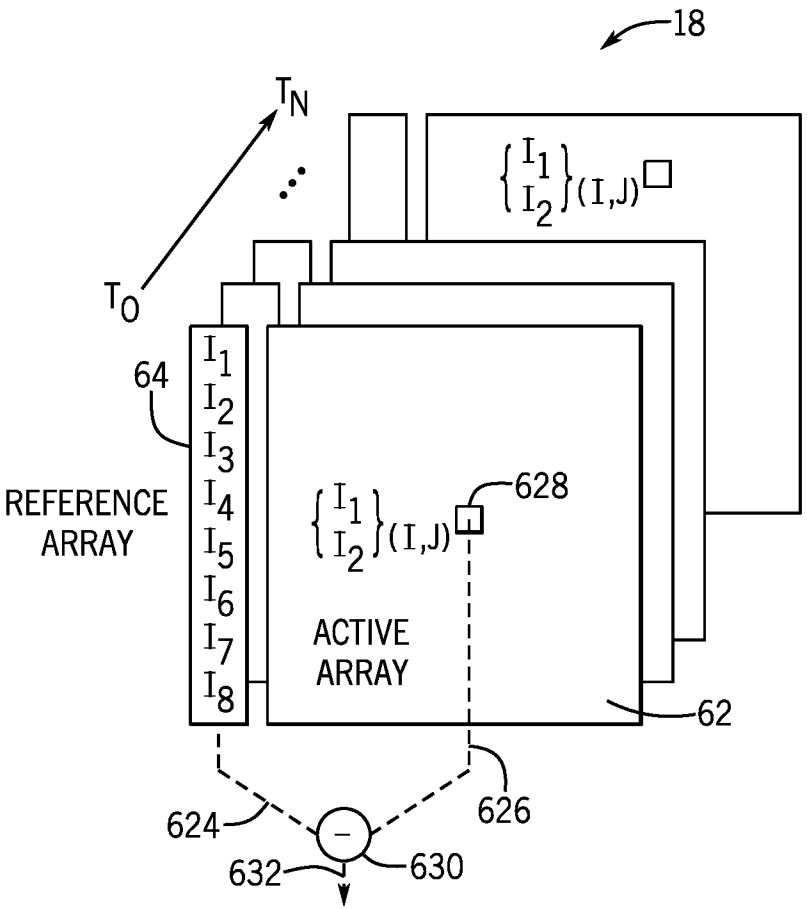
FIG. 33 is a diagram of the display of FIG. 7 at different times, according to an embodiment of the present disclosure.

FIG. 33 is a diagram of the display 18 of FIG. 7 at different times $T_0$ to $T_N$, according to an embodiment of the present disclosure. The display includes an active array 62, which may be programmed to display image data, and a reference array 64, which may be a pristine replica of the active array 62. At the different times $T_0$ to $T_N$, control and/or sensing circuitry of the reference array 64 may sense a set 624 (e.g., eight pairs) of current-voltage values (e.g., associated with currents $I_1$-$I_8$), which may be, for example, sent to the processor core complex 12 to be stored in the look-up tables 582. At the same times, the sensing circuitry 576 of the active array 62 may sense a set 626 (e.g., two pairs) of current-voltage values for each pixel (I,J) 628 of the active array 62), which may be, for example, sent to the processor core complex 12 to be stored in the look-up tables 582. The set of current-voltage values 626 sensed by the sensing circuitry 576 of the active array 62 may be associated with the $I_1$, $I_2$ and/or $V_{Data1}$, $V_{Data2}$. That is, in some embodiments, the set of current-voltage values 626 may include $I_1$ and $I_2$ (of the set of current-voltage values sensed by the sensing circuitry of the reference array 64) and the data voltages that produce $I_1$ and $I_2$ at each pixel (I,J) 628 of the active array 62. In alternative or additional embodiments, the set of current-voltage values 626 may include $V_{Data1}$ and $V_{Data2}$ (that produce $I_1$ and $I_2$ in the reference array 64) and the resulting currents that are produced by $V_{Data1}$ and $V_{Data2}$ at each pixel (I,J) 628 of the active array 62.

The voltage comparator circuit 584 of the processor core complex 12 may generate each current-voltage curve 590 for each pixel I, J 628 of the active array and generate the reference current-voltage curve 596, and compare 630 a respective current-voltage curve 590 to the reference current-voltage curve 596. The voltage comparator circuit 584 may then determine, for each pixel 628, voltage differences 632 between a respective current-voltage curve 590 to the reference current-voltage curve 596 to correct. The current-voltage compensation circuit 586 may then generate a compensation current-voltage curve for each pixel 628 based at least in part on the voltage differences 632, and drive a respective pixel 628 via the digital-to-analog converter 572.

Figure 34:
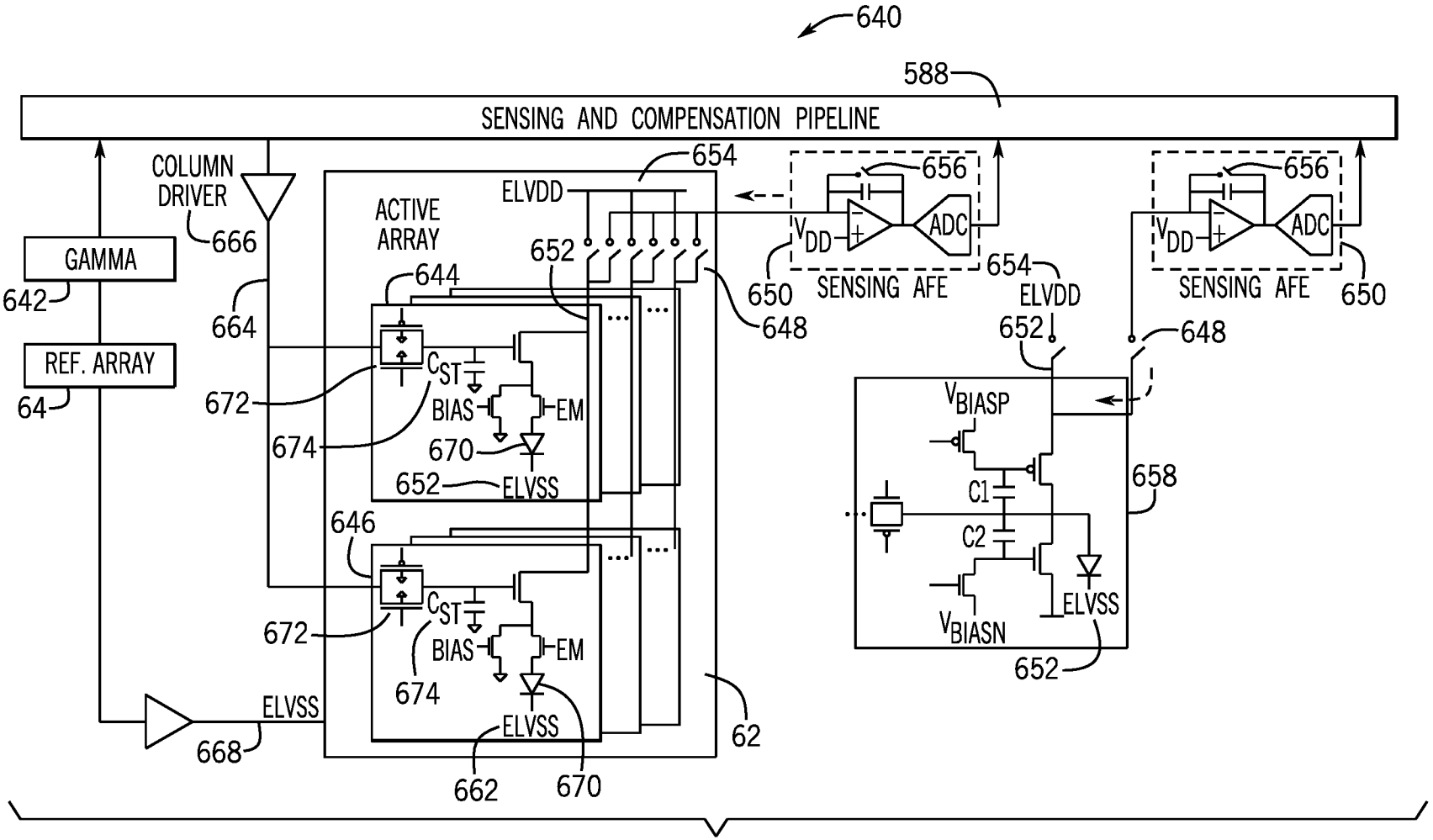
FIG. 34 is a schematic diagram of a current and voltage sensing system for the display of FIG. 7, according to an embodiment of the present disclosure.

FIG. 34 is a schematic diagram of a current and voltage sensing system 640 for the display 18 of FIG. 7, according to an embodiment of the present disclosure. The system 640 includes the sensing and compensation pipeline 588, which may sense, determine, and/or receive gamma and/or gray level information 642 (e.g., based at least in part on current and voltage values and/or a current-voltage curve) of the reference array 64. The sensing and compensation pipeline 588 may also sense, determine, and/or receive current and voltage values of each pixel (e.g., 644, 646) the active array 62 from power supply (e.g., ELVDD) routing 648 via a sensing analog front end (AFE) 650. As illustrated, the ELVDD routing 648 may couple a VDD supply line 652 of each pixel 644, 646 to ELVDD power supply 654 when the active array 62 is in normal operation (e.g., displaying image data). When the active array 62 is performing a sensing operation, a switch 656 of the sensing AFE 650 may couple the VDD supply line 652 of each pixel 644, 646 to the sensing AFE 650.

After sensing of the gamma information 642 and the current and voltage values of each pixel (e.g., 644, 646) is performed, the voltage comparator circuit 584 may generate voltage differences based at least in part on the gamma information 642 and the current and voltage values. The current-voltage compensation circuit 586 may then generate a set of data voltages 664 to compensate for the voltage differences, which may be applied to each pixel by one or more column drivers 666.

Additionally, temperature and/or brightness changes may enable global ELVSS power supply 668 adjustment, followed by gamma point sensing. As illustrated, the current and voltage sensing system 640 may be applied to different types of pixels, such as pixel 658. While the illustrated current and voltage sensing system 640 uses the ELVDD power supply to sense current and voltage values, it should be noted that using any suitable alternative or additional power supplies (e.g., ELVSS 662) is contemplated.

When sensing currents across diodes 670 (e.g., LEDs, OLEDs, and the like) in pixels 644, 646 of the active array 62 and/or pixels of the reference array 64, data retention may be inconsistent. In particular, when programming a pixel 644, 646, current may leak from a data voltage-providing gate or metal-oxide-semiconductor 672, which in turn may cause voltage leakage or drop in a storage capacitor 674. This may cause different amounts or averages of current across the diode 670 during operation of the pixel 644, 646 (e.g., when sensing current across a diode of the reference array 64, sensing current across the diode 670 of the pixel 644, 646 of the active array 64, and displaying image data using the diode 670 of the pixel 644, 646 of the active array 64), resulting in inconsistent data retention and thus affecting accurate current sensing of the pixel 644, 646 (e.g., across the diode 670).

Additionally, because of the close proximity of pixels (e.g., in the active array 62 and/or the reference array 64), attempting to sense or determine current in the pixel (or across the diode of the pixel) may include sensing or receiving current that leaks from one pixel to another (e.g., lateral leakage current). Moreover, bias currents may also be a source of error when sensing or determining current in the pixel.

1. Maintaining Data Retention

To maintain data retention, a data voltage-providing gate or metal-oxide-semiconductor of each pixel of the reference array 64 may provide a data voltage while performing a sensing operation. Similarly, the data voltage-providing gate or metal-oxide-semiconductor (e.g., 672) of each pixel of the active array 62 may provide a data voltage while performing a sensing operation. The average current in pixels of the respective arrays may be similar. The difference between the average current in the pixels of the respective arrays may be determined, and be applied to normal operation (e.g., displaying image data) of the active array 62. In particular, the difference between the average current in the pixels of the respective arrays may be captured by optical calibration (e.g., by a manufacturer, in a factory manufacturing the display 18, or the like). The optical calibration may capture the difference between driving a pixel (e.g., of the active array 62) constantly and driving the pixel by sampling and holding (e.g., driving for a target time, such as 2 milliseconds, and allowing current from the pixel to leak).

Figure 35:
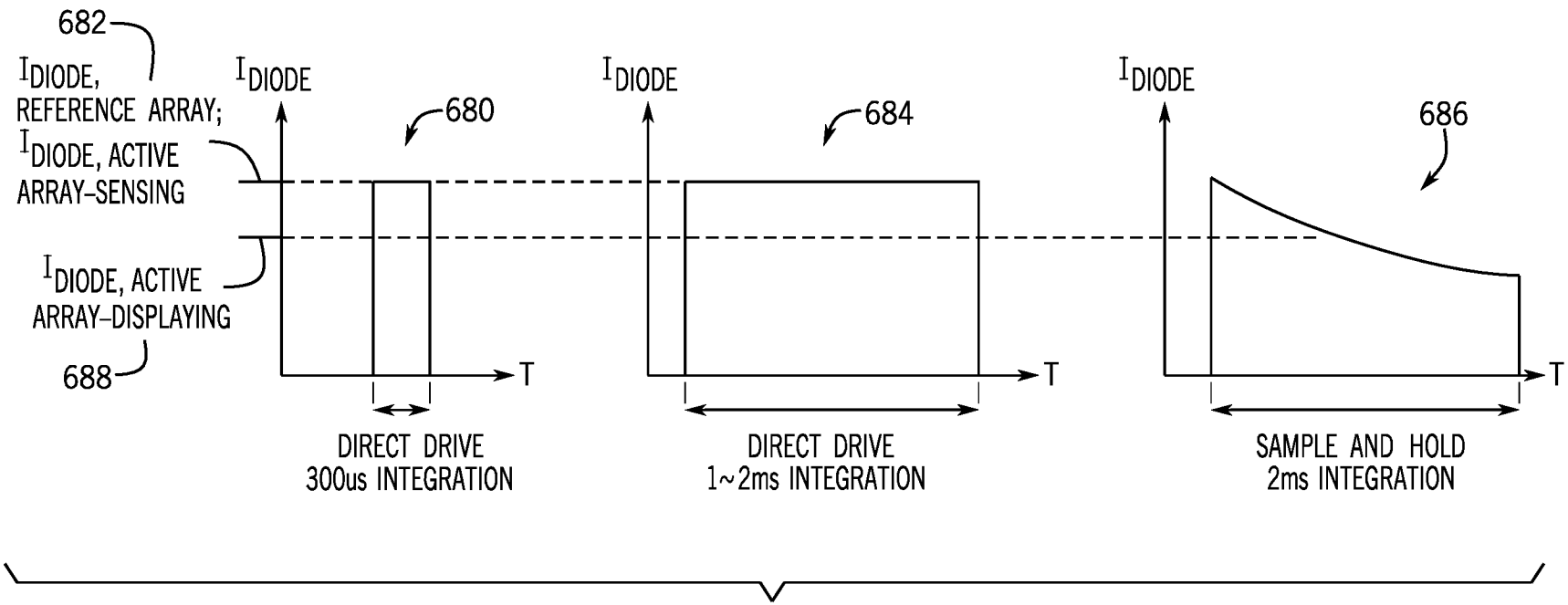
FIG. 35 is a set of timing diagrams for mitigating data retention to more accurately sense current in pixels the display of FIG. 7, according to an embodiment of the present disclosure.

FIG. 35 is a set of timing diagrams for mitigating data retention to more accurately sense current in pixels the display 18 of FIG. 7, according to an embodiment of the present disclosure. A first timing diagram 680 illustrates directly driving (e.g., maintaining) a data voltage at the gate of a pixel of the reference array 64 for approximately 300 microseconds, and thus providing a first current 682 across a diode of the pixel. A second timing diagram 684 illustrates directly driving (e.g., maintaining) a data voltage (e.g., while performing a sensing operation) at the gate of a pixel of the active array 62 for approximately 1 to 2 milliseconds, and thus providing the first current 682 across a diode of the pixel. A third timing diagram 686 illustrates sampling and holding a data voltage (e.g., while performing a normal display operation) at the gate of a pixel of the active array 62 for approximately 2 milliseconds and allowing current from the pixel to leak, and thus providing a second average current 688 across the diode of the pixel.

Figure 36:
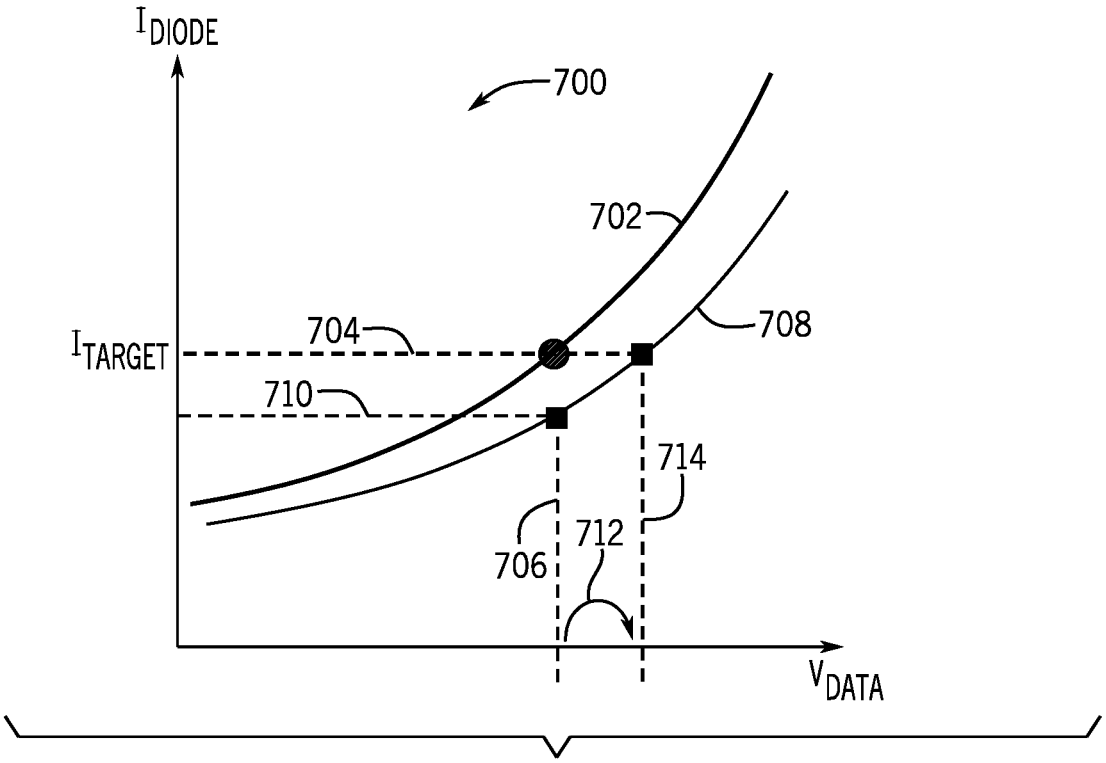
FIG. 36 is a graph illustrating mitigating data retention to more accurately sense current in pixels the display of FIG. 7 before compensation has been performed, according to an embodiment of the present disclosure.

FIG. 36 is a graph illustrating mitigating data retention to more accurately sense current in pixels the display 18 of FIG. 7 before compensation has been performed, according to an embodiment of the present disclosure. A first current-voltage curve 702 illustrates directly driving a data voltage $V_{Data}$ at the gate of a pixel of the reference array 64 at an initial time T0 of operation of the display 18. In particular, the first current-voltage curve 702 indicates providing a target current $I_{target}$ 704 at a first data voltage 706. A second current-voltage curve 708 illustrates sampling and holding a data voltage (e.g., while performing a normal display operation) at the gate of a pixel of the active array 62. The second current-voltage curve 708 indicates providing a current 710 less than the target current $I_{target}$ 704 at the first data voltage 706 before the optical calibration 712, and providing the target current $I_{target}$ 704 at a second data voltage 714 after the optical calibration 712.

Figure 37:
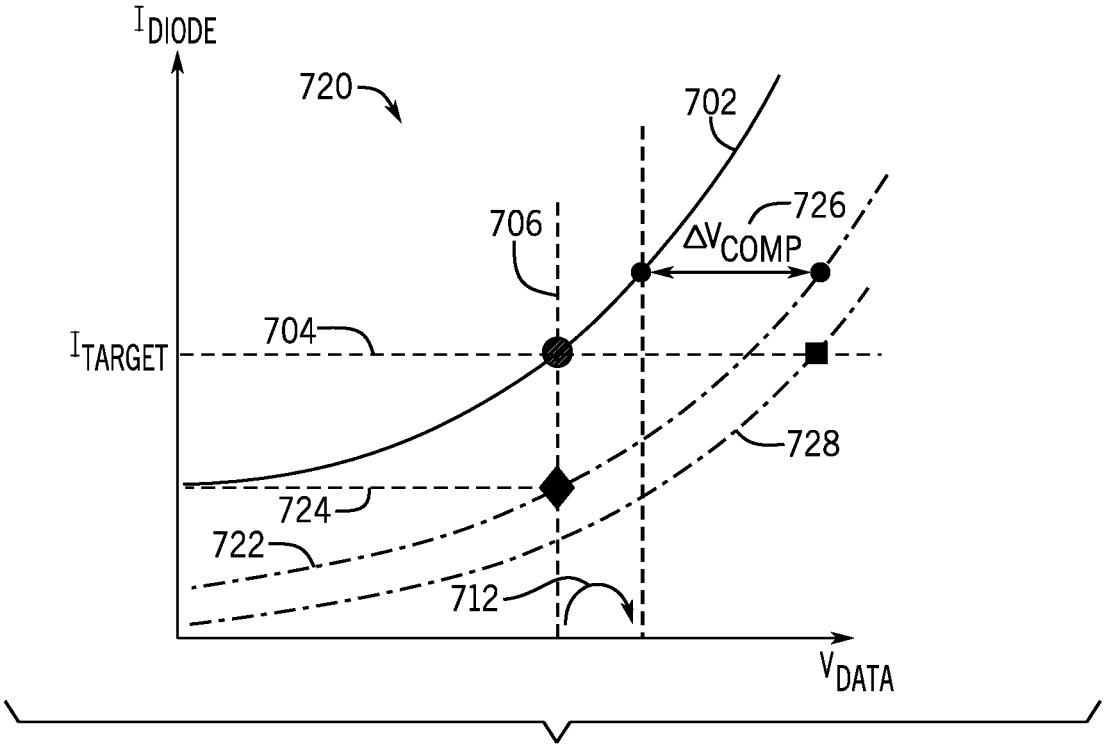
FIG. 37 is a graph illustrating mitigating data retention to more accurately sense current in pixels the display of FIG. 7 after compensation has been performed, according to an embodiment of the present disclosure.

FIG. 37 is a graph illustrating mitigating data retention to more accurately sense current in pixels the display 18 of FIG. 7 after compensation has been performed, according to an embodiment of the present disclosure. The first current-voltage curve 702 illustrates directly driving the data voltage $V_{Data}$ at the gate of a pixel of the reference array 64 at an initial time T0 of operation of the display 18. In particular, the first current-voltage curve 702 indicates providing a target current $I_{target}$ 704 at the first data voltage 706. A second current-voltage curve 722 illustrates directly driving a data voltage $V_{Data}$ at the gate of a pixel of the active array 62 during off-time sensing of current and voltage. The second current-voltage curve 722 indicates providing a current 724 less than the target current $I_{target}$ 704 at the first data voltage 706, and a difference in compensated data voltage 726 between the first current-voltage curve 702 and the second current-voltage curve 722 after calibration 712. A third current-voltage curve 728 illustrates sampling and holding a data voltage (e.g., while performing a normal display operation) at the gate of a pixel of the active array 62 after compensation and calibration. That is, the third current-voltage curve 728 is generated based at least in part on sensing current-voltage characteristics and compensating for voltage degradation, in addition to calibrating by capturing the difference between driving a pixel of the active array 62 constantly and driving the pixel by sampling and holding. As a result, the third current-voltage curve 728 indicates providing the target current $I_{target}$ 704 at a second data voltage 730.

2. Mitigating Lateral Leakage and/or Bias Current

Figure 38:
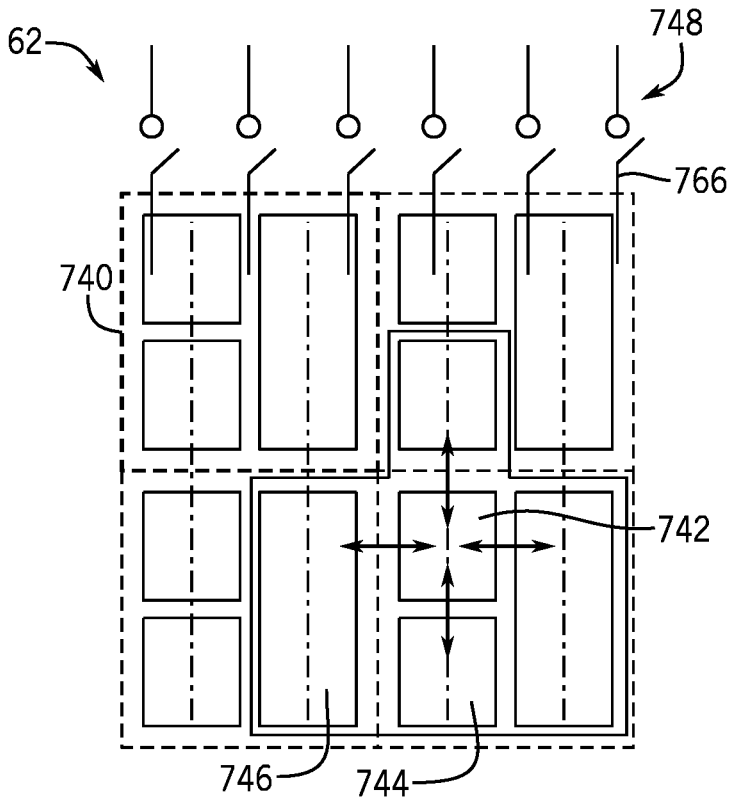
FIG. 38 is a diagram of pixels of the display of FIG. 7, according to an embodiment of the present disclosure.

Because of the close proximity of pixels and sub-pixels (e.g., in the active array 62 and/or the reference array 64), attempting to sense or determine current in the pixel or sub-pixel (or across a diode of the pixel or sub-pixel) may include sensing or receiving current that leaks from one pixel or sub-pixel to another (e.g., lateral leakage current). FIG. 38 is a diagram of pixels 740 of the display 18 of FIG. 7, according to an embodiment of the present disclosure. The pixels 740 may be included in either the active array 62 or the reference array 64. The pixels 740 may include sub-pixels, such as a red sub-pixel 742, a green sub-pixel 744, a blue sub-pixel 746, and the like. It should be noted that references to pixels (e.g., 740) in the present disclosure may equally apply to sub-pixels (e.g., 742, 744, 746), and vice versa.

When sensing current in a pixel or sub-pixel, surrounding pixels or sub-pixels may be turned off or programmed to zero. For example, when sensing current in the red sub-pixel 742, surrounding sub-pixels 744, 746 may be turned off. If the lateral leakage current from the red sub-pixel 742 is not mitigated or decreased, a voltage difference may result between an anode of the red sub-pixel 742 and anodes of the surrounding sub-pixels 744, 746. Because there may be a finite impedance between the red sub-pixel 742 and the surrounding sub-pixels 744, 746, there may be a leakage current from the anode the red sub-pixel 742 and the anodes of the surrounding sub-pixels 744, 746. Because current may be sensed from a "top" side 748 (e.g., from a top located power supply, such as an ELVDD power supply coupled to a drain of the TFT of the sub-pixel 742), the resulting sensed current may not only include the current across the diode of the sub-pixel 742, but also the leakage current.

Figure 39:
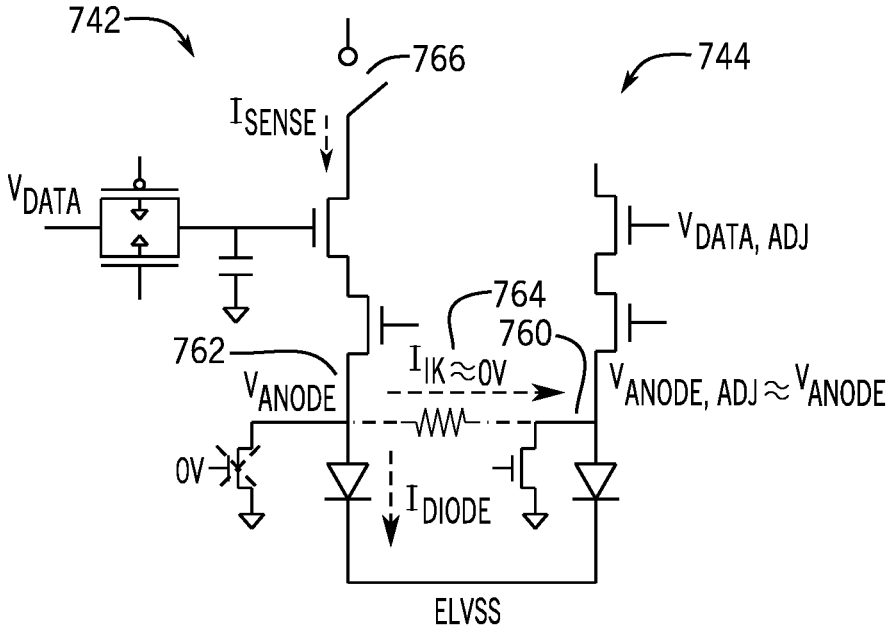
FIG. 39 is a circuit diagram demonstrating a first technique to mitigate leakage current from a sub-pixel to an adjacent sub-pixel of the display of FIG. 7, according to an embodiment of the present disclosure.

FIG. 39 is a circuit diagram demonstrating a first technique to mitigate leakage current from the sub-pixel 742 to an adjacent sub-pixel (e.g., 744) of the display 18 of FIG. 7, according to an embodiment of the present disclosure. Instead of turning off or programming to zero the adjacent sub-pixels (e.g., 744), the digital-to-analog converter 572 may drive the adjacent sub-pixels such that voltage (e.g., $V_{anode,\ adj}$) of the anodes 760 of the adjacent sub-pixels may approximately match voltage (e.g., $V_{anode}$) of the anode 762 of the sub-pixel 742. In some embodiments, the digital-to-analog converter 572 may drive the current in the adjacent sub-pixels such that the resulting voltage (e.g., $V_{anode,\ adj}$) of the anodes 760 of the adjacent sub-pixels may approximately match voltage (e.g., $V_{anode}$) of the anode 762 of the sub-pixel 742. This may result in having the same potential between the sub-pixel 742 and the adjacent sub-pixel 744, decreasing, minimizing, and/or mitigating current leakage 764 from the sub-pixel 742 to the adjacent sub-pixel 744. In some embodiments, to control the voltage or current of the $V_{anode,\ adj}$ of the anodes 760 of the adjacent sub-pixels, each column of pixels or sub-pixels may include dedicated power supply (e.g., coupled to the ELVDD power supply 748) lines 766.

Figure 40:
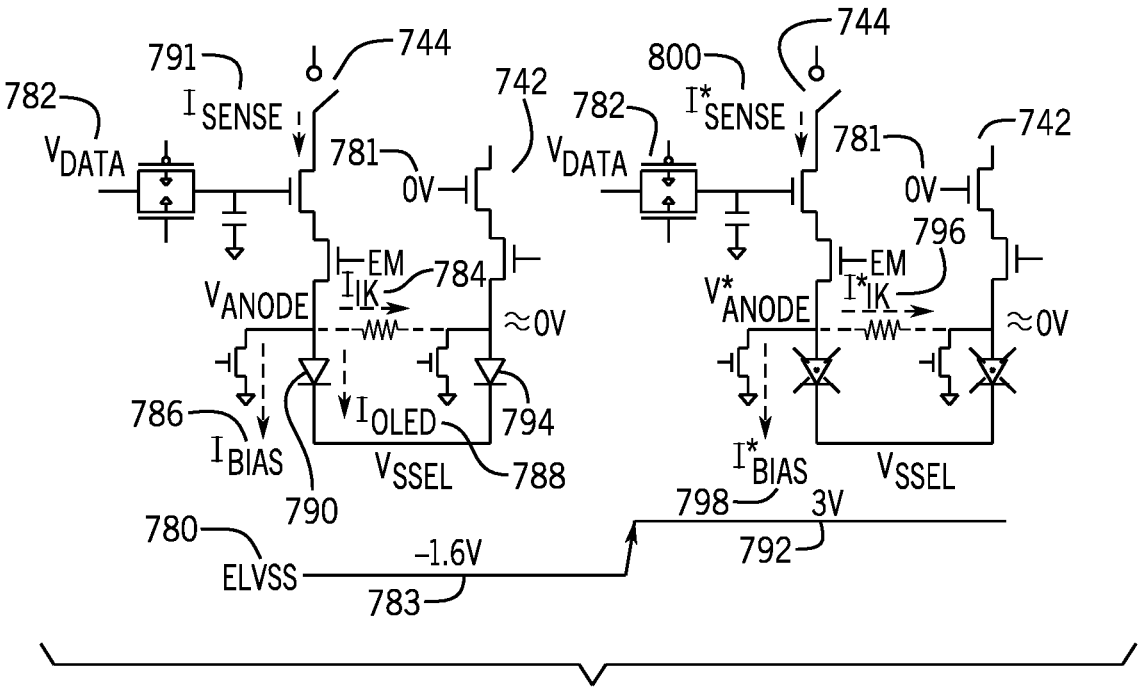
FIG. 40 is a circuit diagram demonstrating a second technique to account for leakage and bias currents flowing from a sub-pixel to an adjacent sub-pixel of the display 18 of FIG. 7, according to an embodiment of the present disclosure.

FIG. 40 is a circuit diagram demonstrating a second technique to account for leakage and bias currents flowing from the sub-pixel 742 to an adjacent sub-pixel (e.g., 744) of the display 18 of FIG. 7, according to an embodiment of the present disclosure. The second technique is similar to the technique described with respect to the pixel of the reference array 64 in FIG. 26. As illustrated, a data voltage of 0 V 781 may be applied to the adjacent sub-pixel 744, while a data voltage of $V_{Data}$ 782 may be applied to the sub-pixel 742. An ELVSS power supply 780 may first provide an operating supply voltage 783 (e.g., approximately −1.6 V (Volts)) to the two sub-pixels 742, 744. Providing the operating supply voltage 783 may result in an operating leakage current $I_{lk}$ 784, an operating bias current $I_{bias}$ 786, and an operating diode current $I_{diode}$ 788 across a diode 790 of the sub-pixel 744. As such, sensing the current (e.g., $I_{sense}$ 790) may result in a sum current of the three currents (e.g., $I_{sense}=I_{lk}+I_{bias}+I_{diode}$).

The ELVSS power supply 780 may then provide an increased voltage 792 (e.g., approximately 3 V) to the two sub-pixels 742, 744, such that the diodes 790, 794 of the sub-pixels 744, 742 are reverse biased and current is stopped from flowing across the diodes 790, 794, resulting in a leakage current $I^*_{lk}$ 796 and a bias current $I^*_{bias}$ 798. As such, sensing the current (e.g., $I^*_{sense}$ 800) may result in a sum current of the two currents ($I^*_{sense}=I^*_{lk}+I^*_{bias}$). In this manner, subtracting $I^*_{sense}$ 800 from $I_{sense}$ 790 may result in a more accurate value for $I_{diode}$ (e.g., $I_{diode}=I_{sense}-I^*_{sense}$). The increased voltage 792 may be based at least in part on temperature and generated by control circuitry of the reference array 64. For example, the reference array control circuitry may generate the increased voltage 792 such that a maximum voltage applied to a pixel of the reference array 64, given the increased voltage 792, may achieve a target luminance. It should be noted that the second technique of FIG. 40 may double sensing or sampling time in the sub-pixels 742, 744. In some embodiments, the ELVSS power supply 780 may instead provide an increased current to the two sub-pixels 742, 744, such that the diodes 790, 794 of the sub-pixels 744, 742 are reverse biased and current is stopped from flowing across the diodes 790, 794, resulting in the leakage current $I^*_{lk}$ 796 and the bias current $I^*_{bias}$ 798. As with the increase voltage 792 above, sensing the current (e.g., $I^*_{sense}$ 800) may result in the sum current of the two currents ($I^*_{sense}=I^*_{lk}+I^*_{bias}$). In this manner, subtracting $I^*_{sense}$ 800 from $I_{sense}$ 790 may result in a more accurate value for $I_{diode}$ (e.g., $I_{diode}=I_{sense}-I^*_{sense}$). The increased current may be based at least in part on temperature and generated by control circuitry of the reference array 64.

Figure 41:
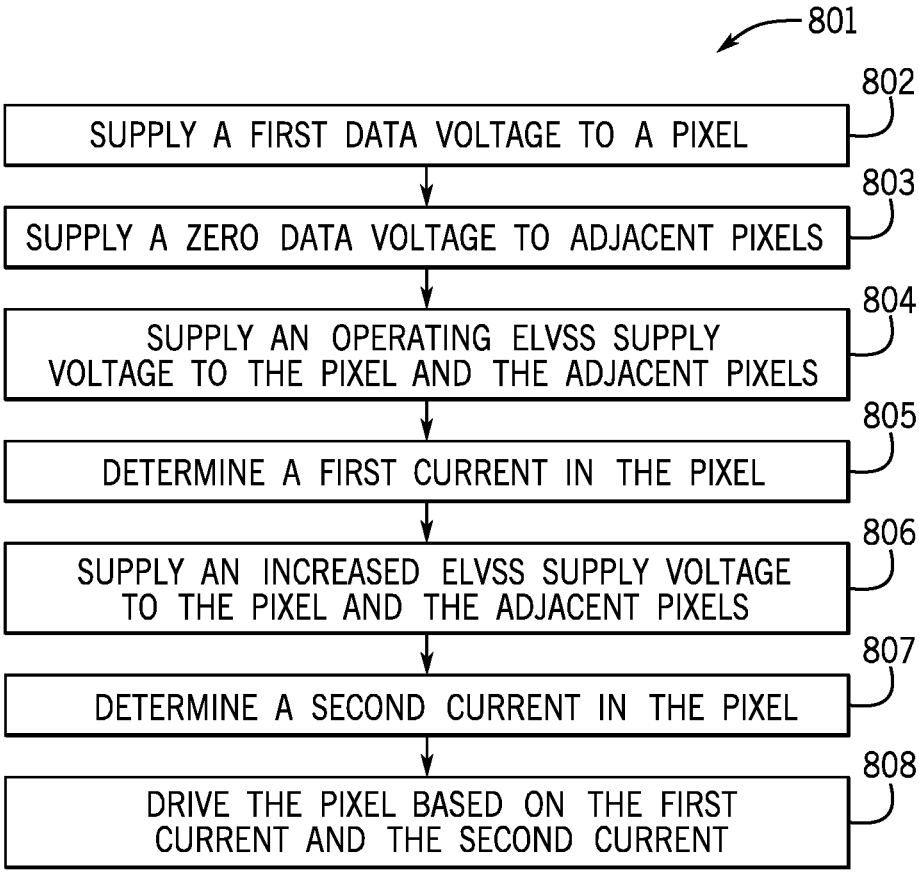
FIG. 41 is a flow diagram of a method to account for leakage and bias currents flowing from a pixel to adjacent pixels of the display of FIG. 7, according to an embodiment of the present disclosure.

FIG. 41 is a flow diagram of a method 801 to account for leakage and bias currents flowing from a pixel to adjacent pixels of the display 18 of FIG. 7, according to an embodiment of the present disclosure. The method 801 may be performed by any suitable device or combination of devices that may supply voltage to pixels, supply an ELVSS voltage level or current level to the pixels (e.g., via an ELVSS power supply coupled to sources of thin film transistors of the pixels), determines currents in the pixels, and drives the pixels. While the method 801 is described using steps in a specific sequence, it should be understood that the present disclosure contemplates that the described steps may be performed in different sequences than the sequence illustrated, and certain described steps may be skipped or not performed altogether. In some embodiments, at least some of the steps of the method 801 may be performed by the processor core complex 12, as described below. However, it should be understood that any suitable device or combination of devices is contemplated to perform the method 801, such as the digital-to-analog converter 572 of FIG. 31, the sensing circuitry 576, the ELVSS power supply 780, the display 18, and the like.

The processor core complex 12 supplies (process block 802) a first data voltage to a pixel. For example, as shown in FIG. 40, the processor core complex 12 may instruct the digital-to-analog converter 572 to supply data voltage $V_{Data}$ 782 to the pixel 744. The processor core complex 12 also supplies (process block 803) a zero data voltage to adjacent pixels (e.g. pixels adjacent to the pixel). For example, as shown in FIG. 40, the processor core complex 12 may instruct the digital-to-analog converter 572 to supply 0 V 781 to the adjacent pixel 742.

The processor core complex 12 supplies (process block 804) an operating ELVSS supply voltage or current to the pixel and the adjacent pixels. For example, as shown in FIG. 40, the processor core complex 12 may instruct the ELVSS power supply 780 to provide an operating supply voltage 783 (e.g., approximately −1.6 V (Volts)) or current to the two pixels 742, 744.

The processor core complex 12 then determines (process block 805) a first current in the pixel. For example, as shown in FIG. 40, the processor core complex 12 may instruct the sensing circuitry 576 to determine the first current, which may include the operating leakage current $I_{lk}$ 784, the operating bias current $I_{bias}$ 786, and the operating diode current $I_{diode}$ 788 across the diode 790 of the pixel 744. As such, the sensing circuitry 576 may determine the first current (e.g., $I_{sense}$ 790) in the pixel 744 as a sum current of the three currents (e.g., $I_{sense}=I_{lk}+I_{bias}+I_{diode}$).

The processor core complex 12 supplies (process block 806) an increased ELVSS supply voltage or current to the pixel and the adjacent pixels. For example, as shown in FIG. 40, the processor core complex 12 may instruct the ELVSS power supply 780 to provide an increased ELVSS supply voltage 792 (e.g., approximately 3 V) to the two pixels 742, 744. The increased ELVSS supply voltage 792 may cause the diodes 790, 794 of the pixels 744, 742 to reverse bias, thus causing current to stop flowing across the diodes 790, 794. In some embodiments, the ELVSS power supply 780 may provide an increased current to the two pixels 742, 744, causing the diodes 790, 794 of the pixels 744, 742 to reverse bias, in turn causing current to stop flowing across the diodes 790, 794.

The processor core complex 12 then determines (process block 807) a second current in the pixel. For example, as shown in FIG. 40, the processor core complex 12 may instruct the sensing circuitry 576 to determine the second current, which may include the leakage current $I^*_{lk}$ 796 and the bias current $I^*_{bias}$ 798. As such, the sensing circuitry 576 may determine the second current (e.g., $I^*_{sense}$ 800) in the pixel 742 as a sum current of the two currents ($I^*_{sense}=I^*_{lk}+I^*_{bias}$).

The processor core complex 12 then drives (process block 808) the pixel 742 based at least in part on the first current and the second current. For example, the processor core complex 12 may instruct the digital-to-analog converter 572 to drive the pixel 742 based at least in part on the first current and the second current. In particular, subtracting $I^*_{sense}$ 800 from $I_{sense}$ 790 may result in a more accurate value for current across the diode, $I_{diode}$ (e.g., $I_{diode}=I_{sense}-I^*_{sense}$). The processor core complex 12 may store the current across the diode for the data voltage $V_{Data}$, the currents sensed across the diode for other data voltages, and the respective data voltages, in the buffer 580. After a certain amount of time (e.g., approximately two weeks), these current and voltage values may be sent from the buffer 580 to the look-up tables 582. The voltage comparator circuit 584 may generate a current-voltage curve for the pixel 744 based at least in part on the current and voltage values, and compare the current-voltage curve to another current-voltage curve generated by the reference array control circuitry. The voltage comparator circuit 584 may generate a set of voltage differences based at least in part on the comparison, and the current-voltage compensation circuit 586 may instruct the digital-analog converter 572 to drive the pixel 744 based at least in part on the set of voltage differences (to compensate for the set of voltage differences).

In some embodiments, the current step limiter circuitry 72 of the active array control circuitry 85 may limit current compensation values corresponding to the set of voltage differences. In particular, the current step limiter circuitry 72 may be used to limit the current compensation values that correspond to the set of voltage differences below a visibility threshold. The visibility threshold may correspond to a current value change that a viewer of the display 18 may not perceive when applied to driving the pixel 744 (as compared to driving the pixel 744 prior to applying the current compensation values). In this manner, the viewer may not notice the applied compensation, improving the overall viewing experience of the display 18.

Figure 42:
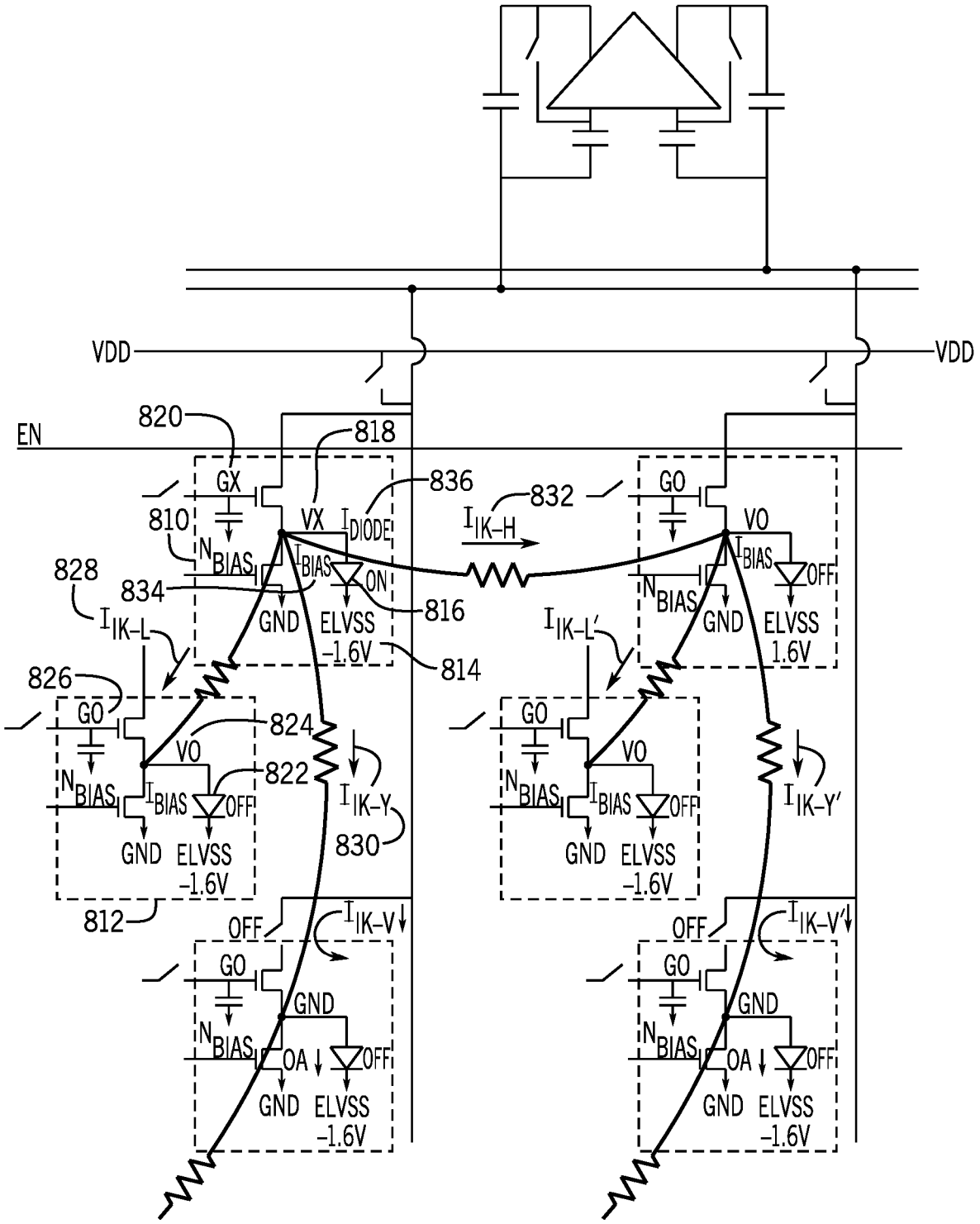
FIG. 42 is a circuit diagram illustrating determining a sum of leakage currents, a bias current, and a diode current of a pixel of the display of FIG. 7, according to an embodiment of the present disclosure.
Figure 43:
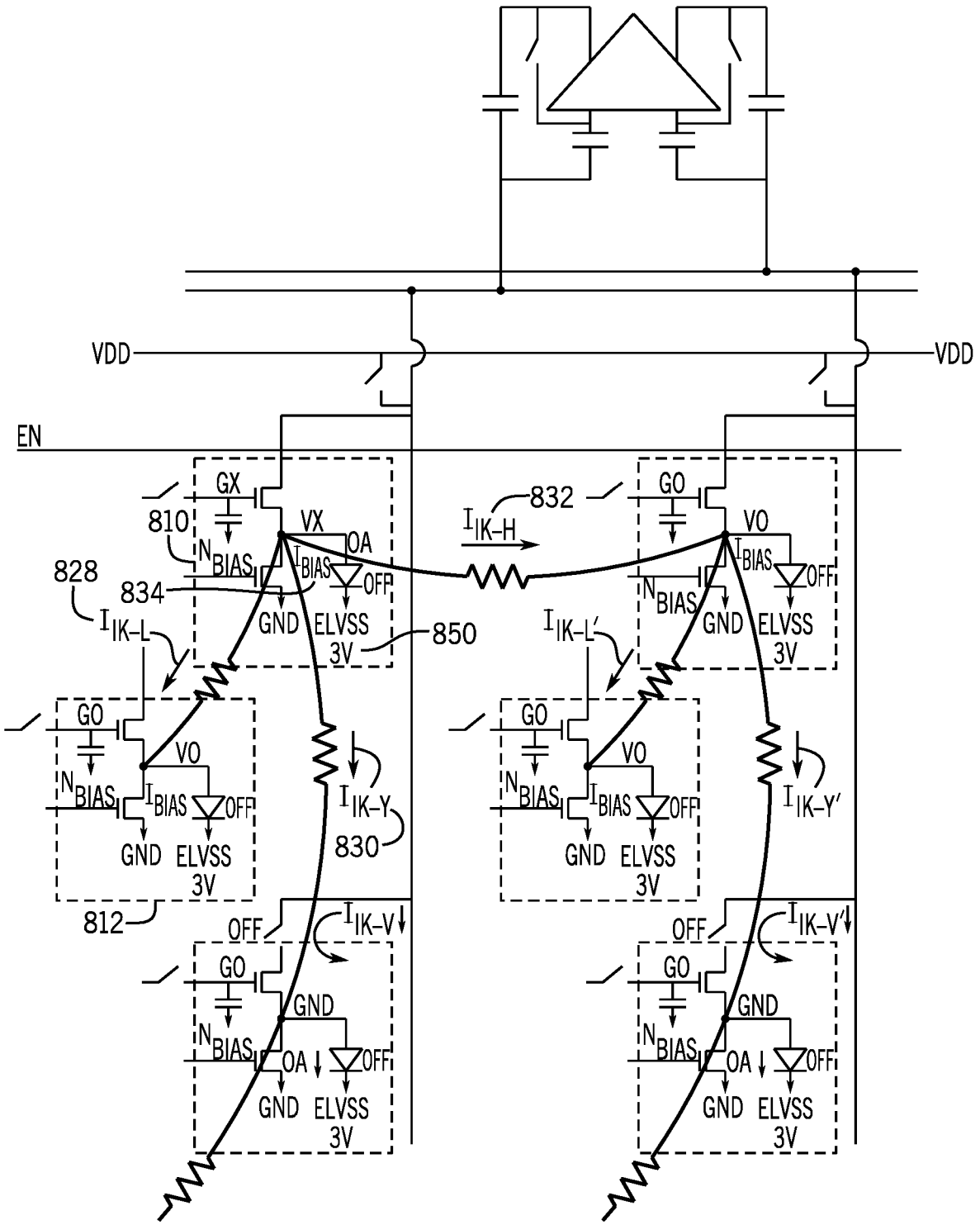
FIG. 43 is a circuit diagram illustrating determining a sum of leakage currents and a bias current of a pixel of the display of FIG. 7, according to an embodiment of the present disclosure.

FIGS. 42 and 43 are circuit diagrams further demonstrating the second technique to account for leakage and bias currents flowing from a pixel 810 to multiple adjacent pixels 812, according to an embodiment of the present disclosure. FIG. 42 is a circuit diagram illustrating determining a sum of leakage currents, a bias current, and a diode current of the pixel 810 of the display 18 of FIG. 7, according to an embodiment of the present disclosure. In particular, the ELVSS power supply provides an operating supply voltage 814 (e.g., approximately −1.6 V) or current to the pixel 810 and the adjacent pixels 812. As illustrated, a diode 816 of the pixel 810 may be supplied with a data voltage of VX 818 that causes the diode 816 to emit a gray level of GX 820. Diodes 822 of the adjacent pixel 812 may be supplied with a data voltage of V0 824 that causes the diodes 822 to emit a gray level of G0 826. This may generate leakage currents $I_{lk-L}$ 828, $I_{lk-Y}$ 830, and $I_{lk-H}$ 832, a bias current $I_{bias}$ 834, and a diode current $I_{diode}$ 836. As such, sensing the current (e.g., $I_{sense}$) in the pixel 810 may result in a sum current of the three types of currents (e.g., $I_{sense}=I_{lk-Y}+I_{lk-H}+I_{bias}+I_{diode}$).

FIG. 43 is a circuit diagram illustrating determining a sum of leakage currents and a bias current of the pixel 810 of the display 18 of FIG. 7, according to an embodiment of the present disclosure. In particular, the ELVSS power supply may provide an increased voltage 850 (e.g., approximately 3 V) or current to the pixel 810 and the adjacent pixels 812, such that the diodes 816, 822 of the pixel 810 and the adjacent pixels 812, respectively, are reverse biased and current is stopped from flowing across the diodes 816, 822, generating the leakage currents $I_{lk-L}$ 828, $I_{lk-Y}$ 830, and $I_{lk-H}$ 832, and the bias current $I_{bias}$ 834. As such, sensing the current (e.g., $I^*_{sense}$) may result in a sum current of the two types of currents ($I^*_{sense}=I_{lk-L}+I_{lk-Y}+I_{lk-H}+I_{bias}$). In this manner, subtracting $I^*_{sense}$ from $I_{sense}$ (from FIG. 42) may result in a more accurate value for $I_{diode}$ (e.g., $I_{diode}=I_{sense}-I^*_{sense}$).

Figure 44:
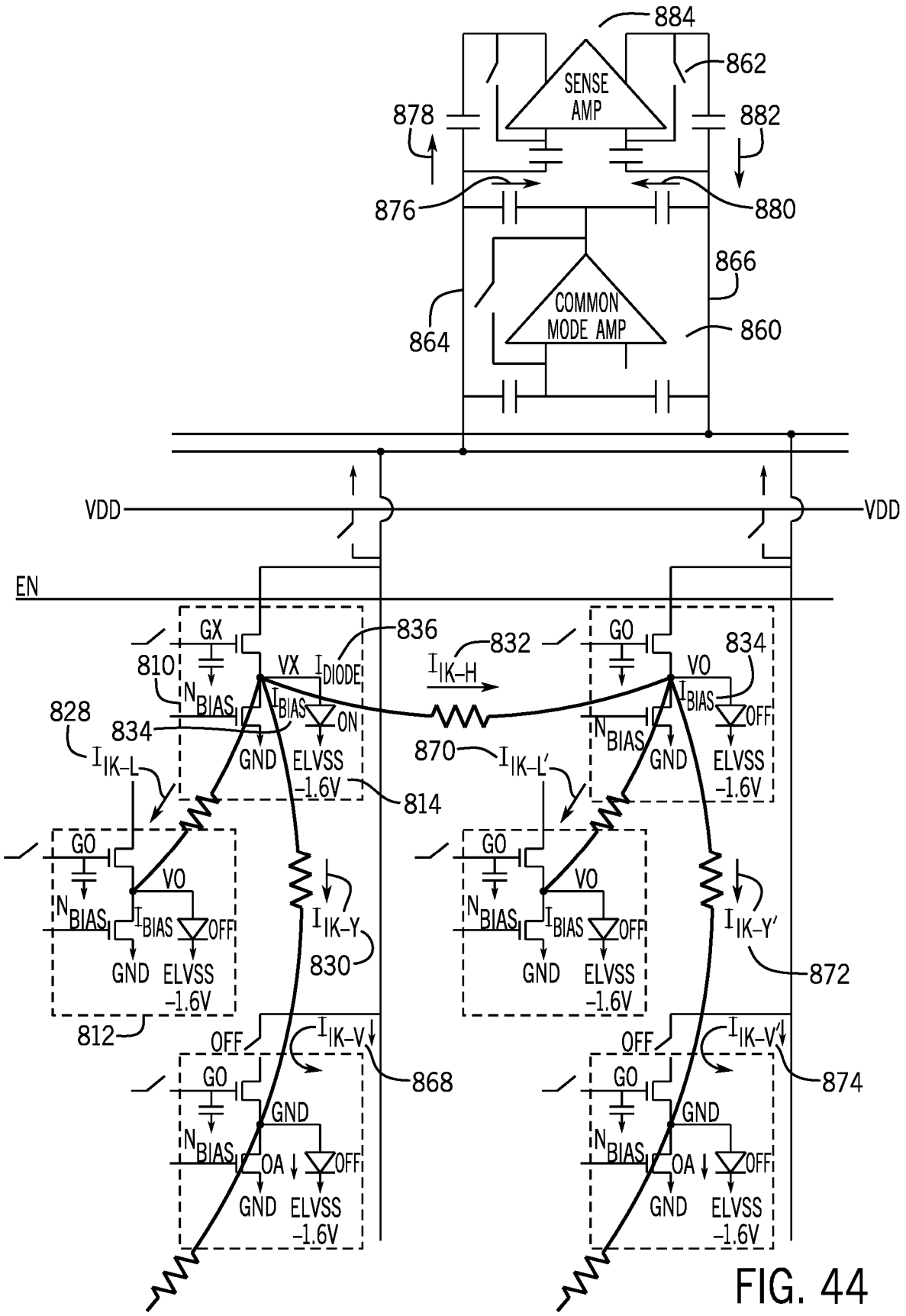
FIG. 44 is a circuit diagram illustrating canceling common mode leaking when operating supply voltage is provided in the display 18 of FIG. 7, according to an embodiment of the present disclosure.
Figure 45:
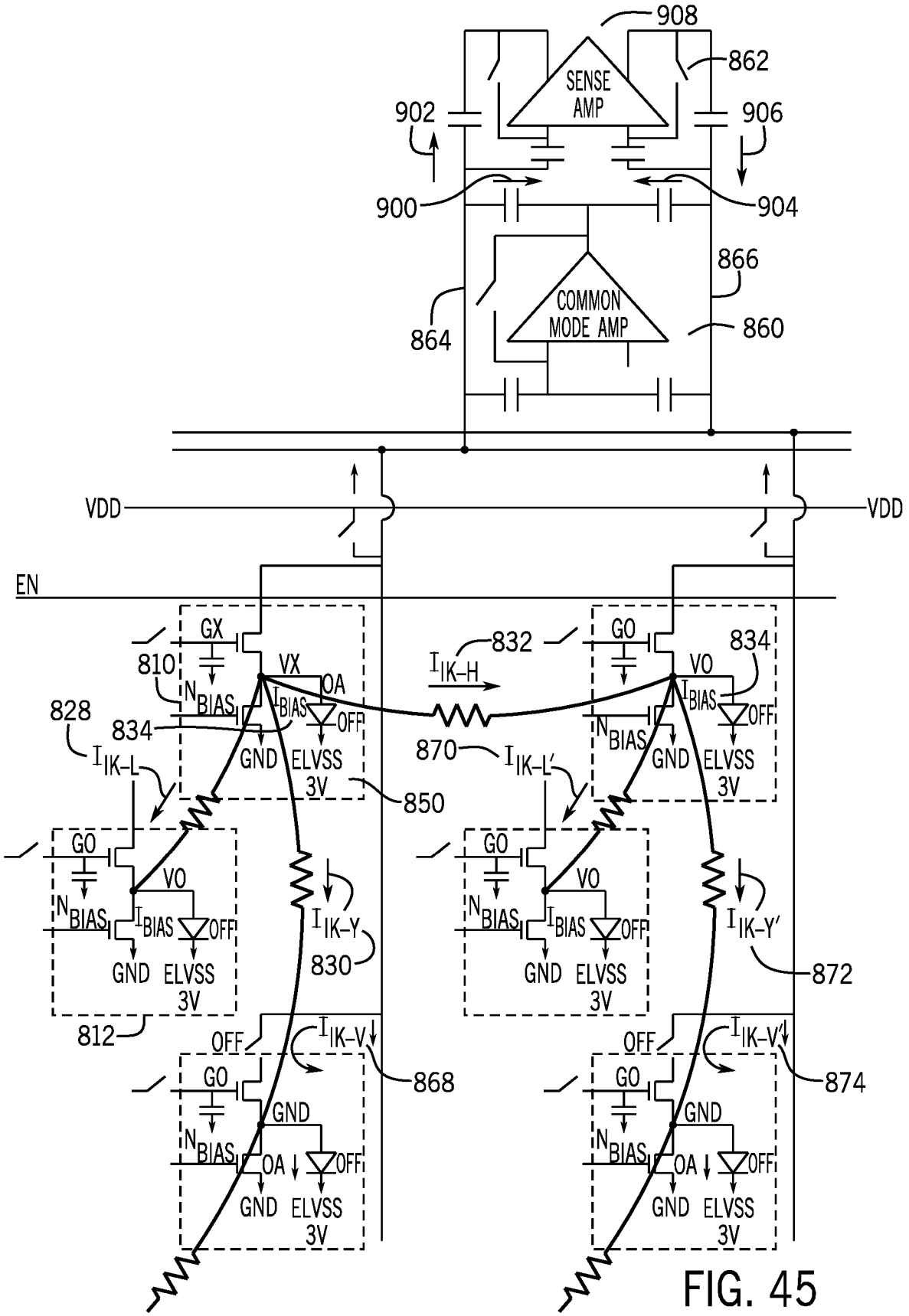
FIG. 45 is a circuit diagram illustrating canceling common mode leaking when increased supply voltage is provided in the display of FIG. 7, according to an embodiment of the present disclosure.

FIGS. 44 and 45 are circuit diagrams demonstrating common mode leakage canceling using the second technique to account for leakage and bias currents flowing from a pixel 810 to multiple adjacent pixels 812, according to an embodiment of the present disclosure. FIG. 44 is a circuit diagram illustrating canceling common mode leaking when the operating supply voltage 814 is provided in the display 18 of FIG. 7, according to an embodiment of the present disclosure. In particular, the ELVSS power supply provides the operating supply voltage 814 (e.g., approximately −1.6 V) to the pixel 810 and the adjacent pixels 812. The pixels 810, 812 may be coupled to a common mode amplifier 860 and a sense amplifier 862 (e.g., a differential sensing amplifier such as the sensing analog front end 66). When performing differential sensing, current in positive and negative branches 864, 866 of the common mode amplifier 860 and the sense amplifier 862 may include large common mode signal in terms of bias current. The common mode amplifier 860 may cancel or absorb the common mode signal so that a remaining differential signal may be received at the sense amplifier 862.

For example, the current in the positive branch 864 may include respective leakage currents $I_{lk-L}$ 828, $I_{lk-Y}$ 830, $I_{lk-H}$ 832, and $I_{lk-V}$ 868, the bias current $I_{bias}$ 834, and the diode current $I_{diode}$ 836 (e.g., $I_{lk-L}+I_{lk-Y}+I_{lk-H}+I_{lk-V}+I_{bias}+I_{diode}$). The current in the negative branch 866 may include respective leakage currents $I_{lk-L'}$ 870, $I_{lk-Y'}$ 872, $I_{lk-H}$ 832, and $I_{lk-V'}$ 874, and the bias current $I_{bias}$ 834 (e.g., $I_{lk-L'}+I_{lk-Y'}-I_{lk-H}+I_{lk-V}+I_{bias}$). Passing the current in the positive branch 864 through the common mode amplifier 860 may result in canceling the common mode signal 876 (e.g., $I_{lk-L}+I_{lk-Y}+I_{lk-V}+I_{bias}+(I_{diode}+\Delta I_{lk-L}+\Delta I_{lk-Y}+\Delta I_{lk-V})/2)$) in the current in the positive branch 864 so that a remaining differential signal 878 (e.g., $(I_{diode}+\Delta I_{lk-L}+\Delta I_{lk-Y}+\Delta I_{lk-V})/2+I_{lk-H}$) may be received at the sense amplifier 862. Similarly passing the current in the negative branch 866 through the common mode amplifier 860 may result in canceling the common mode signal 880 (e.g., $I_{lk-L}+I_{lk-Y}+I_{lk-V}+I_{bias}+(I_{diode}+\Delta I_{lk-L}+\Delta I_{lk-Y}+\Delta I_{lk-V})/2)$) in the current in the negative branch 866 so that a remaining differential signal 882 (e.g., $(I_{diode}+\Delta I_{lk-L}+\Delta I_{lk-Y}+\Delta I_{lk-V})/2-I_{lk-H}$) may be received at the sense amplifier 862. As a result, the total current 884 received at the sense amplifier 862 via the differential signals 878 and 882 may be $I_{diode}+\Delta I_{lk-L}+\Delta I_{lk-Y}+\Delta I_{lk-V}+2*I_{lk-H}$.

FIG. 45 is a circuit diagram illustrating canceling common mode leaking when the increased supply voltage 850 is provided in the display 18 of FIG. 7, according to an embodiment of the present disclosure. In particular, the ELVSS power supply provides the increased supply voltage 850 (e.g., approximately 3 V) to the pixel 810 and the adjacent pixels 812. The current in the positive branch 864 may include respective leakage currents $I_{lk-L}$ 828, $I_{lk-Y}$ 830, $I_{lk-H}$ 832, and $I_{lk-V}$ 868, and the bias current $I_{bias}$ 834 (e.g., $I_{lk-L}+I_{lk-Y}+I_{lk-H}+I_{lk-V}+I_{bias}$). The current in the negative branch 866 may include respective leakage currents $I_{lk-L'}$ 870, $I_{lk-Y'}$ 872, $I_{lk-H}$ 832, and $I_{lk-V'}$ 874, and the bias current $I_{bias}$ 834 (e.g., $I_{lk-L'}+I_{lk-Y'}-I_{lk-H}+I_{lk-V}+I_{bias}$). Passing the current in the positive branch 864 through the common mode amplifier 860 may result in canceling the common mode signal 900 (e.g., $I_{lk-L}+I_{lk-Y}+I_{lk-V}+I_{bias}+(\Delta I_{lk-L}+\Delta I_{lk-Y}+\Delta I_{lk-V})/2)$) in the current in the positive branch 864 so that a remaining differential signal 902 (e.g., $(\Delta I_{lk-L}+\Delta I_{lk-Y}+\Delta I_{lk-V})/2+I_{lk-H}$) may be received at the sense amplifier 862. Similarly passing the current in the negative branch 866 through the common mode amplifier 860 may result in canceling the common mode signal 904 (e.g., $I_{lk-L}+I_{lk-Y}+I_{lk-V}+I_{bias}+(\Delta I_{lk-L}+\Delta I_{lk-Y}+\Delta I_{lk-V})/2)$) in the current in the negative branch 866 so that a remaining differential signal 906 (e.g., $(\Delta I_{lk-L}+\Delta I_{lk-Y}+\Delta I_{lk-V})/2-I_{lk-H}$) may be received at the sense amplifier 862. As a result, the total current 908 received at the sense amplifier 862 via the differential signals 878 and 882 may be $\Delta I_{lk-L}+\Delta I_{lk-Y}+\Delta I_{lk-V}+2*I_{lk-H}$. As such, the difference between the total current 884 received at the sense amplifier 862 when the operating supply voltage 814 is provided to the pixels 810, 812 and the total current 908 received at the sense amplifier 862 when the increased supply voltage 850 is provided to the pixels 810, 812 may be $I_{Diode}$ (e.g., $I_{diode}+\Delta I_{lk-L}+\Delta I_{lk-Y}+\Delta I_{lk-V}+2*I_{lk-H})-(\Delta I_{lk-L}+\Delta I_{lk-Y}+\Delta I_{lk-V}+2*I_{lk-H})$).

Figure 47:
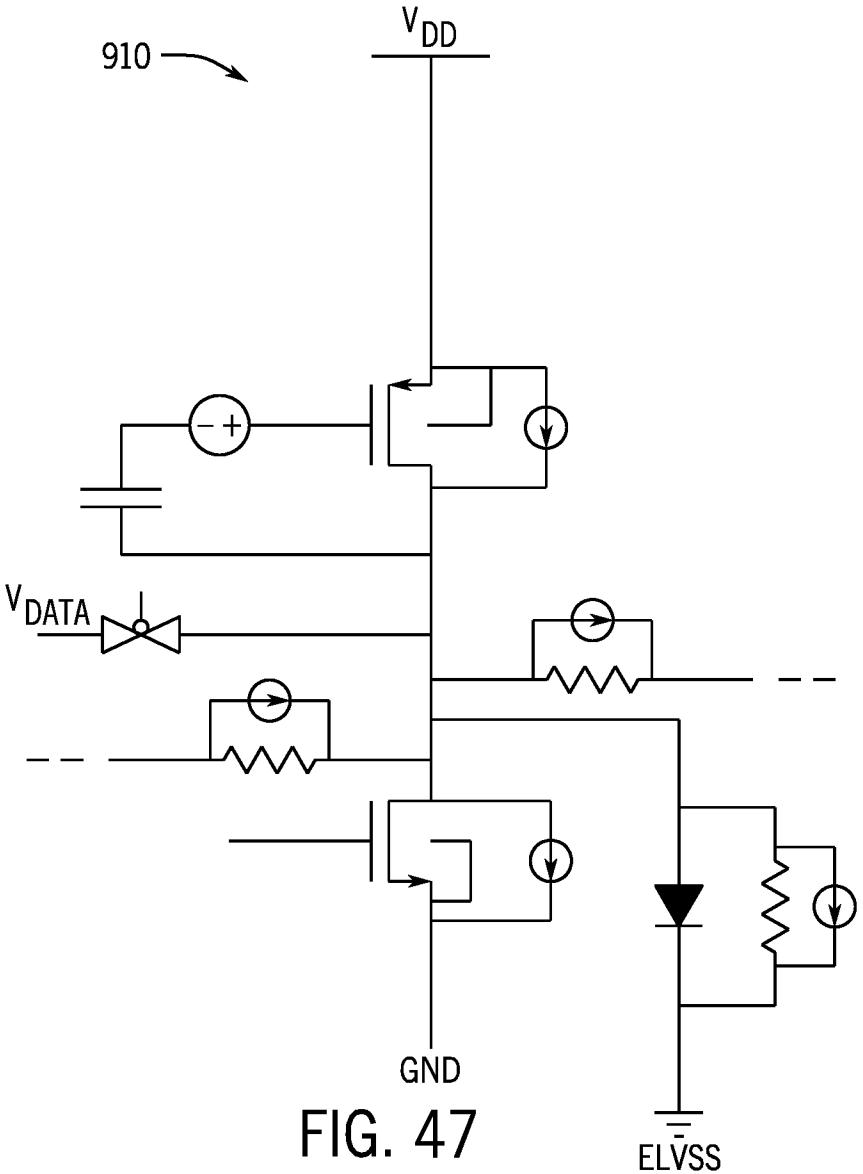
FIG. 47 is a circuit diagram illustrating a Class A-amplifier pixel, according to an embodiment of the present disclosure.
Figure 46:
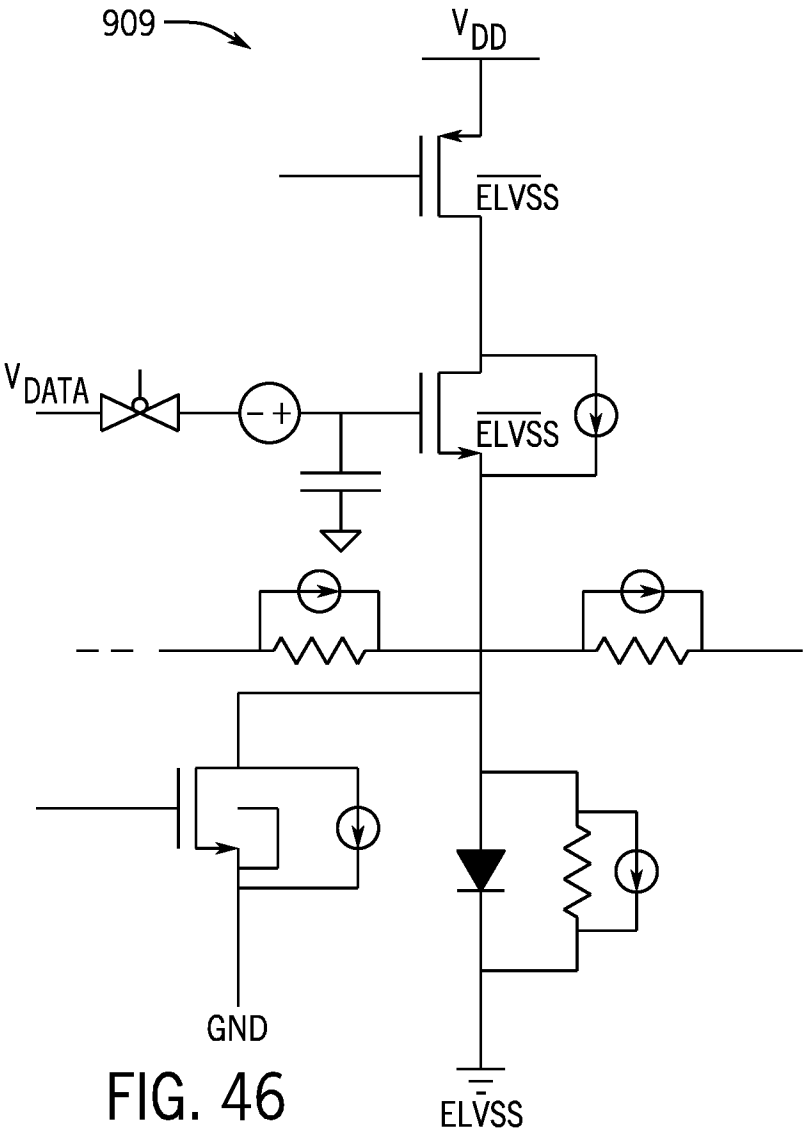
FIG. 46 is a circuit diagram illustrating a source follower pixel, according to an embodiment of the present disclosure.

As illustrated, the pixels 810, 812 in the circuit diagrams of FIGS. 42-45 may be source follower pixels, such as the source follower pixel 909 illustrated in the circuit diagram of FIG. 46, according to an embodiment of the present disclosure. However, the present disclosure may include any suitable type of pixel, such as a Class A-amplifier pixel 910 as illustrated in the circuit diagram of FIG. 47 or a Class AB-amplifier pixel 911 as illustrated in the circuit diagram of FIG. 48, according to embodiments of the present disclosure.

In embodiments in which the pixel includes a topmost current source 912 (on side of the data voltage $V_{Data}$ 913 line) and a bottommost current source 914 (on the other or opposite side of the data voltage $V_{Data}$ 913 line), such as with the Class AB-amplifier pixel 911 (or a Class B-amplifier pixel), the circuit diagrams of FIGS. 42-45 may sense current from the topmost current source 912 but not the bottommost current source 914. This is because the sense amplifier (e.g., 862 of FIG. 44) may be coupled to the topmost current source 912 but not the bottommost current source 914. As such, the sense amplifier 862 may not be able to facilitate compensating for or mitigating noise produced from the bottommost current source 914 as current and noise produced by bottommost current source 914 may not be measured.

Figure 48:
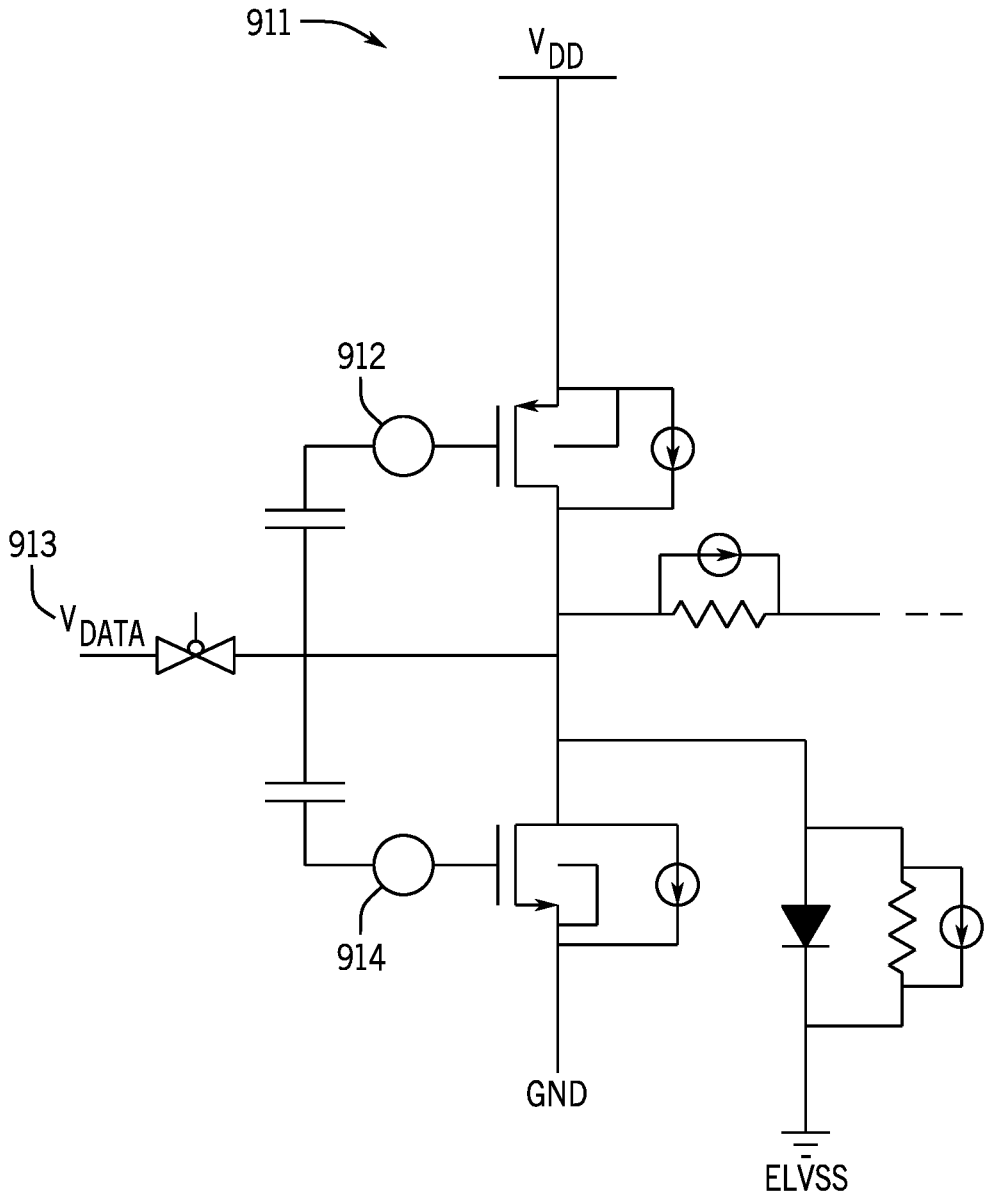
FIG. 48 is a circuit diagram illustrating a Class AB-amplifier pixel, according to an embodiment of the present disclosure.
Figure 49:
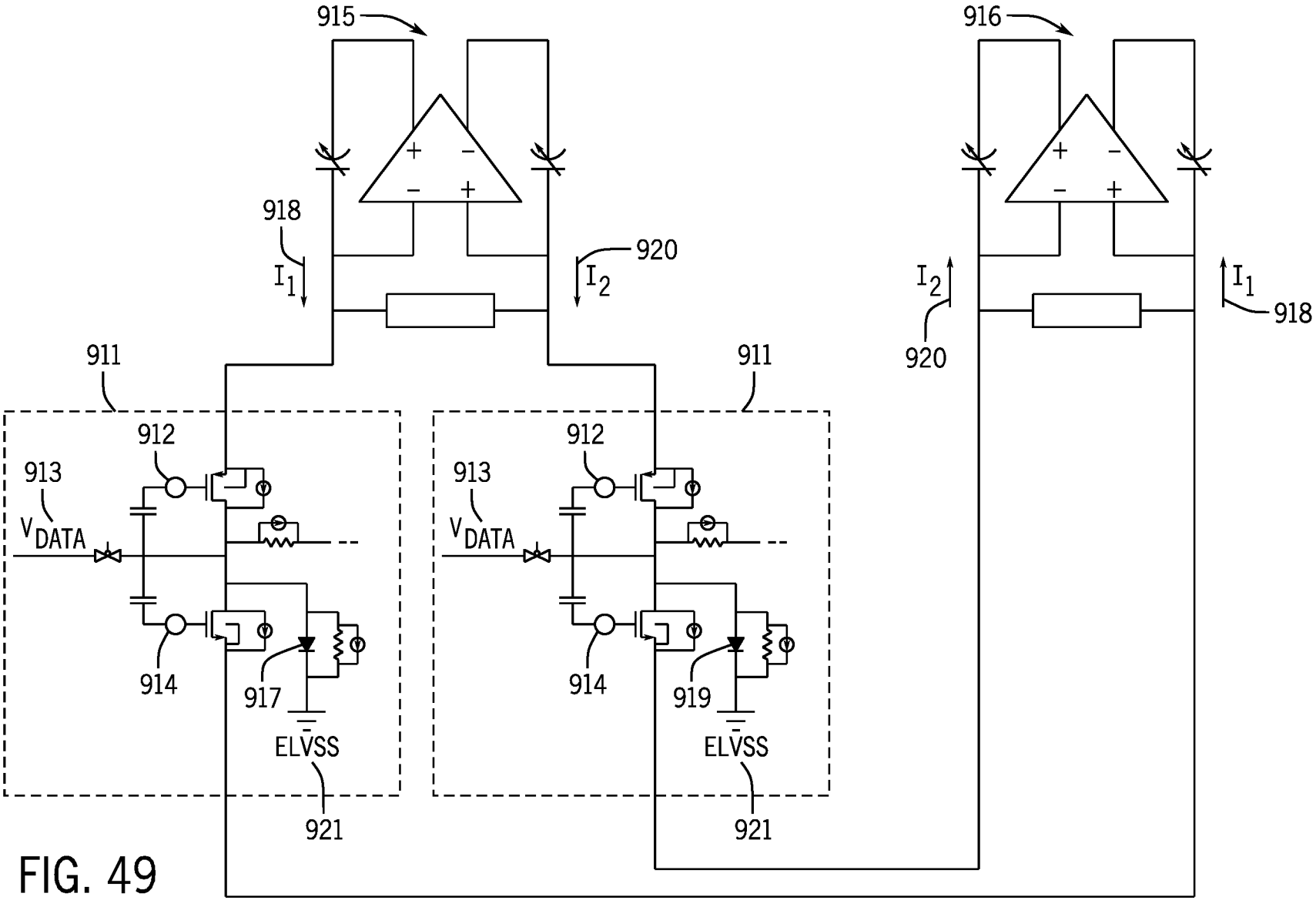
FIG. 49 is a circuit diagram illustrating mitigating noise for the Class AB-amplifier pixel of FIG. 48, according to an embodiment of the present disclosure.

FIG. 49 is a circuit diagram illustrating mitigating noise for the Class AB-amplifier pixel 911 of FIG. 48, according to an embodiment of the present disclosure. As with the circuit diagram of FIG. 44, there is a topmost sense amplifier 915 coupled to the topmost current sources 912 of each of the Class AB-amplifier pixels 911. The circuit diagram of FIG. 49 also includes a bottommost sense amplifier 916 coupled to the bottommost current sources 914 of each of the Class AB-amplifier pixels 911. By sensing from both sides of the data voltage $V_{Data}$ 913 line of each Class AB-amplifier pixel 911, the sense amplifiers 915, 916 may facilitate reducing or mitigating the noise from the current sources 912, 914, as the noise from each Class AB-amplifier pixel 911 may correlate.

For example, a diode 917 of one Class AB-amplifier pixel 911 may be forced off by providing a low (e.g., 0 V) data voltage 913 to the diode 917, such that current across that diode 917 is zero. As such, the current $I_1$ 918 across the respective pixel 911 may include the noise from the respective current source 912, but not the current across the diode 917. A diode 919 of the other Class AB-amplifier pixel 911 may be operative, such that current across that diode 919 is non-zero. As such, the current $I_2$ 920 across the respective pixel 911 may include both the current across the diode 919 as well as the noise from the respective current source 914. Subtracting the current $I_1$ 918 from the current $I_2$ 920 may provide an accurate measurement or estimation of the current across the diode 919. Indeed, in some embodiments, reducing or mitigating noise from the current sources 912, 914 in this manner may extend signal-to-noise ratio in current supplied from the current sources 912, 914 by 20-70 decibels (e.g., up to 55 decibels) per pixel.

Advantageously, the current in the Class AB-amplifier pixels 911 may be accurately sensed by the sense amplifiers 915, 916, even when bias conditions change in the Class AB-amplifier pixels 911, such as when power supplied by the ELVSS power supply 921 changes. Moreover, outputs of the sense amplifiers 915, 916 may be added at inputs of existing analog-to-digital converters (e.g., 152), without adding additional analog-to-digital converters 152 to the circuitry.

However, because of non-ideal differences between pixels 911, such as manufacturing imperfections, in some cases, subtracting the current $I_1$ 918 across a first pixel 911 from the current $I_2$ 920 across a second pixel 911 may not provide an accurate measurement or estimation of the current across the diode 919. Indeed, even though two pixels 911 may be supplied the same amount of voltage, the current values across the respective diodes 917, 919 may be different. As such, subtracting the current $I_1$ 918 across a first pixel 911 from the current $I_2$ 920 across a second pixel 911 may yield, not only the current across the diode 919, but also an additional current value due to the non-ideal differences between pixels 911, which may be referred to as a bias mismatch current (between the two pixels 911).

Figure 50:
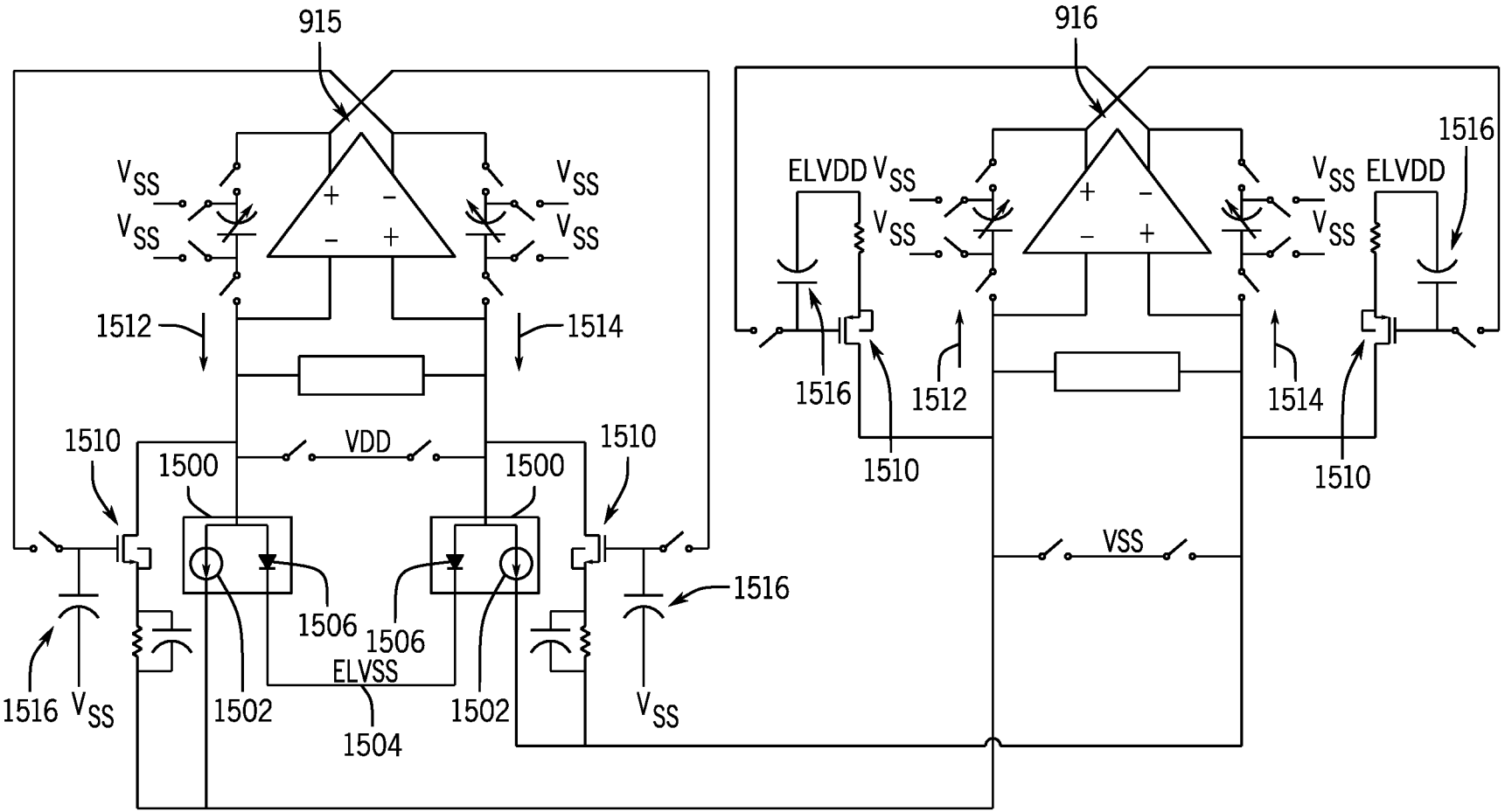
FIG. 50 is a circuit diagram illustrating determining bias mismatch current between two pixels, according to an embodiment of the present disclosure.

Thus, to accurately determine the current across the diode 919, the bias mismatch current may be subtracted from the difference between the current $I_1$ 918 across a first pixel 911 from the current $I_2$ 920 across a second pixel 911. FIG. 50 is a circuit diagram illustrating determining the bias mismatch current between two pixels 1500, according to an embodiment of the present disclosure. To determine the bias mismatch current, signal current 1502 may be disabled (e.g., by pushing cutout voltages, such as voltage supplied by the ELVSS power supply 1504, to high) such that no current is flowing through diodes 1506. In this manner, the current measured by sense amplifiers 1508 is current through transistors of the pixels 1500—that is, the bias currents (e.g., 440 of FIG. 26)—and not current through the diodes 1506. The difference between these bias currents, as measured by the may be sense amplifiers 1508, is the bias mismatch current. Side transistors 1510 of the circuit diagram may mitigate or eliminate the bias mismatch current, thus enabling a more accurate determination of current through the diodes 1506.

Figure 51:
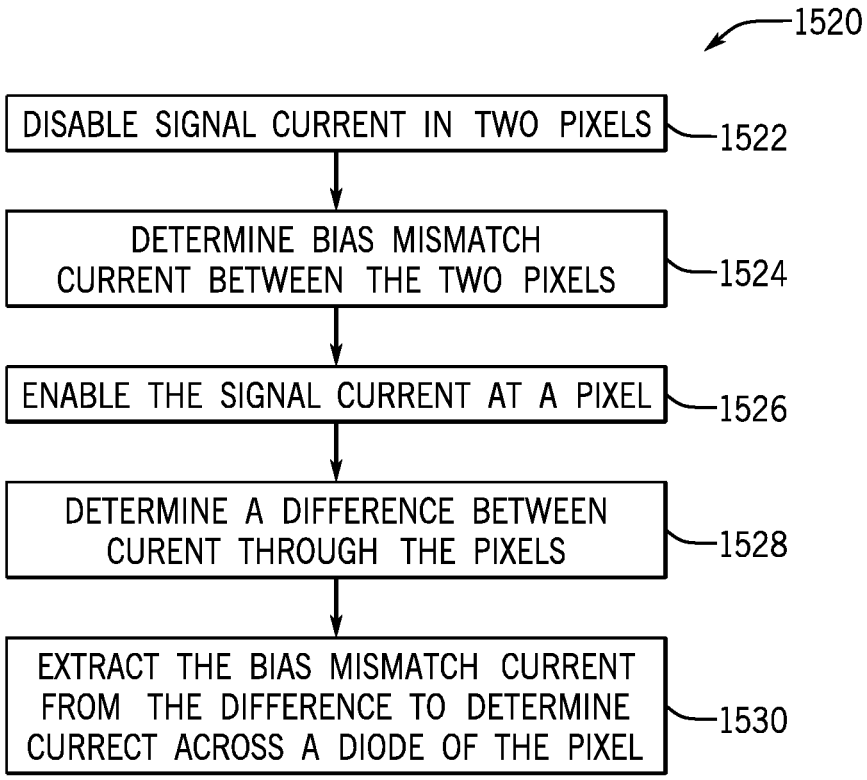
FIG. 51 is a flow diagram of a method for determining current through a diode, according to an embodiment of the present disclosure.

FIG. 51 is a flow diagram of a method 1520 for determining current through a diode (e.g., 1506), according to an embodiment of the present disclosure. In particular, the method 1520 may be performed using the circuit diagram shown in FIG. 50. In some embodiments, the diode may be part of a Class AB-amplifier pixel 911, such as that shown in FIG. 48. While the method 1520 is described using steps in a specific sequence, it should be understood that the present disclosure contemplates that the described steps may be performed in different sequences than the sequence illustrated, and certain described steps may be skipped or not performed altogether. In some embodiments, at least some of the steps of the method 1520 may be performed by the processor core complex 12, as described below. However, it should be understood that any suitable device or combination of devices is contemplated to perform the method 1520, such as the digital-to-analog converter 572 of FIG. 31, the sensing circuitry 576, the ELVSS power supply 780, the display 18, and the like.

The processor core complex 12 disables (process block 1522) signal current in the two pixels 1500. For example, the processor core complex 12 may push cutout voltages, such as voltage supplied by the ELVSS power supply 1504, to high. As such, no current may flow through the diodes 1506.

The processor core complex 12 then determines (process block 1524) bias mismatch current between the two pixels 1500. In particular, the processor core complex 12 may configure the circuit shown in FIG. 50 to determine the bias mismatch current using the side transistors 1510. For example, the side transistors 1510 may sample the bias currents at gates of the current sources 1502, and the processor core complex 12 may determine a different between the bias currents.

The processor core complex 12 enables (process block 1526) the signal current at a pixel 911. In particular, the processor core complex 12 may enable the signal current at a respective pixel 911 for which current across the corresponding diode 1506 is desired to be determined. As such, the processor core complex 12 may pull the cutout voltages, such as the voltage supplied by the ELVSS power supply 1504, to low.

The processor core complex 12 then determines (process block 1528) a difference between current through the pixels 911. That is, the processor core complex 12 may determine a current 1512 through the pixel 911 having the diode 1506 for which the signal current is provided from process block 1526 and a current 1514 through the pixel 911 having a diode 1506 for which a signal current is not provided. For example, the processor core complex 12 may determine the currents 1512, 1514 by measuring current at output capacitors 1516. The processor core complex 12 may then determine a difference between these two currents 1512, 1514. The difference may thus include both a desired current across the diode 1506 of the pixel 911 as well as the bias mismatch current.

The processor core complex 12 extracts (process block 1530) the bias mismatch current from the difference between current through the pixels 911. That is, the processor core complex 12 may subtract the bias mismatch current from the difference between current through the pixels 911. The remaining current is thus the current across the diode 1506 of the pixel 911. In this manner, the method 1520 and the circuit diagram of FIG. 50 may accurately measure current across diodes in Class AB-amplifier pixels 911 (and other pixels having current sources on each side of a voltage data line 913) while also compensating for bias mismatch between the pixels 911.

As discussed with reference to FIG. 38, when sensing current in a pixel or sub-pixel, surrounding pixels or sub-pixels may be turned off or programmed to zero. As such, current may leak from the pixel or sub-pixel being sensed to the surrounding pixels or sub-pixels. In the configuration for the pixel 740 shown in FIG. 38, a left column of sub-pixels includes a top row sub-pixel of a red sub-pixel 742 and a bottom row sub-pixel of a green sub-pixel 744. The pixel 740 also includes a right column of a blue sub-pixel 746.

Figure 52:
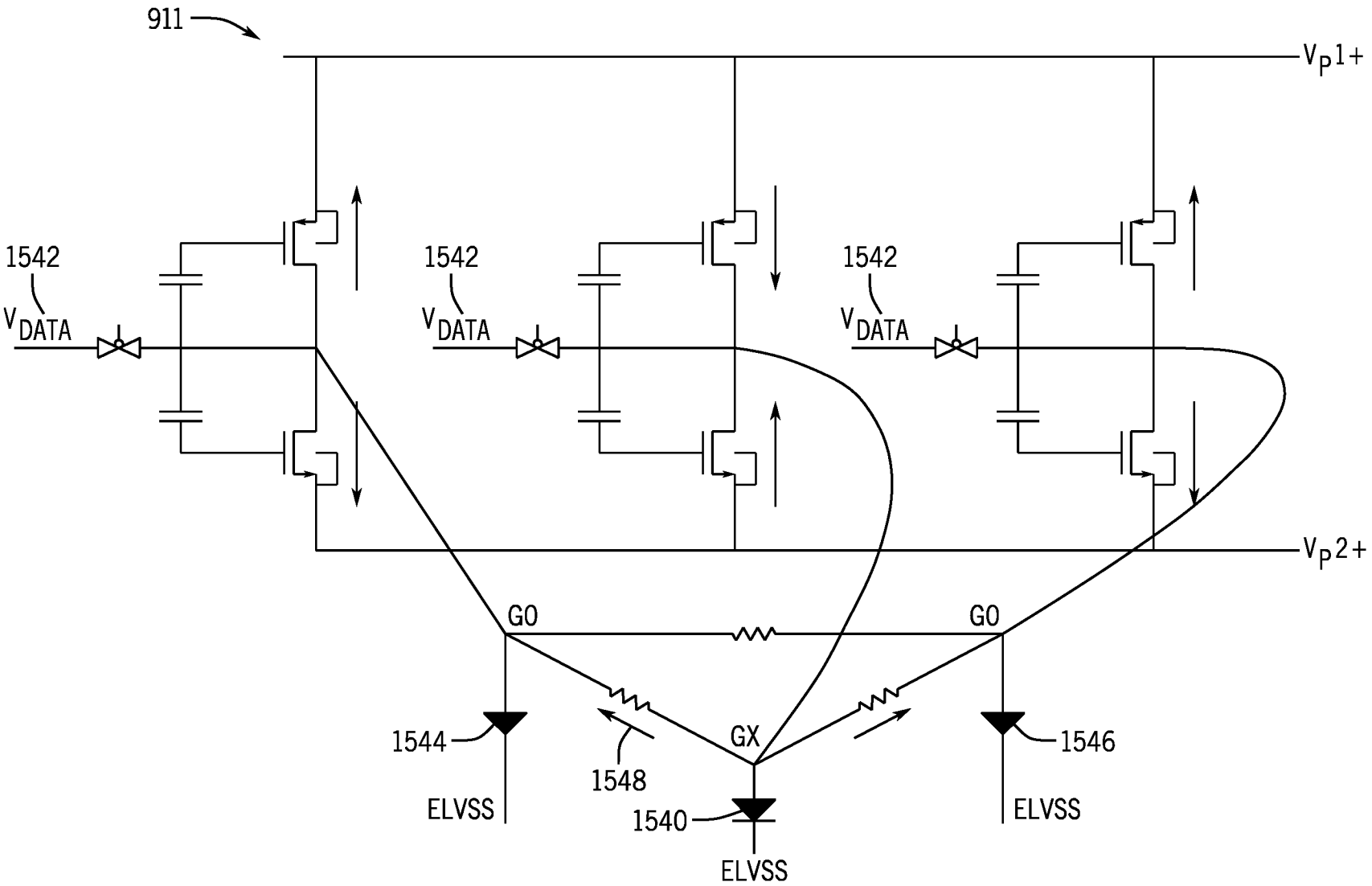
FIG. 52 illustrates lateral leakage current in the Class AB-amplifier pixel of FIG. 49 as a result of sensing current through a diode of a blue sub-pixel, according to an embodiment of the present disclosure.

For certain pixels (e.g., the Class A-amplifier pixel 910 shown in FIG. 47), lateral leakage current may flow from a voltage drain (e.g., VDD) to a voltage source (e.g., VSS). However, a pixel with a current source on each side of a data voltage line, such as the Class AB-amplifier pixel 911, circulates the lateral leakage current from the VDD and VSS, as shown by the arrows in FIG. 52. In particular, FIG. 52 illustrates lateral leakage current in the pixel 911 of FIG. 49 as a result of sensing current through a diode of a blue sub-pixel 1540, according to an embodiment of the present disclosure. As such, the blue sub-pixel 1540 is being sent data (via the data voltage line 1542) to cause the blue sub-pixel 1540 to emit a gray level of X ("GX", where X may be any suitable gray level (e.g., G100)). Additionally, a red sub-pixel 1544 and a green sub-pixel 1546 of the pixel 911 are turned off, such that the red sub-pixel 1544 and the green sub-pixel 1546 are sent data (via respective data voltage lines 1542) causing the red sub-pixel 1544 and the green sub-pixel 1546 to emit gray levels of zero ("G0") and appear off. The red arrows 1548 indicate the flow of leakage currents from the blue sub-pixel 1540 to the red sub-pixel 1544 and the green sub-pixel 1546.

Figure 53:
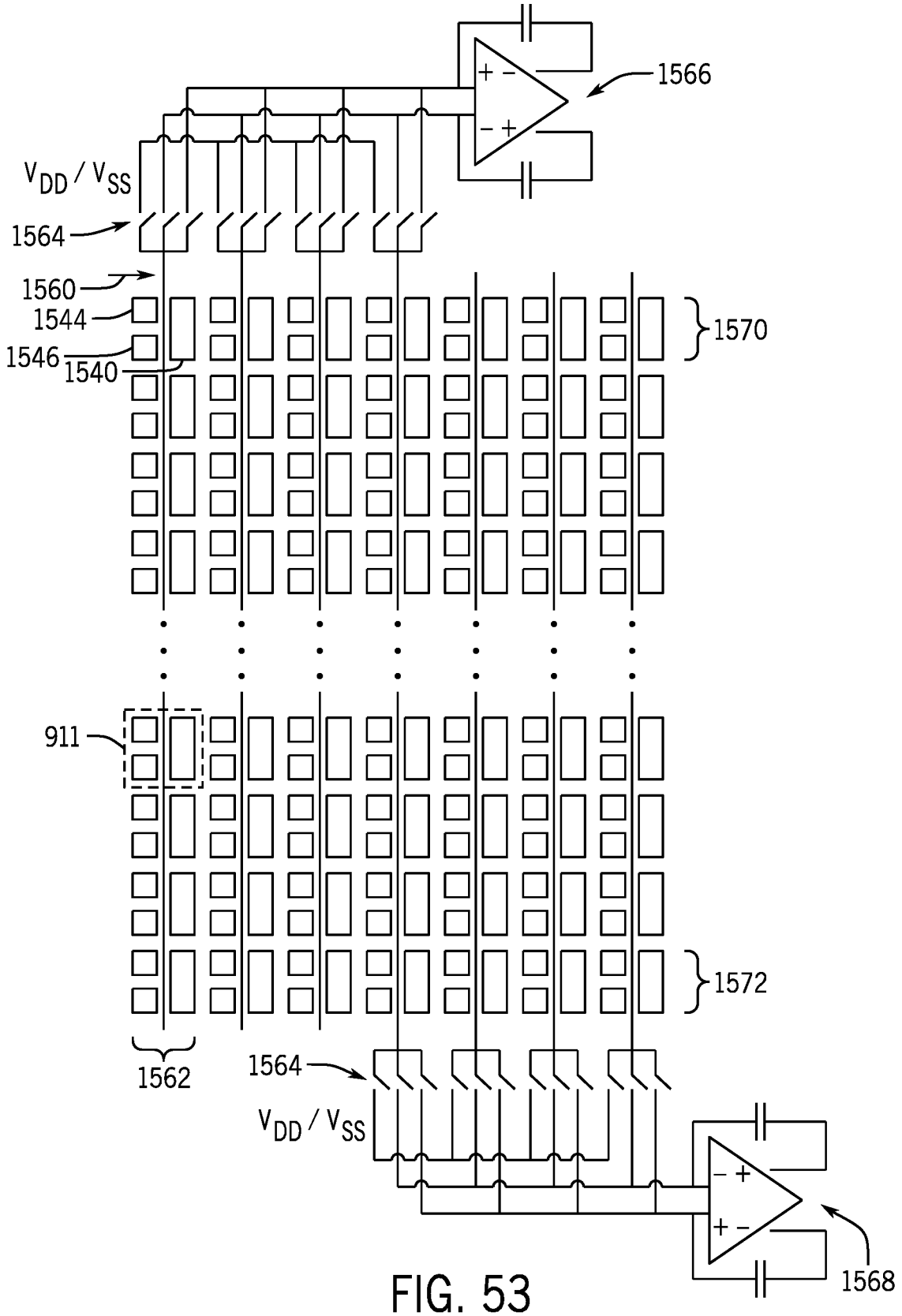
FIG. 53 is a circuit diagram illustrating mitigating the lateral leakage currents when sensing current in a sub-pixel, according to an embodiment of the present disclosure.

The lateral leakage currents may be accounted for or subtracted away if the VDD and VSS lines for leaking paths (e.g., the neighboring sub-pixels of the sub-pixel being sensed) are combined. FIG. 53 is a circuit diagram illustrating mitigating the lateral leakage currents when sensing current in a sub-pixel, according to an embodiment of the present disclosure. As illustrated, VDD/VSS power routing or supply lines 1560 may be disposed between each column 1562 of pixels 911. As such, each sub-pixel may be adjacent to a power routing line 1560 that may be coupled to a three-way switch or multiplexer 1564 that in turn is coupled to a sense amplifier 1566. In some embodiments, each power routing line 1560 is coupled to two three-way multiplexers 1564, 1568 (one disposed above the first row 1570 of pixels 911 and one disposed below the last row 1572 of pixels 911). A first multiplexer 1564 may be coupled to a topmost sense amplifier 1566, while a second multiplexer 1568 may be coupled to a bottommost sense amplifier 1568. The two sense amplifiers 1566, 1568 may reduce or mitigate noise from the two current sources (e.g., 912, 914) disposed on each side of the data voltage line (e.g., 913), as discussed with respect to FIG. 49.

Figure 54:
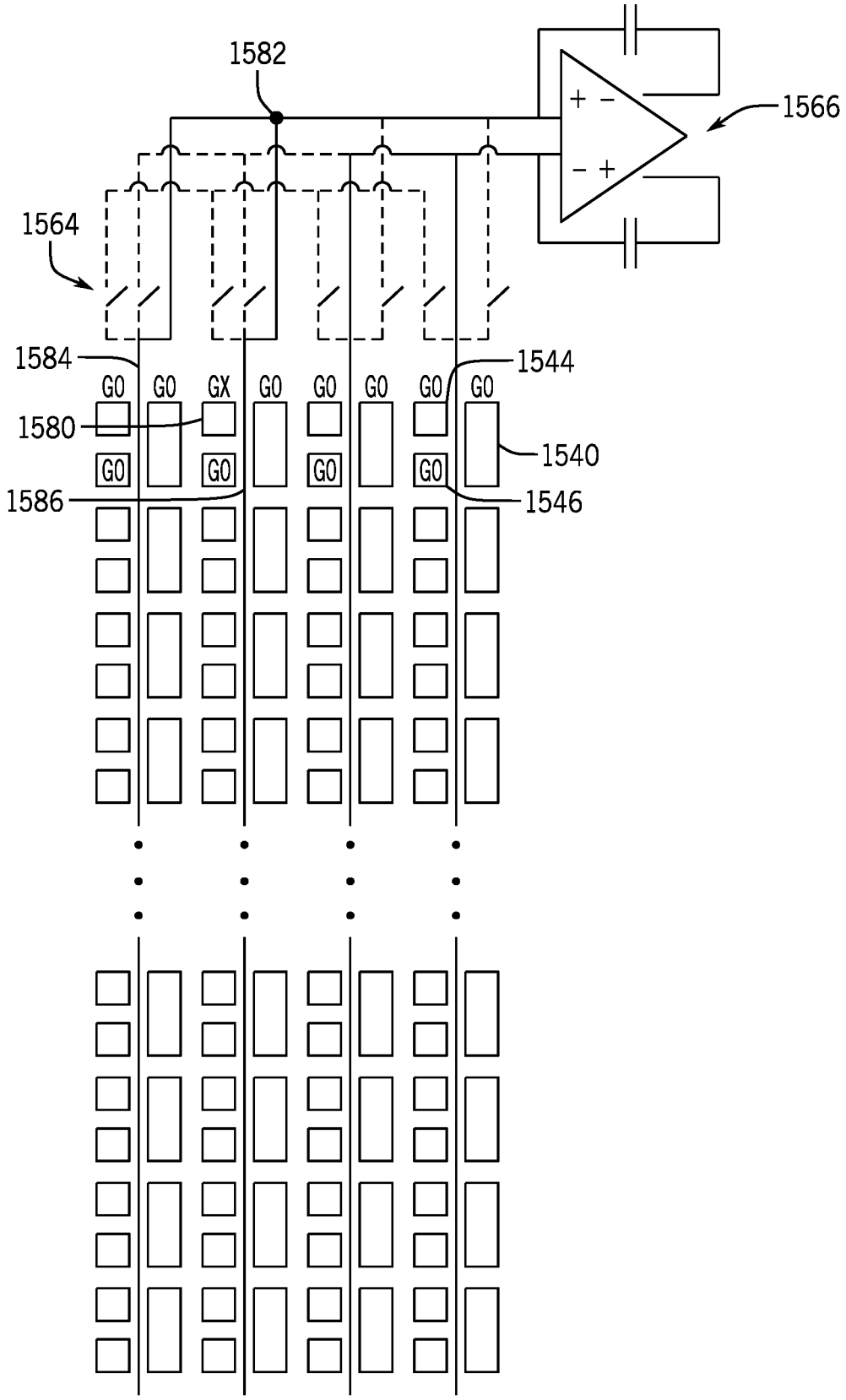
FIG. 54 is an example circuit diagram illustrating performing a sense operation on a red sub-pixel, according to an embodiment of the present disclosure.

When sensing current of a pixel 911, the multiplexers 1564 may connect those power routing lines 1560 that supply the VDD/VSS signals to sub-pixels that may receive leakage current. For example, in the example circuit diagram of FIG. 54, a sense operation is performed on a red sub-pixel 1580, according to an embodiment of the present disclosure. In particular, the red sub-pixel 1580 is sent data (via a data voltage line) that causes the red sub-pixel 1580 to emit a gray level of X, while other sub-pixels (e.g., 1540, 1544, 1546) are sent data that cause the other sub-pixels to emit a gray level of zero. As a result, the multiplexer 1564 is instructed (e.g., by the processor core complex 12) to close switches that couple a node 1582 (connecting the multiplexer 1564 to the sense amplifier 1566) to the power routing lines 1584, 1586 that supply the VDD/VSS signals to sub-pixels that may receive leakage current when sensing current in the red sub-pixel 1580 (e.g., neighboring sub-pixels of the red sub-pixel 1580). As illustrated, the power routing lines 1584, 1586 that supply the VDD/VSS signals to sub-pixels that may receive leakage current when sensing current in the red sub-pixel 1580 may be the two closest power routing lines 1584, 1586 to the red sub-pixel 1580. While the bottommost sense amplifier 1568 is not shown in FIG. 54, it should be understood that this same technique applies if a bottommost sense amplifier 1568 were used in FIG. 54.

Figure 55:
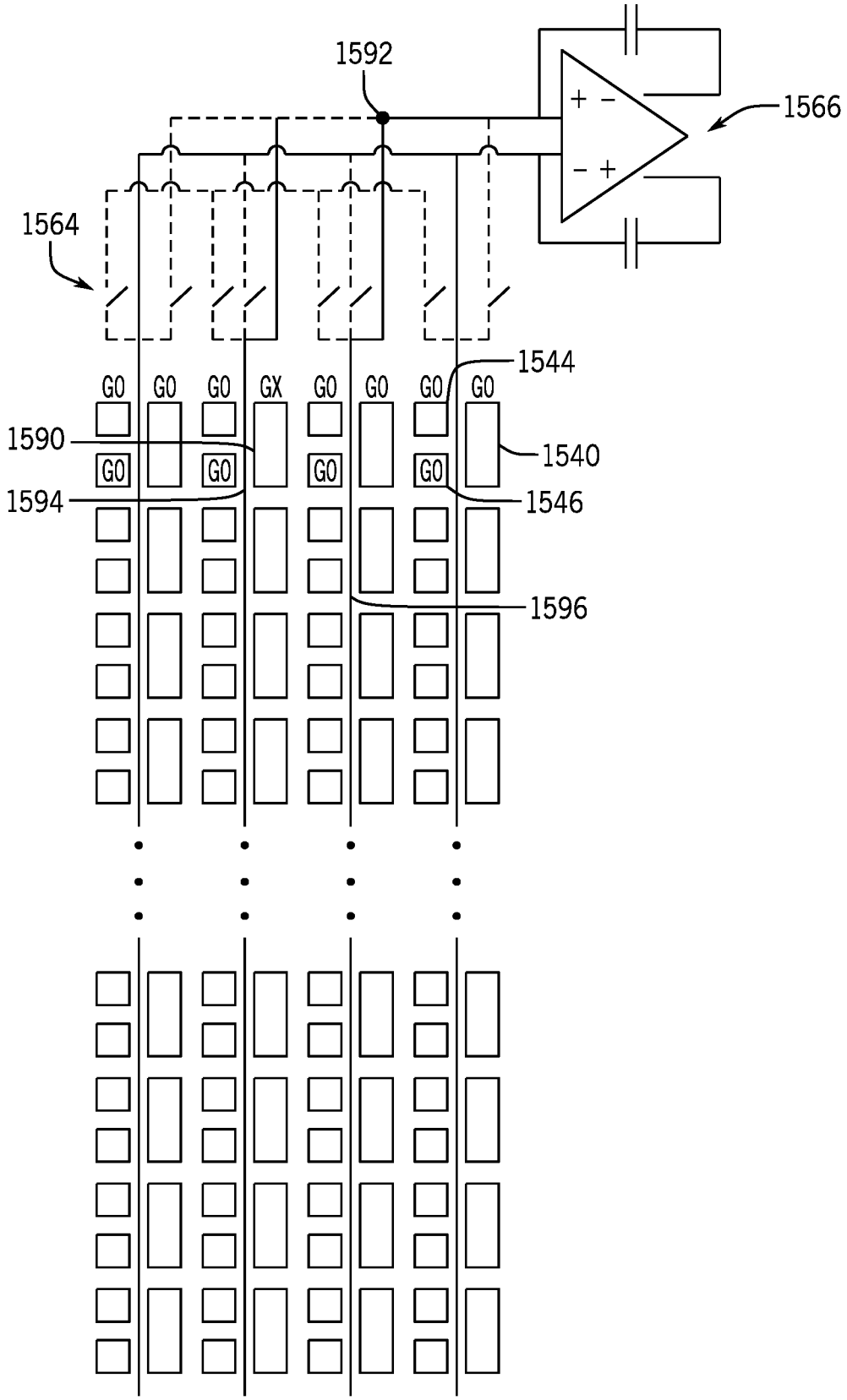
FIG. 55 is an example circuit diagram illustrating performing a sense operation on a blue sub-pixel, according to an embodiment of the present disclosure.

Similarly, in the example circuit diagram of FIG. 55, a sense operation is performed on a blue sub-pixel 1590, according to an embodiment of the present disclosure. In particular, the blue sub-pixel 1590 is sent data (via a data voltage line) that causes the blue sub-pixel 1590 to emit a gray level of X, while other sub-pixels (e.g., 1540, 1544, 1546) are sent data that cause the other sub-pixels to emit a gray level of zero. As a result, the multiplexer 1564 is instructed (e.g., by the processor core complex 12) to close switches that couple a node 1592 (connecting the multiplexer 1564 to the sense amplifier 1566) to the power routing lines 1594, 1596 that supply the VDD/VSS signals to sub-pixels that may receive leakage current when sensing current in the blue sub-pixel 1590 (e.g., neighboring sub-pixels of the blue sub-pixel 1590). As illustrated, the power routing lines 1594, 1596 that supply the VDD/VSS signals to sub-pixels that may receive leakage current when sensing current in the blue sub-pixel 1590 may be the two closest power routing lines 1594, 1596 to the blue sub-pixel 1590. While the bottommost sense amplifier 1568 is not shown in FIG. 55, it should be understood that this same technique applies if a bottommost sense amplifier 1568 were used in FIG. 55. In this manner, the circuit diagrams of FIGS. 53-55 may be accounted for or subtracted away when sensing current in a pixel with a current source on each side of a data voltage line, such as the Class AB-amplifier pixel 911.

Figure 56:
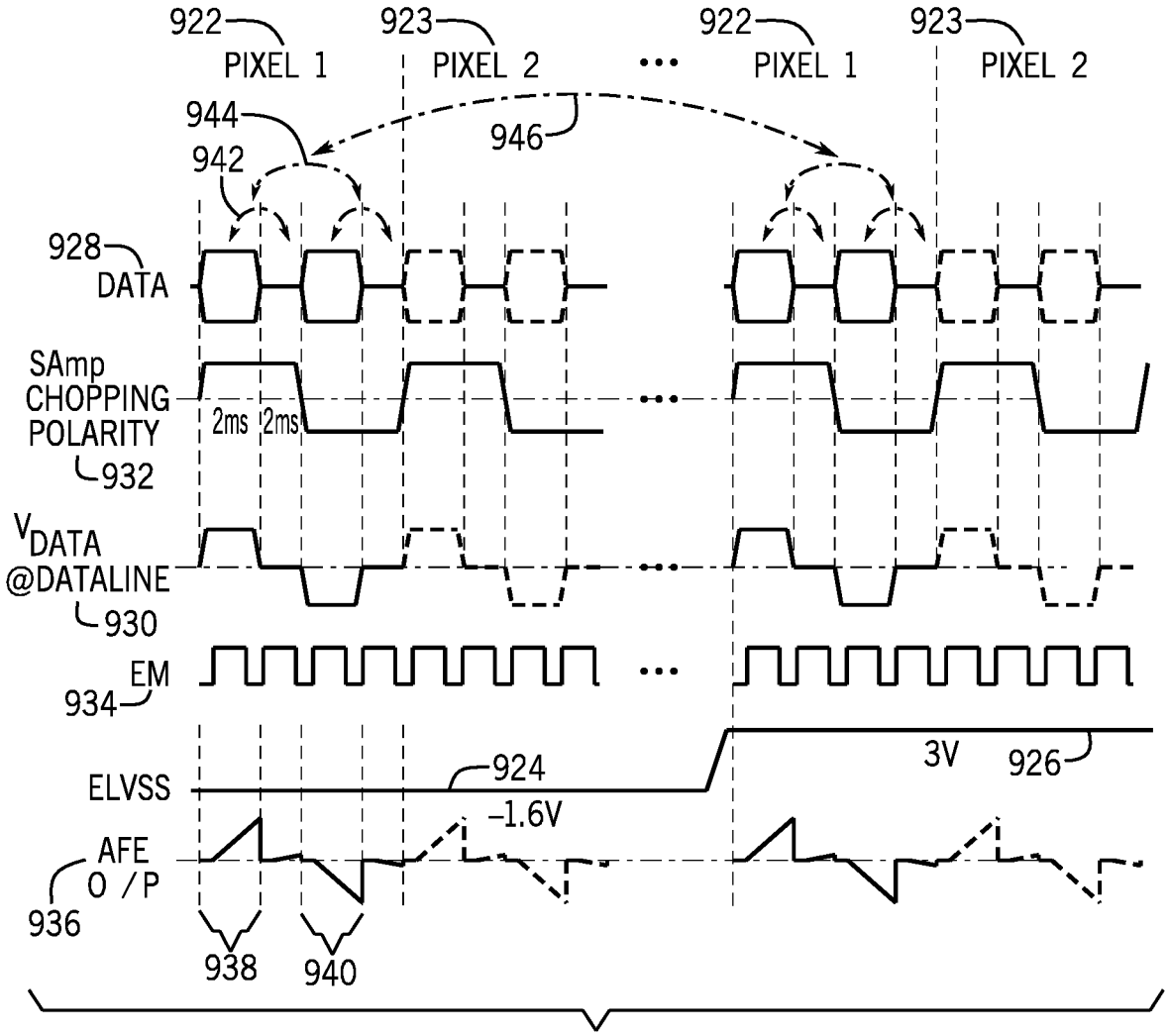
FIG. 56 is a timing diagram for sensing current in pixels of an active array of the display of FIG. 7, according to an embodiment of the present disclosure.

FIG. 56 is a timing diagram for sensing current in pixels 922, 923 of the active array 62 of the display 18 of FIG. 7, according to an embodiment of the present disclosure. The ELVSS power supply may first provide an operating supply voltage 924 (e.g., approximately −1.6 V), and then an increased supply voltage 926 (e.g., approximately 3 V) to the pixels 922, 923. The timing diagram illustrates data values 928 and data voltages 930 provided to the pixel 922, source amplifier chopping polarity 932 in the pixels 922, 923, emission signals 934 in the pixels 922, 923, and analog front end (AFE) operation 936 in the pixels 922, 923.

As illustrated, each sensing operation 938, 940 may take approximately 2 milliseconds, and two pairs of current-voltage values may be sensed per pixel 922 (or sub-pixel). The timing diagram also illustrates timing of correlated double sampling 942, source amplifier offset cancellation 944, and lateral leakage and bias current cancellation 946.

The sensing operation may be performed periodically (e.g., approximately every two weeks) and/or based at least in part on certain conditions. The look-up tables 582 of the processor core complex 12 may be updated based at least in part on the sensing results, and applied to display 18 to be used until the next sensing operation. It should be noted that sensing of all pixels 922, 923 or sub-pixels may be performed in a target time. A number of analog front end channels performing sensing operations may be dependent on the target time. For example, assuming a number of sub-pixels to be sensed is 7,875,000, and a time to sense the number of sub-pixels is 4200 minutes, the number of analog front end channels to perform sensing in 30 minutes may be 140. To perform the sensing in 90 minutes, the number of analog front end channels may be 50.

Performing the sensing operation in less time may result in less chance of the sensing operation being interrupted (e.g., by activating or using the device 10). Because temperature may change when the sensing operation is continued after the interruption (e.g., at the next off-time for the device 10), interrupted sensing operations may be less accurate and more prone to error. However, because the resolution of the display 18 may be high, driving the pixels of the display 18 at a target refresh rate may use a large amount of bandwidth. Similarly, driving the pixels of the display 18 may consume a large amount of power and implementing the sensing scheme for a high resolution display 18 may be complex. As such, in some embodiments, the pixels may be grouped and a representative pixel of the grouped pixels may be sensed, rather than each individual pixel of the group.

Figure 57:
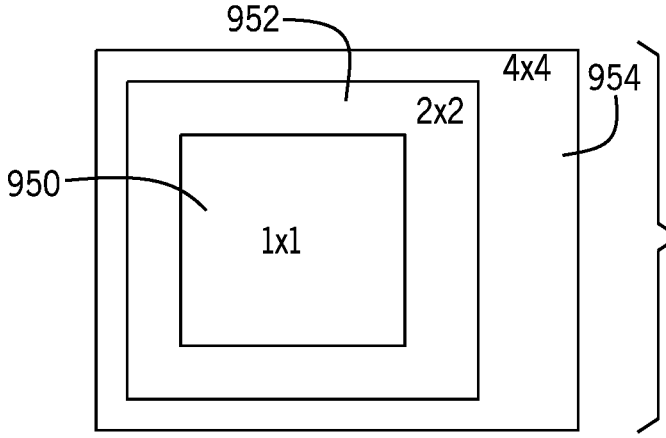
FIG. 57 is a diagram of pixel groups of the display of FIG. 7, according to an embodiment of the present disclosure.

FIG. 57 is a diagram of pixel groups of the display 18 of FIG. 7, according to an embodiment of the present disclosure. Pixel 950 is a pixel of the active array, pixel group 952 is a 2×2 configuration of four pixels 950, and pixel group 954 is a 4×4 configuration of sixteen pixels 950. Because the pixels in each group are adjacent to one another, the pixels of a respective group undergo similar aging, use, and operational conditions (such as temperature). As such, instead of sensing each individual pixel 950 of a group 952, 954, a representative pixel of the group may be sensed, and the remaining pixels of the group may not be sensed. In this manner, less pixels 950 may be sensed in each sensing operation, thus reducing power consumption, bandwidth usage, and complexity during the sensing operation.

In some embodiments, different groupings may be used based at least in part on location of the pixels of the groupings. For example, in a more likely focused (e.g., by a viewer) portion of the display 18, such as near the center of the display 18, pixels 950 may be sensed individually or via smaller groups, such as the 2×2 configuration 952. In a less likely focused portion of the display 18, such as near the periphery or border of the display 18, pixels 950 may be sensed via larger groups, such as the 4×4 configuration 954. As such, even fewer pixels 950 may be sensed in each sensing operation, further reducing power consumption, bandwidth usage, and complexity during the sensing operation. Despite FIG. 57 illustrating only 2×2 and 4×4 pixel groups, it should be understood that any suitable grouping of pixels 950 is contemplated.

Figure 58:
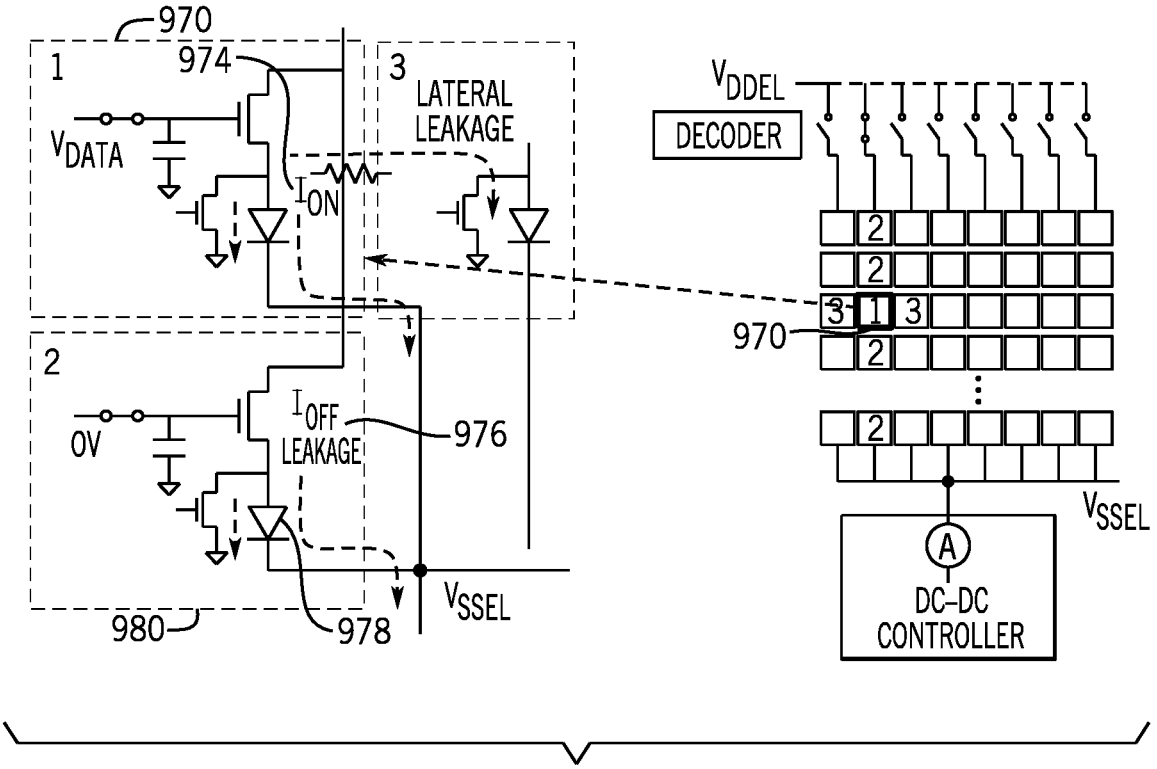
FIG. 58 is a schematic diagram illustrating sensing current in a pixel of the display of FIG. 7, according to an embodiment of the present disclosure.

While current sensing has been discussed as being performed from a "top" side (e.g., from a top located power supply, such as an ELVDD power supply coupled to a drain of the TFT of a pixel) as shown by element 748 of FIG. 38, in some embodiments, current sensing may be performed from a bottom located power supply, such as an ELVSS power supply coupled to a source of the TFT of a pixel. FIG. 58 is a schematic diagram illustrating sensing current in a pixel 970 of the display 18 of FIG. 7, according to an embodiment of the present disclosure. In particular, current sensed in the pixel 970 may be determined as a sum of current 972 through the diode 974 (which is turned on) of the pixel 970 and one or more currents 976 through one or more diodes 978 of one or more adjacent pixels 980.

Current-Voltage Compensation Methods

After the sensing circuitry 576 of FIG. 31 senses or predicts a respective set of current-voltage values for each pixel of the active array 62 (which may be stored in the look-up tables 582), the voltage comparator circuit 584 may generate a current-voltage curve for each pixel based at least in part on the respective set of current-voltage values. Because providing an entire curve or excessive set of current-voltage values for each pixel (e.g., per image frame) to the voltage comparator circuit 584 may be impractical in terms of memory or bandwidth usage, the sensing circuitry 576 may instead send a reduced number (e.g., two pairs) of current-voltage values, and the voltage comparator circuit 584 may generate the current-voltage curve (e.g., in real-time) for each pixel based at least in part on the respective set of current-voltage values. The voltage comparator circuit 584 may compare the generated current-voltage curve for each pixel to a reference current-voltage curve received from the reference array control circuitry of, and generate a set of voltage differences or degradations (e.g., corresponding to resulting current values). The current-voltage compensation circuit 586 may then instruct the digital-to-analog converter 572 to compensate for the set of voltage differences or degradations (e.g., by providing increased data voltages for certain corresponding current values).

Figure 59:
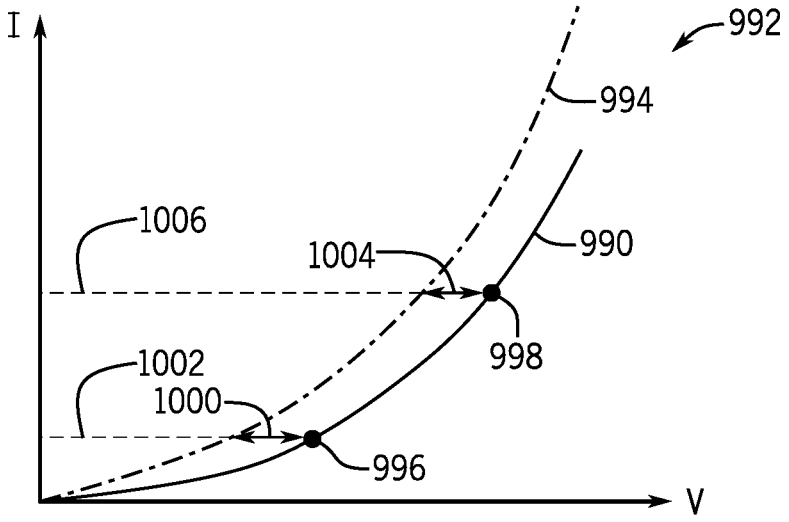
FIG. 59 is a graph illustrating generating a current-voltage curve for a pixel of the display of FIG. 7 using a delta-based model, according to an embodiment of the present disclosure.

Any suitable method may be used by the voltage comparator circuit 584 to generate the current-voltage curve for each pixel, such as a delta-based model or an interpolation-based model. FIG. 59 is a graph illustrating generating a current-voltage curve 990 for a pixel of the display 18 of FIG. 7 using a delta-based model 992, according to an embodiment of the present disclosure. The graph includes a "pristine" reference current-voltage curve 994 that may be generated from a set of reference current-voltage values received from the reference array control circuitry of. For example, the voltage comparator circuit 584 may receive eight pairs of current-voltage values and interpolate the reference current-voltage curve 994 based at least in part on the eight pairs of current-voltage values.

The graph also includes two pairs of sensed current-voltage values 996, 998 received from the sensing circuitry 576 for the pixel. The voltage comparator circuit 584 may determine a first voltage difference or delta value 1000 between a voltage of the first pair of sensed current-voltage values 996 at a corresponding current 1002 and a reference voltage of the reference current-voltage curve 994 at the corresponding current 1002. The voltage comparator circuit 584 may also determine a second voltage difference or delta value 1004 between a voltage of the second pair of sensed current-voltage values 998 at a corresponding current 1006 and a reference voltage of the reference current-voltage curve 994 at the corresponding current 1006.

Using the delta-based model 992, the voltage comparator circuit 584 may then determine a linear relationship between the first voltage difference 1000 and the second voltage difference 1004, and apply the linear relationship to the reference current-voltage curve 994 to reconstruct the current-voltage curve 990. The current-voltage compensation circuit 586 may then instruct the digital-to-analog converter 572 to compensate for voltage degradation as provided and based at least in part on the current-voltage curve 990. For example, the current-voltage compensation circuit 586 may determine a set of voltage differences (e.g., including the first voltage difference 1000 and the second voltage difference 1004) between the current-voltage curve 990 and the reference current-voltage curve 994, and increase data voltages or currents for the pixel at corresponding current values based at least in part on the set of voltage differences.

Figure 60:
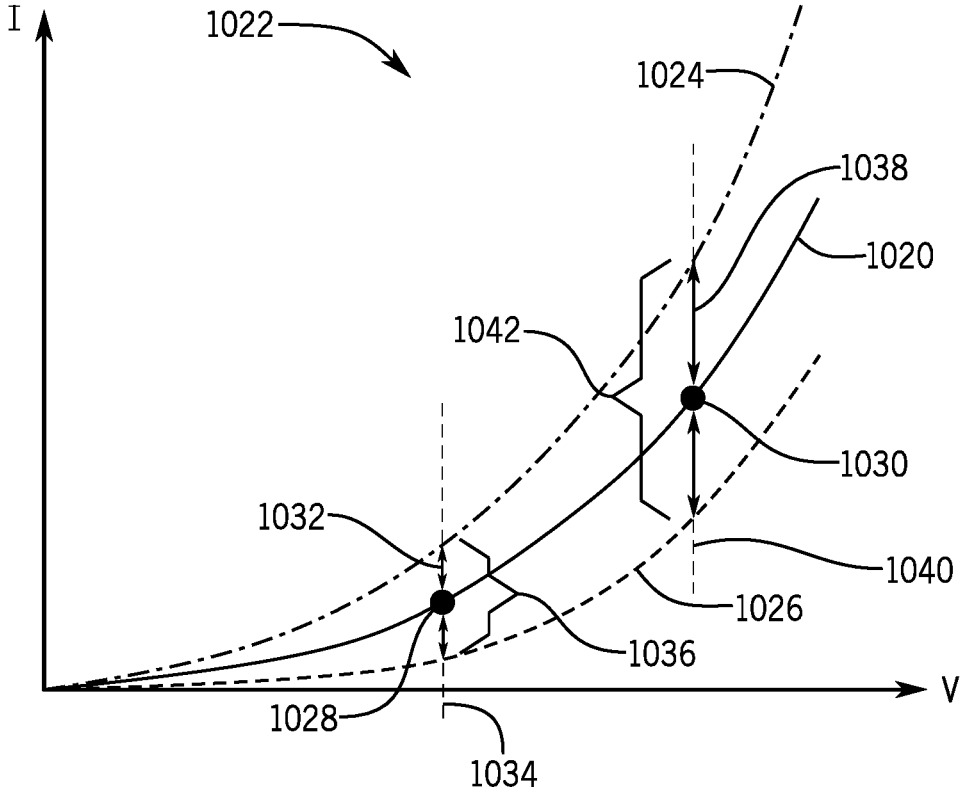
FIG. 60 is a graph illustrating generating a current-voltage curve for a pixel of the display of FIG. 7 using an interpolation-based model, according to an embodiment of the present disclosure.

In some embodiments, a linear relationship may not accurately model the current-voltage curve for each pixel. For example, certain materials used to make the display 18 may cause the relationship of the current-voltage curve for each pixel to tend to be nonlinear. As such, the voltage comparator circuit 584 may use an interpolation-based model to generate the current-voltage curve for each pixel. FIG. 60 is a graph illustrating generating a current-voltage curve 1020 for a pixel of the display 18 of FIG. 7 using an interpolation-based model 1022, according to an embodiment of the present disclosure. The graph includes a "pristine" reference current-voltage curve 1024 that may be generated from a set of reference current-voltage values received from the reference array control circuitry of. The graph also includes an "aged" current-voltage curve 1026 that may be generated by stressing one or more pixels of a display over a period of time such that the aged current-voltage curve 1026 represents an accurate representation of how the current-voltage relationship of the one or more pixels age.

In some embodiments, the aged current-voltage curve 1026 may be generated for each batch of displays manufactured (e.g., by or at the manufacturer). In alternative or additional embodiments, the aged current-voltage curve 1026 may be generated for each display 18. For example, the digital-to-analog converter 572 may stress one or more pixels of a less active and/or less focused (e.g., by a user) area of the display 18 over a period of time, such as along the periphery or border of the display 18 and generate the aged current-voltage curve 1026 based at least in part on the stressed one or more pixels. The aged current-voltage curve 1026 may be stored in any suitable storage device, such as the local memory 14, the main memory storage device 16, or the like.

The graph includes two pairs of sensed current-voltage values 1028, 1030 received from the sensing circuitry 576 for the pixel. The voltage comparator circuit 584 may determine a first difference $d_1$ 1032 between a current of the first pair of sensed current-voltage values 1028 at a corresponding voltage 1034 and a current of the reference current-voltage curve 1024 at the corresponding voltage 1034. The voltage comparator circuit 584 may also determine a first total difference $D_1$ 1036 between the current of the reference current-voltage curve 1024 at the corresponding voltage 1034 and a current of the aged current-voltage curve 1026 at the corresponding voltage 1034. The voltage comparator circuit 584 may then determine a first degradation ratio $r_1$ between the first difference 1032 and the first total difference 1036 (e.g., $r_1=d_1/D_1$).

The voltage comparator circuit 584 may also determines a second difference $d_2$ 1038 between a current of the second pair of sensed current-voltage values 1030 at a corresponding voltage 1040 and a current of the reference current-voltage curve 1024 at the corresponding voltage 1040. The voltage comparator circuit 584 may also determine a second total difference $D_2$ 1042 between the current of the reference current-voltage curve 1024 at the corresponding voltage 1040 and a current of the aged current-voltage curve 1026 at the corresponding voltage 1040. The voltage comparator circuit 584 may then determine a second degradation ratio $r_2$ between the second difference 1038 and the second total difference 1042 (e.g., $r_2=d_2/D_2$).

Using the interpolation-based model 1022, the voltage comparator circuit 584 may then determine a linear relationship between the first ratio and the second ratio, and apply the linear relationship to the reference current-voltage curve 1024 to reconstruct the current-voltage curve 1020. The current-voltage compensation circuit 586 may then instruct the digital-to-analog converter 572 to compensate for voltage degradation as provided and based at least in part on the current-voltage 1020. For example, the current-voltage compensation circuit 586 may determine a set of voltage differences between the current-voltage curve 1020 and the reference current-voltage curve 1024, and increase data voltages or currents for the pixel at corresponding current values based at least in part on the set of voltage differences.

Reconstructing the current-voltage curve using the degradation ratios, rather than linear voltage differences, may reduce or remove dependency of the current-voltage relationship on the material of the display 18 and/or temperature. That is, typically, sensing is performed with lower temperature because the device 10 is inactive, while applying compensation based at least in part on sensing results is performed with higher temperature because the device is active. Because using the degradation ratios is more universally applicable (e.g., as opposed to using the linear voltage differences), the interpolation-based reconstruction of the current-voltage curve may be more accurate. This is at least in part because the current-voltage curve of a pixel appears to have voltage degrade linearly when expressed using the degradation ratios.

Figure 61:
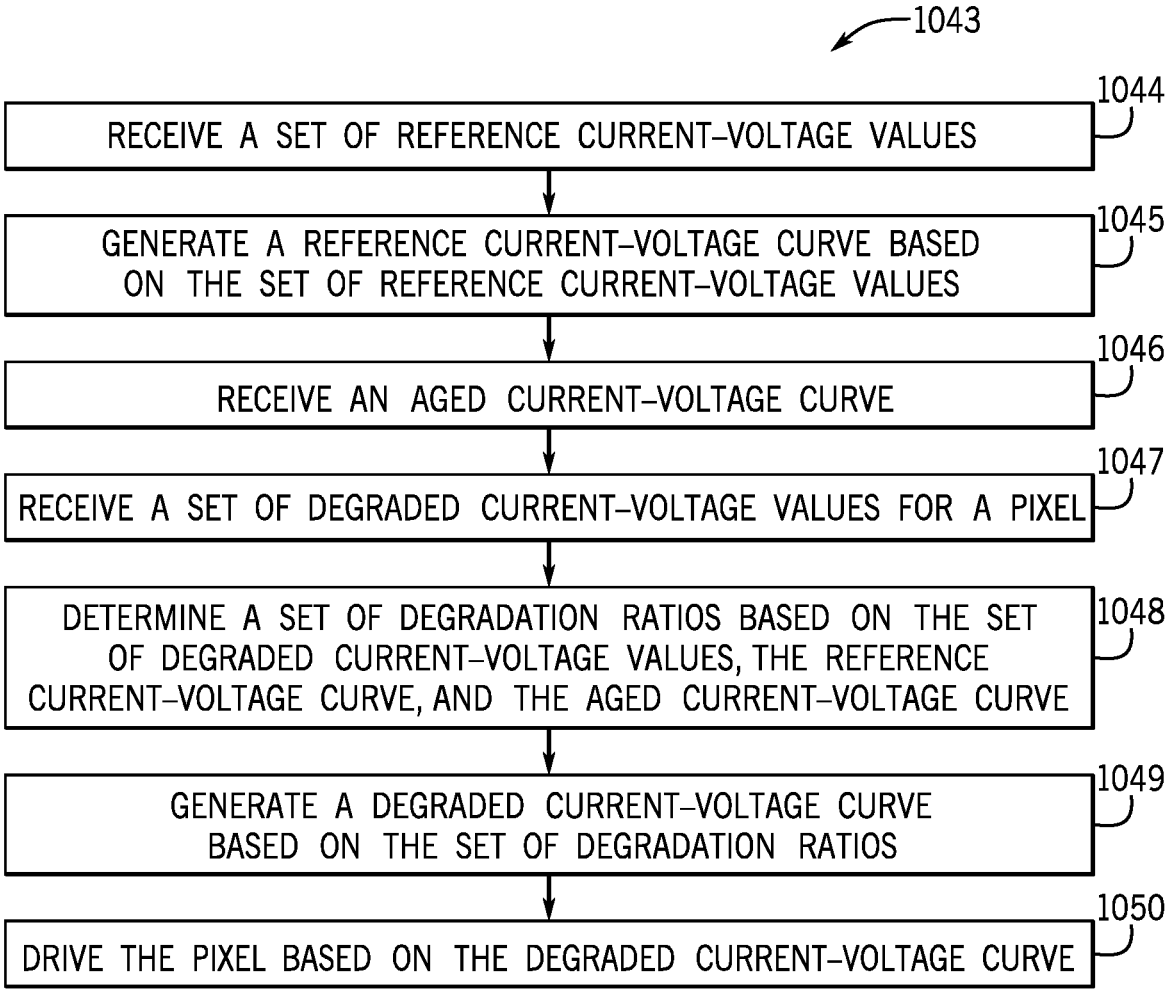
FIG. 61 is a flow diagram of a method for determining a degraded current-voltage curve to drive a pixel of the display of FIG. 7, according to an embodiment of the present disclosure.

FIG. 61 is a flow diagram of a method 1043 for determining a degraded current-voltage curve to drive a pixel of the display 18 of FIG. 7, according to an embodiment of the present disclosure. The method 1043 may be performed by any suitable device or combination of devices that may generate current-voltage curves, determine degradation ratios, and drive a pixel. While the method 1043 is described using steps in a specific sequence, it should be understood that the present disclosure contemplates that the described steps may be performed in different sequences than the sequence illustrated, and certain described steps may be skipped or not performed altogether. In some embodiments, at least some of the steps of the method 1043 may be performed by the current-voltage compensation circuit 586 of FIG. 31, as described below. However, it should be understood that any suitable device or combination of devices is contemplated to perform the method 1043, such as the digital-to-analog converter 572, the voltage comparator circuit 584, the processor core complex 12, the display 18, and the like.

The current-voltage compensation circuit 586 receives (process block 1044) a set of reference current-voltage values. The set of reference current-voltage values may be received from the reference array control circuitry of, and may include any suitable number (e.g. eight pairs) of reference current-voltage values. The current-voltage compensation circuit 586 then generates (process block 1045) a reference current-voltage curve 1024 based at least in part on the set of reference current-voltage values.

The current-voltage compensation circuit 586 receives (process block 1046) an aged current-voltage curve 1026. In some embodiments, the current-voltage compensation circuit 586 may receive a set of aged current-voltage values from the sensing circuitry 576 and/or any suitable storage device or mechanism, such as the local memory 14, the main memory storage device 16, the look-up tables 582, or the like. The current-voltage compensation circuit 586 may then generate the aged current-voltage curve 1026 based at least in part on the set of aged current-voltage values.

The current-voltage compensation circuit 586 then receives (process block 1047) a set of degraded current-voltage values for a pixel. The set of degraded current-voltage values may be received from the sensing circuitry 576 and be degraded due to the pixel being in operation for a period of time.

The current-voltage compensation circuit 586 determines (process block 1048) a set of degradation ratios based at least in part on the set of degraded current-voltage values, the reference current-voltage curve 1024, and the aged current-voltage curve 1026. In particular, for each degraded current-voltage value of the set of degraded current-voltage values, the current-voltage compensation circuit 586 may determine a difference d 1032 between a current of a respective degraded current-voltage value 1028 at a corresponding voltage 1034 and a current of the reference current-voltage curve 1024 at the corresponding voltage 1034. The voltage comparator circuit 584 may also determine a total difference D 1036 between the current of the reference current-voltage curve 1024 at the corresponding voltage 1034 and a current of the aged current-voltage curve 1026 at the corresponding voltage 1034. The voltage comparator circuit 584 may then determine a degradation ratio r between the first difference 1032 and the first total difference 1036 (e.g., r=d/D).

The current-voltage compensation circuit 586 generates (process block 1049) a degraded current-voltage curve 1020 based at least in part on the set of degradation ratios. In particular, the voltage comparator circuit 584 may then determine a linear relationship between the set of degradation ratios and apply the linear relationship to the reference current-voltage curve 1024 to reconstruct the degraded current-voltage curve 1020. The current-voltage compensation circuit 586 may then drive (process block 1050) or instruct the digital-to-analog converter 572 to drive the pixel 574 based at least in part on the degraded current-voltage curve 1020. For example, the current-voltage compensation circuit 586 may determine a set of voltage differences between the current-voltage curve 1020 and the reference current-voltage curve 1024, and increase data voltages or currents for the pixel at corresponding current values based at least in part on the set of voltage differences.

In some embodiments, the current step limiter circuitry 72 of the active array control circuitry 85 may limit current compensation values corresponding to the set of voltage differences. In particular, the current step limiter circuitry 72 may be used to limit the current compensation values that correspond to the set of voltage differences below a visibility threshold. The visibility threshold may correspond to a current value change that a viewer of the display 18 may not perceive when applied to driving the pixel 574 (as compared to driving the pixel 574 prior to applying the current compensation values). In this manner, the viewer may not notice the applied compensation, improving the overall viewing experience of the display 18.

Figure 62:
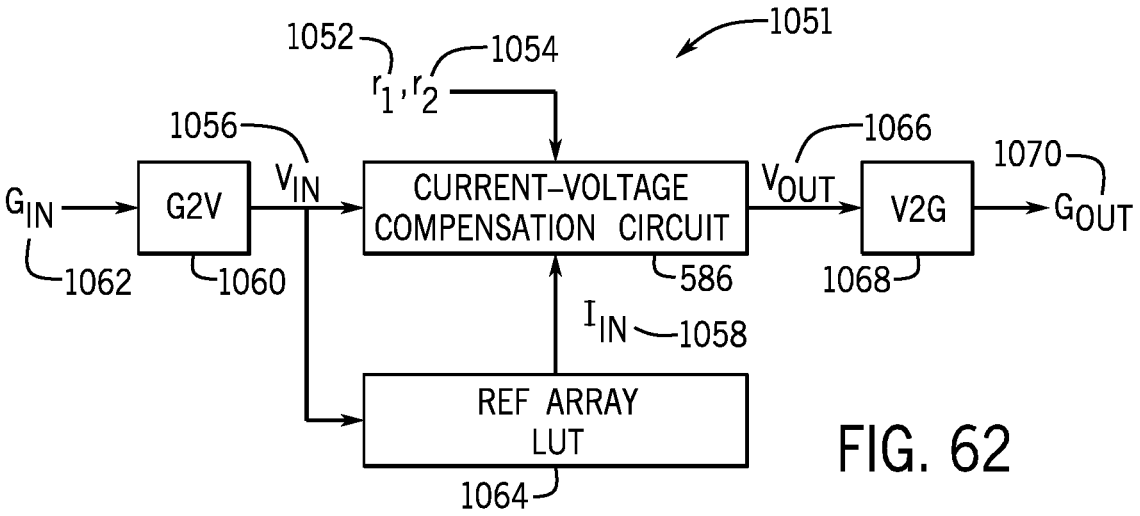
FIG. 62 is a block diagram of a system that compensates for voltage degradation in the display of FIG. 7, according to an embodiment of the present disclosure.

FIG. 62 is a block diagram of a system 1051 that compensates for voltage degradation in the display 18 of FIG. 7, according to an embodiment of the present disclosure. Some or all of the system 1051 may be included in the processor core complex 12, the timing controller 581, the display 18, or any other suitable component of the device 10. As illustrated, the system 1051 includes the current-voltage compensation circuit 586 of FIG. 31, which receives as inputs the degradation ratios $r_1$ 1052, $r_2$ 1054, an input voltage $V_{in}$ 1056, and an input current $I_{in}$ 1058.

The degradation ratios $r_1$ 1052, $r_2$ 1054 for each pixel may be saved in any suitable storage device or mechanism, such as the local memory 14, the main memory storage device 16, the look-up tables 582, or the like. The input voltage $V_{in}$ 1056 may be received from a gamma-to-voltage converter 1060 based at least in part on an input gamma or gray level $G_{in}$ 1062. The input gamma $G_{in}$ 1062 may be a target gamma intended to be displayed by a pixel, and the input voltage $V_{in}$ 1056 may be the data voltage corresponding to producing the input gamma $G_{in}$ 1062 prior to compensation. The input current $I_{in}$ 1058 may be received from a reference array look-up table 1064, which may store data voltages and corresponding pixel currents of one or pixels of the reference array 64. The reference array look-up table 1064 may be part of the look-up tables 582, and be based at least in part on the input voltage $V_{in}$ 1056. In particular, the input current $I_{in}$ 1058 may be a resulting current produced by a pixel of the reference array 64 when a data voltage of the input voltage $V_{in}$ 1056 is provided to the pixel.

The current-voltage compensation circuit 586 may output $V_{out}$ 1066 based at least in part on the inputs, which may correspond to a compensated data voltage to produce the input current $I_{in}$ 1058 at the pixel based at least in part on a current-voltage curve generated (e.g., interpolated) using the degradation ratios $r_1$ 1052, $r_2$ 1054. The output voltage $V_{out}$ 1066 may be converted by the voltage-to-gamma converter 1068 to a gamma value $G_{out}$ 1070, which may be sent to the digital-to-analog converter 572 to drive the pixel 574. Driving the pixel 574 to emit the gamma value $G_{out}$ 1070 may result in the pixel 574 actually emitting approximately the input gamma value $G_{in}$ 1062, thus compensating for current-voltage degradation in the pixel 574.

Figure 63:
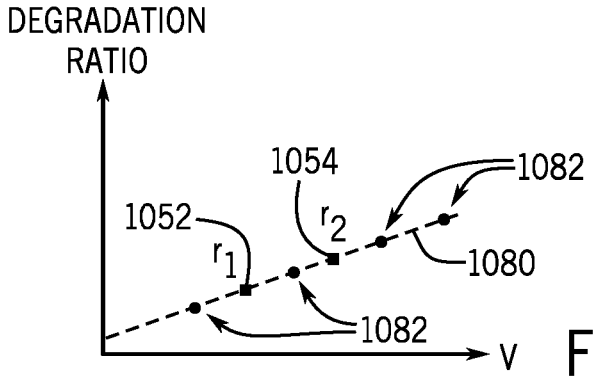
FIG. 63 is a graph illustrating a linear relationship of degradation ratios for a pixel of the display of FIG. 7, according to an embodiment of the present disclosure.

FIG. 63 is a graph illustrating a linear relationship 1080 of degradation ratios for a pixel of the display 18 of FIG. 7, according to an embodiment of the present disclosure. Using the two degradation ratios $r_1$ 1052, $r_2$ 1054, the current-voltage compensation circuit 586 may generate or extrapolate the linear relationship 1080 (e.g., with respect to voltage). The current-voltage compensation circuit 586 may also determine or extrapolate degradation ratios or tap points 1082 based at least in part on the linear relationship 1080.

Figure 64:
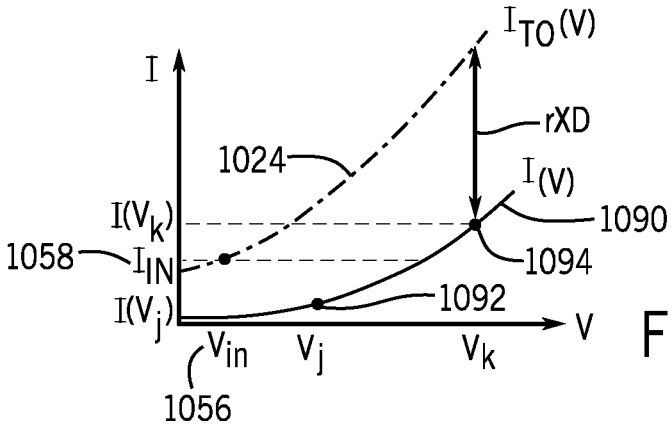
FIG. 64 is a graph illustrating reconstructing a current-voltage curve based at least in part on two extrapolated current-voltage values, according to an embodiment of the present disclosure.

FIG. 64 is a graph illustrating reconstructing a current-voltage curve I(V) 1090 based at least in part on two extrapolated current-voltage values 1092, 1094, according to an embodiment of the present disclosure. As illustrated, the graph includes the reference current-voltage curve $I_{TO}$ (V) 1024 and the input current $I_{in}$ 1058, which is the current of the reference current-voltage curve at $V_{in}$ 1056 (e.g., $I_{TO}(V_{in})$). The current-voltage compensation circuit 586 may convert the extrapolated degradation ratios or tap points 1082 into extrapolated current-voltage values. The current-voltage compensation circuit 586 may then determine two extrapolated current-voltage values ($V_j$, $I_j$) 1092, ($V_k$, $I_k$) 1094 based at least in part on their respective current values, which satisfy the condition: $I(V_j)<I_{in}<I(V_k)$.

Figure 65:
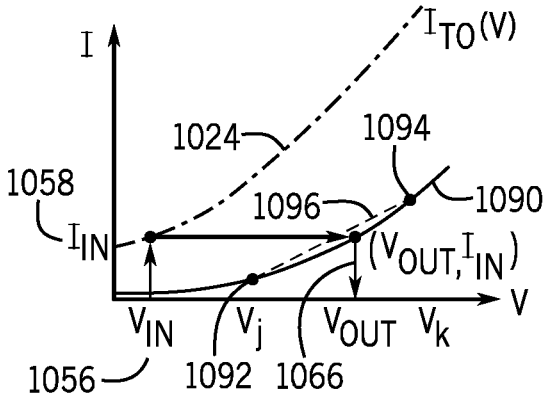
FIG. 65 is a graph illustrating determining output voltage used to drive a pixel and compensate for voltage degradation, according to an embodiment of the present disclosure.

FIG. 65 is a graph illustrating determining the output voltage $V_{out}$ 1066 used to drive the pixel and compensate for voltage degradation, according to an embodiment of the present disclosure. The current-voltage compensation circuit 586 may interpolate the output voltage $V_{out}$ 1066 from $I(V_j)$ and $I(V_k)$. For example, the current-voltage compensation circuit 586 may generate a curve 1096 between the two extrapolated current-voltage values ($V_j$, $I_j$) 1092 and ($V_k$, $I_k$) 1094, and select the output voltage $V_{out}$ 1066 on the curve 1096 that approximately corresponds to the input current $I_{in}$ 1058. The output voltage $V_{out}$ 1066 may be converted by the voltage-to-gamma converter 1068 to a gamma value $G_{out}$ 1070, which may be sent to the digital-to-analog converter 572 to drive the pixel 574. Driving the pixel 574 to emit the gamma value $G_{out}$ 1070 may result in the pixel 574 actually emitting approximately the input gamma value $G_{in}$ 1062, thus compensating for current-voltage degradation in the pixel 574.

Figure 66:
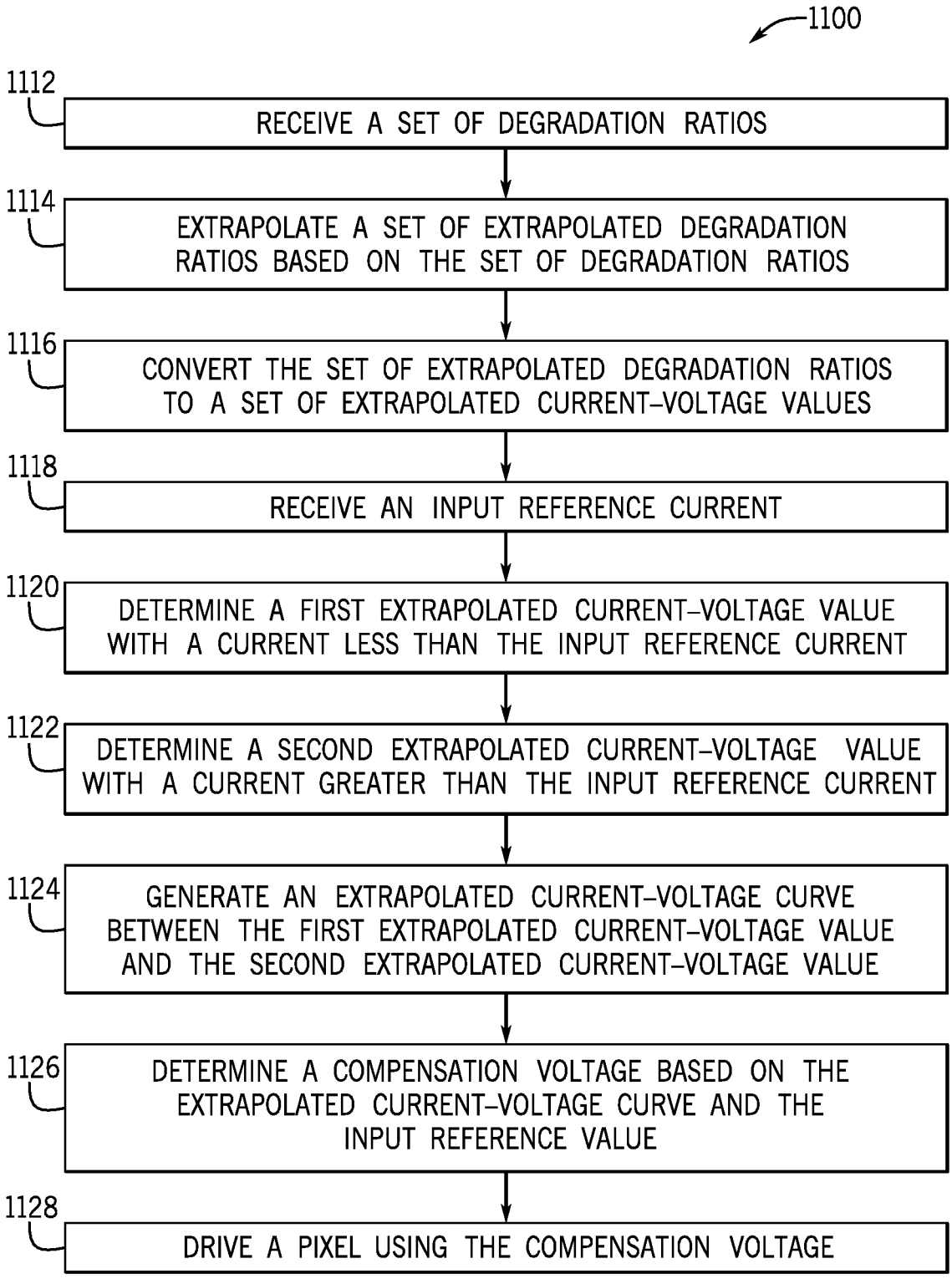
FIG. 66 is a flow diagram of a method for compensating for current-voltage degradation to drive a pixel of the display of FIG. 7, according to an embodiment of the present disclosure.

FIG. 66 is a flow diagram of a method 1110 for compensating for current-voltage degradation to drive a pixel of the display 18 of FIG. 7, according to an embodiment of the present disclosure. The method 1110 may be performed by any suitable device or combination of devices that may extrapolate data, generate a current-voltage curve, and drive a pixel. While the method 1110 is described using steps in a specific sequence, it should be understood that the present disclosure contemplates that the described steps may be performed in different sequences than the sequence illustrated, and certain described steps may be skipped or not performed altogether. In some embodiments, at least some of the steps of the method 1110 may be performed by the current-voltage compensation circuit 586 of FIG. 31, as described below. However, it should be understood that any suitable device or combination of devices is contemplated to perform the method 1110, such as the digital-to-analog converter 572, the voltage comparator circuit 584, the processor core complex 12, the display 18, and the like.

The current-voltage compensation circuit 586 receives (process block 1112) a set of degradation ratios. A set of degradation ratios (e.g., 1052, 1054) may be received for each pixel, and may be stored in any suitable storage device or mechanism, such as the local memory 14, the main memory storage device 16, the look-up tables 582, or the like.

The current-voltage compensation circuit 586 then extrapolates (process block 1114) a set of extrapolated degradation ratios based at least in part on the set of degradation ratios. For example, the current-voltage compensation circuit 586 may generate or extrapolate a linear relationship 1080 (e.g., with respect to voltage) based at least in part on the set of degradation ratios. The current-voltage compensation circuit 586 may then determine or extrapolate the set of extrapolated degradation ratios or tap points 1082 based at least in part on the linear relationship 1080.

The current-voltage compensation circuit 586 may convert (process block 1116) the set of extrapolated degradation ratios to a set of extrapolated current-voltage values. In particular, the current-voltage relationship of an extrapolated degradation ratio may be expressed as $I(V_x)=I_{TO}(V_x)-r_xD_x$, where $I_{TO}$ is the reference current-voltage curve 1024, $r_x$ is the degradation ratio at data voltage x, and $D_x$ is the current difference between the reference current-voltage curve 1024 and the aged current-voltage curve 1026 at the data voltage x.

The current-voltage compensation circuit 586 may receive (process block 1118) an input reference current. The input current $I_{in}$ 1058 may be received from a reference array look-up table, which may be part of the look-up tables 582, and be based at least in part on the input voltage $V_{in}$ 1056. In particular, the input current $I_{in}$ 1058 may be a resulting current produced by a pixel of the reference array 64 when a data voltage of the input voltage $V_{in}$ 1056 is provided to the pixel.

The current-voltage compensation circuit 586 may determine (process block 1120) a first extrapolated current-voltage value with a current less than the input reference current. The current-voltage compensation circuit 586 may also determine (process block 1122) a second extrapolated current-voltage value with a current greater than the input reference current. FIG. 65 illustrates an example of a first extrapolated current-voltage value ($V_j$, $I_j$) 1092 and a second extrapolated current-voltage value ($V_k$, $I_k$) 1094. In some embodiments, the first extrapolated current-voltage value may be the extrapolated current-voltage value in the set of extrapolated current-voltage values that is less than and closest to the input reference current. Similarly, the second extrapolated current-voltage value may be the extrapolated current-voltage value in the set of extrapolated current-voltage values that is greater than and closest to the input reference current.

The current-voltage compensation circuit 586 may then generate (process block 1124) an extrapolated current-voltage curve based at least in part on the first extrapolated current-voltage value and the second extrapolated current-voltage value. For example, FIG. 65 illustrates an example of the extrapolated current-voltage curve 1096 based at least in part on the first extrapolated current-voltage value ($V_j$, $I_j$) 1092 and second extrapolated current-voltage value ($V_k$, $I_k$) 1094.

The current-voltage compensation circuit 586 may determine (process block 1126) a compensation voltage or current based at least in part on the extrapolated current-voltage curve and the input reference current. The current-voltage compensation circuit 586 may determine the compensation voltage (e.g., the output voltage $V_{out}$ 1066) or current as given by the extrapolated current-voltage curve 1096 at the input reference current (e.g., $I_{in}$ 1058).

The current-voltage compensation circuit 586 may then drive (process block 1128) or instruct the digital-to-analog converter 572 to drive a pixel (e.g., 574) using the compensation voltage or current. The compensation voltage or current may enable the digital-to-analog converter 572 to approximately supply the input reference current (e.g., $I_{in}$ 1058) to the pixel, thus emitting a gamma closer to the input gamma 1062 (when compared to operation without compensation). In this manner, the method 1110 may compensate for current-voltage degradation in the pixel.

In some embodiments, the current step limiter circuitry 72 of the active array control circuitry 85 may limit the compensation current or the current corresponding to the compensation voltage. In particular, the current step limiter circuitry 72 may be used to limit the compensation current or the current corresponding to the compensation voltage below a visibility threshold. The visibility threshold may correspond to a current value change that a viewer of the display 18 may not perceive when applied to driving the pixel 574 (as compared to driving the pixel 574 prior to applying the compensation current or the current corresponding to the compensation voltage). In this manner, the viewer may not notice the applied compensation, improving the overall viewing experience of the display 18.

The specific embodiments described above have been shown by way of example, and it should be understood that these embodiments may be susceptible to various modifications and alternative forms. It should be further understood that the claims are not intended to be limited to the particular forms disclosed, but rather to cover all modifications, equivalents, and alternatives falling within the spirit and scope of this disclosure.

The techniques presented and claimed herein are referenced and applied to material objects and concrete examples of a practical nature that demonstrably improve the present technical field and, as such, are not abstract, intangible or purely theoretical. Further, if any claims appended to the end of this specification contain one or more elements designated as "means for [perform]ing [a function] . . . " or "step for [perform]ing [a function] . . . ", it is intended that such elements are to be interpreted under 35 U.S.C. 112(f). However, for any claims containing elements designated in any other manner, it is intended that such elements are not to be interpreted under 35 U.S.C. 112(f).

What is claimed is:

1. A mobile electronic device comprising:

a display comprising an active array and a reference array, wherein the active array comprises a pixel and the reference array comprises a reference pixel; and processing circuitry communicatively coupled to the display, wherein the processing circuitry is configured to drive the pixel based at least in part on a degraded current-voltage relationship of the pixel, a reference current-voltage relationship of the reference pixel, and an aged current-voltage relationship, wherein the aged current-voltage relationship is determined based on a stress applied to one or more pixels of an additional display, and wherein the aged current-voltage relationship is stored in a storage component accessible to the processing circuitry.

2. The mobile electronic device of claim 1, wherein the aged current-voltage relationship is based at least in part on a periphery pixel of an additional active array of the additional display.

3. The mobile electronic device of claim 1, wherein the processing circuitry comprises one or more look-up tables configured to store a set of degraded current-voltage values of the pixel associated with the degraded current-voltage relationship.

4. The mobile electronic device of claim 3, wherein the processing circuitry comprises a voltage comparator circuit configured to generate the degraded current-voltage relationship based at least in part on the set of degraded current-voltage values.

5. The mobile electronic device of claim 3, wherein the processing circuitry comprises a voltage comparator circuit configured to:

determine a set of degradation ratios based at least in part on the set of degraded current-voltage values, the reference current-voltage relationship, and the aged current-voltage relationship; and generate the degraded current-voltage relationship based at least in part on the set of degradation ratios.

6. The mobile electronic device of claim 5, wherein each degradation ratio of the set of degradation ratios is based at least in part on:

a first difference in current between a respective reference current-voltage value associated with the reference current-voltage relationship and a respective degraded current-voltage value of the set of degraded current-voltage values; and a second difference in current between the respective reference current-voltage value and a respective degraded current-voltage value of the set of degraded current-voltage values and an aged current-voltage value associated with the aged current-voltage relationship.

7. A method comprising:

extrapolating, via processing circuitry, a set of extrapolated degradation ratios based at least in part on a set of received degradation ratios;

determining, via the processing circuitry, a first extrapolated current-voltage value based at least in part on a first extrapolated degradation ratio of the set of extrapolated degradation ratios comprising a first current less than a reference current;

determining, via the processing circuitry, a second extrapolated current-voltage value based at least in part on a second extrapolated degradation ratio of the set of extrapolated degradation ratios comprising a second current greater than the reference current;

generating, via the processing circuitry, an extrapolated current-voltage curve between the first extrapolated current-voltage value and the second extrapolated current-voltage value;

determining, via the processing circuitry, a compensation voltage based at least in part on the extrapolated current-voltage curve and the reference current; and instructing, via the processing circuitry, a digital-to-analog converter to drive a pixel using the compensation voltage.

8. The method of claim 7, comprising converting the set of extrapolated degradation ratios to a set of extrapolated current-voltage values, wherein the set of extrapolated current-voltage values comprises the first extrapolated current-voltage value and the second extrapolated current-voltage value.

9. The method of claim 8, wherein the first current is the closest current among currents of the set of extrapolated current-voltage values less than the reference current.

10. The method of claim 8, wherein the second current is the closest current among currents of the set of extrapolated current-voltage values greater than the reference current.

11. The method of claim 7, wherein the reference current is configured to be produced at a reference pixel of a reference array when a reference voltage is supplied.

12. The method of claim 11, wherein a diode of the reference pixel is configured to emit a target grey level when the reference voltage is supplied to the pixel.

13. The method of claim 12, wherein instructing, via the processing circuitry, the digital-to-analog converter to drive the pixel using the compensation voltage approximately produces the target grey level at a second diode of the pixel.

14. The method of claim 11, wherein driving, via the processing circuitry, the pixel using the compensation voltage is configured to approximately produce the reference current at the pixel.

15. The method of claim 7, wherein the extrapolated current-voltage curve is linear.

16. A mobile electronic device comprising:

a display comprising an active array, a reference array, and a digital-to-analog converter, wherein the active array comprises a pixel; and;

processing circuitry communicatively coupled to the display, wherein the processing circuitry comprises:

a current-voltage compensation circuit configured to:

receive a plurality of degradation ratios, an input voltage, and an input reference current; and output a compensation voltage based at least in part on the plurality of degradation ratios, the input voltage, and the input reference current, wherein the digital-to-analog converter drives the pixel based at least in part on the compensation voltage.

17. The mobile electronic device of claim 16, wherein the processing circuitry comprises a gamma-to-voltage converter configured to convert an input gray level to the input voltage.

18. The mobile electronic device of claim 17, wherein the processing circuitry comprises a voltage-to-gamma converter configured to convert the compensation voltage to an output gray level.

19. The mobile electronic device of claim 18, wherein a diode of the pixel is configured to approximately emit the input gray level when the digital-to-analog converter drives the pixel to output the output gray level.

20. The mobile electronic device of claim 16, wherein the processing circuitry comprises a reference array look-up table configured to store the input voltage and the input reference current.

* * * * *